US007254955B2

(12) United States Patent
Otake et al.

(10) Patent No.: US 7,254,955 B2
(45) Date of Patent: Aug. 14, 2007

(54) HEAT EXCHANGE APPARATUS AND REFRIGERATING MACHINE

(75) Inventors: Masahisa Otake, Gunma (JP); Koji Sato, Gunma (JP); Hiroshi Mukaiyama, Gunma (JP); Ichiro Kamimura, Gunma (JP); Norio Sawada, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 235 days.

(21) Appl. No.: 11/177,644

(22) Filed: Jul. 11, 2005

(65) Prior Publication Data

US 2006/0005558 A1 Jan. 12, 2006

(30) Foreign Application Priority Data

Jul. 12, 2004 (JP) ..... P2004-204333
May 31, 2005 (JP) ..... P2005-159372

(51) Int. Cl.
*F25B 27/00* (2006.01)

(52) U.S. Cl. ..... 62/238.7; 62/324.1

(58) Field of Classification Search ..... 62/238.6, 62/238.7, 260, 324.1, 476
See application file for complete search history.

(56) References Cited

U.S. PATENT DOCUMENTS 5,161,739 A * 11/1992 Saito et al. ..... 237/9 R
6,119,478 A * 9/2000 Sada et al. ..... 62/434
6,199,394 B1 * 3/2001 Maeda ..... 62/271
6,223,549 B1 * 5/2001 Kasai ..... 62/324.1

FOREIGN PATENT DOCUMENTS

JP 03-055475 3/1991

* cited by examiner

*Primary Examiner*—Melvin Jones
(74) *Attorney, Agent, or Firm*—McDermott Will & Emery LLP

(57) ABSTRACT

In a refrigerating machine, a water cooling device having a cooling tower or an ice heat storage tank is provided as a heat exchanger for cooling refrigerant after heat-exchange in a heat-source side heat exchanger between an outdoor expansion valve and the heat-source side heat exchanger.

17 Claims, 22 Drawing Sheets

HEAT EXCHANGE APPARATUS AND REFRIGERATING MACHINE

BACKGROUND OF THE INVENTION

1. Field of the Invention

The present invention relates to a heat exchange apparatus having an outdoor unit and a plurality of indoor units in which cooling operation or heating operation can be simultaneously performed in the plural indoor units or both cooling operation and heating operation can be simultaneously performed in a mixing mode in the plural indoor units, and a refrigerating machine having the heat exchange apparatus.

2. Description of the Related Art

There is generally known a refrigerating machine (heat exchange apparatus) in which an outdoor unit and a plurality of indoor units are connected to one another through an inter-unit pipe comprising a high pressure gas pipe, a low pressure gas pipe and a liquid pipe and cooling operation or heating operation can be performed in a plurality of indoor units at the same time, or both cooling operation and heating operation can be performed in a mixing mode in a plurality of indoor units at the same time (see Japanese Patent No. 2804527).

This type of refrigerating machine has a problem that when cooling operation is carried out, the refrigerant temperature at the exit of a heat-source side heat exchanger is increased in connection with increase of the outside air temperature and thus the cooling performance is lowered. Furthermore, it has also a problem that when heating operation is carried out, the refrigerant temperature at the exit of the heat-source side heat exchanger is reduced in connection with decrease of the outside air temperature and thus the heating performance is lowered.

SUMMARY OF THE INVENTION

Therefore, an object of the present invention is to provide a heat exchange apparatus and a refrigerating machine in which the cooling performance or the heating performance can be kept or enhanced even when the outside air temperature increases or decreases and the coefficient of performance can be increased.

In order to attain the above object, according to a first aspect of the present invention, there is provided a heat exchange apparatus including an outdoor unit having a compressor, an outdoor heat exchanger as a heat-source side heat exchanger and an outdoor expansion valve, and at least one indoor unit having an indoor expansion valve and an indoor heat exchanger as a use-side heat exchanger, the outdoor heat exchanger and the indoor heat exchanger being connected to each other through an inter-unit pipe to constitute an heat exchange cycle, characterized by comprising: a first heat exchanger that is disposed between the expansion valve and the heat-source side heat exchanger and carries out heat exchange between heat medium and refrigerant after heat exchange in the heat-source side heat exchanger or carries out heat exchange between the refrigerant and the heat medium in place of the heat-source side heat exchanger during operation, and a second heat exchanger for carrying out heat exchange between the heat medium and a second heat source.

According to the above construction, the first heat exchanger carries out the heat exchange with the heat medium after the heat exchange in the heat-source side heat exchanger or carries out the heat exchange with the heat medium in place of the heat-source side heat exchanger during operation, and the second heat exchanger carries out the heat exchange between the heat medium and the second heat source.

According to a second aspect of the present invention, there is provided a heat exchange apparatus including an outdoor unit having a compressor, an outdoor expansion valve and an outdoor heat exchanger as a heat-source side heat exchanger, and one or plural indoor units each having an indoor expansion valve and an indoor heat exchanger as a use-side heat exchanger, the outdoor unit and the indoor unit being connected through an inter-unit pipe, wherein one end of the outdoor heat exchanger is selectively connected to one of a refrigerant discharge pipe and a refrigerant suction pipe of the compressor, the inter-unit pipe comprises a high pressure pipe connected to the refrigerant discharge pipe, a low pressure pipe connected to the refrigerant suction pipe and an intermediate pressure pipe connected to the other end of the outdoor heat exchanger, one end of each indoor heat exchanger in each of the indoor units is selectively connected to one of the high pressure pipe and the low pressure gas pipe while the other end of the indoor heat exchanger is connected to the intermediate pressure pipe, cooling operation or heating operation can be simultaneously performed in the plural indoor units or both cooling operation and heating operation can be simultaneously performed in a mixing mode in the plural indoor units, and a heat exchanger for carrying out heat exchange between a second heat source and refrigerant after heat exchange in the heat-source side heat exchanger during operation is provided between the outdoor expansion valve and the heat-source side heat exchanger.

According to the above construction, the heat exchanger carries out the heat exchange between the second heat source and the refrigerant after the heat exchange in the heat-source side heat exchanger during operation.

In the above construction, the second heat source may be a natural heat source such as atmospheric air, ground water, river water, seawater, earth's heat or the like.

Furthermore, according to a third aspect of the present invention, there is provided a refrigerating machine including an outdoor unit having a compressor and an outdoor heat exchanger as a heat-source side heat exchanger and an indoor unit having an expansion valve and an indoor heat exchanger as a use-side heat exchanger, the outdoor unit and the indoor unit being connected to each other through an inter-unit pipe to constitute a refrigerating cycle, characterized by comprising a cooling heat exchanger that is disposed between the expansion valve and the heat-source side heat exchanger and cools refrigerant after heat exchanger in the heat-source side heat exchanger during cooling operation.

According to the above construction, the cooling heat exchanger cools the refrigerant after the heat exchange in the heat-source side heat exchanger during cooling operation.

According to a fourth aspect of the present invention, there is provided a refrigerating machine including an outdoor unit having a compressor, an outdoor expansion valve and an outdoor heat exchanger as a heat-source side heat exchanger, and a plurality of indoor units each having an indoor expansion valve and an indoor heat exchanger as a use-side heat exchanger, the outdoor units and the indoor units being connected through an inter-unit pipe, wherein one end of the outdoor heat exchanger is selectively connected to one of a refrigerant discharge pipe and a refrigerant suction pipe of the compressor, the inter-unit pipe comprises a high pressure pipe connected to the refrigerant discharge pipe, a low pressure pipe connected to the refrigerant suction pipe and an intermediate pressure pipe connected to the other end of the outdoor heat exchanger, one end of each indoor heat exchanger in each of the indoor units is selectively connected to one of the high pressure pipe and the low pressure gas pipe while the other end of the indoor heat exchanger is connected to the intermediate pressure pipe, cooling operation or heating operation can be simultaneously performed in the plural indoor units or both cooling operation and heating operation can be simultaneously performed in a mixing mode in the plural indoor units, and a cooling heat exchanger for cooling refrigerant just after heat exchange in the heat-source side heat exchanger between the outdoor expansion valve and the heat-source side heat exchanger during cooling operation is provided.

In the above construction, a water cooling type heat exchanger that is disposed between the outdoor expansion valve and the heat-source side heat exchanger and cools the refrigerant after the heat exchange in the heat-source side heat exchanger during cooling operation and a cooling tower for cooling water of the water cooling type heat exchanger may be provided as the cooling heat exchanger.

Furthermore, as the cooling heat exchanger or in addition to the cooling heat exchanger may be provided an ice thermal storage tank that is disposed between the outdoor expansion valve and the heat-source side heat exchanger and cools the refrigerant after the heat exchange in the heat-source side heat exchanger during cooling operation.

Still furthermore, the compressor may be equipped with an intermediate pressure portion into which refrigerant having intermediate pressure higher than refrigerant pressure at a suction side and lower than refrigerant pressure at a discharge side can be introduced, and there may be provided an intermediate pressure receiver that is interposed in a flow path connecting an expansion valve of the heat-source side heat exchanger and an expansion valve of the use-side heat exchanger, separates gas-liquid mixture refrigerant after the heat exchange in the heat-source side heat exchanger or the use-side heat exchanger into gas-phase refrigerant and liquid-phase refrigerant, and introducing the gas-phase refrigerant to the intermediate pressure portion of the compressor.

Still furthermore, the compressor may be equipped with an intermediate pressure portion into which refrigerant having intermediate pressure higher than refrigerant pressure at a suction side and lower than refrigerant pressure at a discharge side can be introduced, and there may be provided a heat exchange circuit for branching refrigerant flowing from one of the heat-source side heat exchanger and the use-side heat exchanger to the other heat exchanger, carrying out heat exchange between one branched refrigerant and one of the other branched refrigerant and the refrigerant before the branching to set the one branched refrigerant to gas-phase refrigerant and then introducing the gas-phase refrigerant thus achieved to the intermediate pressure portion.

The pressure of the refrigerant at a high pressure side may be supercritical during operation.

Carbon dioxide may be used as the refrigerant.

According to the present invention, even when the ambient temperature of the heat-source side heat exchanger is high during cooling operation, the refrigerant at the exit of the heat-source side heat exchanger can be cooled to a temperature which is further lower than the ambient temperature, or even when the ambient temperature of the heat-source side heat exchanger is low during heating operation, the refrigerant at the exit of the heat-source side heat exchanger can be heated to a temperature which is further higher than the ambient temperature, so that cooling performance or heating performance can be enhanced.

DETAILED DESCRIPTION OF THE PREFERRED EMBODIMENTS

Preferred embodiments according to the present invention will be described hereunder with reference to the accompanying drawings.

[1] First Embodiment

Figure 1:
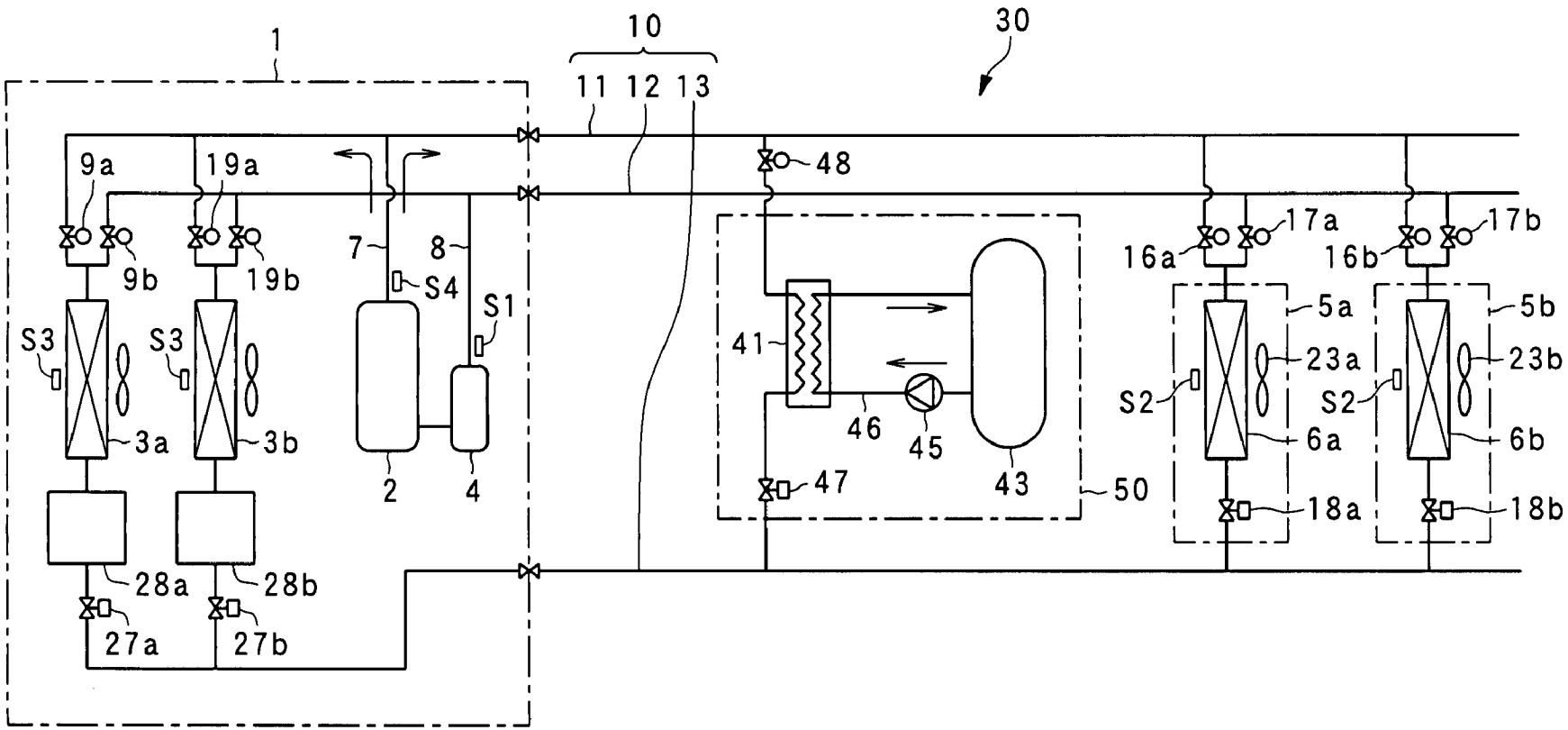
FIG. 1 is a refrigerant circuit diagram showing a refrigerant machine according to a first embodiment.
Figure 2:
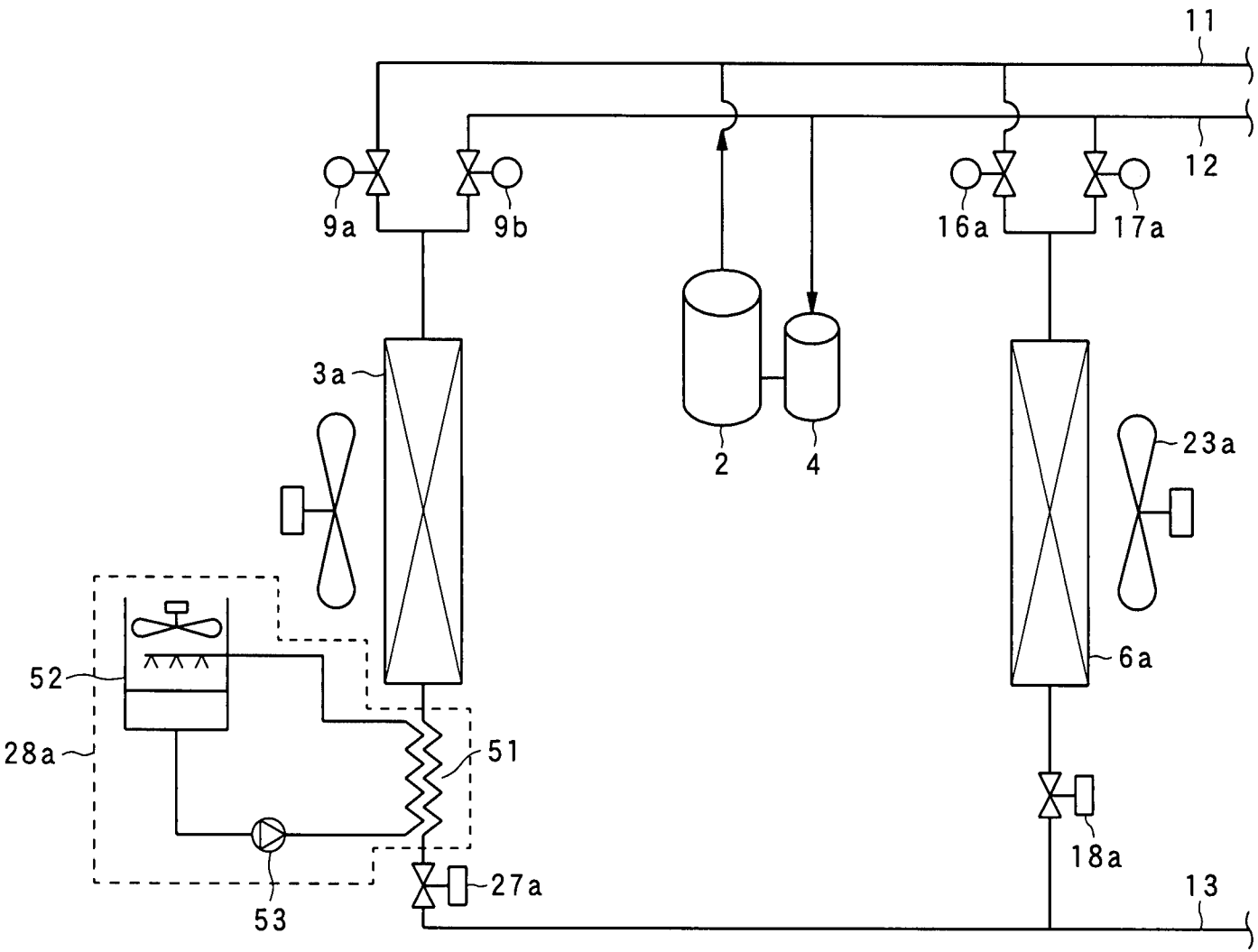
FIG. 2 is a diagram showing the main part of the first embodiment.

FIG. 1 is a refrigerant circuit diagram showing a refrigerating machine (heat exchange device) according to a first embodiment. FIG. 2 is a diagram showing the main part of the first embodiment.

The refrigerating machine 30 comprises an outdoor unit 1 having a compressor 2, outdoor heat exchangers 3*a*, 3*b*, outdoor expansion valves 27*a*, 27*b* and water cooling devices 28*a*, 28*b*, an indoor unit 5*a* having an indoor heat exchanger 6*a* and an indoor expansion valve 18*a*, an indoor unit 5*b* having an indoor heat exchanger 6*b* and an indoor expansion valve 18*b*, and a hot-water stocking unit 50 having a hot water stocking heat exchanger 41, a hot water stocking tank 43, a circulating pump 45 and an expansion valve 47.

The outdoor unit 1, the indoor units 5*a*, 5 band the hot-water stocking unit 50 are connected to one another through an inter-unit pipe 10, and the refrigerating machine 30 allow the indoor units 5*a*, 5*b* to carry out cooling operation or heating operation at the same time or to carry out both cooling operation and heating operation in a mixing mode at the same time while driving the hot-water stocking unit 50.

In the outdoor unit 1, one end of the outdoor heat exchanger 3*a* is exclusively connected to the discharge pipe 7 or suction pipe 8 of the compressor 2 through a change-over valve 9*a* or a change-over valve 9*b*. Likewise, one end of the outdoor heat exchanger 3*b* is exclusively connected to the discharge pipe 7 or suction pipe 8 of the compressor 2 through a change-over valve 19*a* or a change-over valve 19*b*. An accumulator 4 is disposed in the suction pipe 8.

The outdoor unit 1 is equipped with an outdoor control device (not shown), and the outdoor control device controls the compressor 2, the outdoor expansion valves 27*a*, 27*b*, the change-over valves 9*a*, 19*a*, 9*b*, 19*b* in the outdoor unit 1 and the whole refrigerating machine 30.

Furthermore, the water cooling devices 28*a*, 28*b* of the outdoor unit 1 have the same construction. Specifically, as shown by using the water cooling device 28*a*, the water cooling device 28*a* includes a water cooing type heat exchanger 51 which is connected to the outdoor heat exchanger 3*a* (3*b*) and the outdoor expansion valve 27*a* (27*b*) and cools (heat-exchanges) refrigerant discharged from the outdoor heat exchanger 3*a* (3*b*) with water during cooling operation, a cooing tower 52 for cooling the water after the heat exchange with outdoor air, and a cooling water pump 53 for circulating cooling water.

In this case, the pressure ratio can be reduced by cooling the refrigerant with water, and also the enthalpy difference can be increased. When the same capability is secured, the refrigerant circulating amount can be reduced. In other words, in addition to the reduction of the pressure ratio, the compression driving force can be reduced, and the coefficient of performance (COP) of refrigeration can be enhanced.

The inter-unit pipe 10 comprises a high pressure pipe (high pressure gas pipe) 11, a low pressure pipe (low pressure gas pipe) 12 and an intermediate pressure pipe (liquid pipe) 13. The high pressure pipe 11 is connected to the discharge pipe 7, and the low pressure pipe 12 is connected to the suction pipe 8. The intermediate pressure 13 is connected to the other ends of the outdoor heat exchangers 3*a*, 3*b* through the outdoor expansion valves 27*a*, 27*b* and the water cooling devices 28*a*, 28*b*.

One ends of the indoor heat exchangers 6*a*, 6*b* of the indoor units 5*a*, 5*b* are connected to the high pressure pipe 11 through the discharge side valves 16*a*, 16*b*, and also connected to the low pressure pipe 12 through the suction side valves 17*a*, 17*b*. The other ends thereof are connected to the intermediate pressure pipe 13 through the indoor expansion valves 18*a*, 18*b*.

The discharge side valve 16*a* and the suction side valve 17*a* are designed so that when one of the valves is opened, the other valve is closed. The discharge side valve 16*b* and the suction side valve 17*b* are likewise designed so that when one of the valves is opened, the other valve is closed.

Accordingly, one end of each indoor heat exchanger 6*a*, 6*b* is selectively connected to one of the high pressure pipe 11 and the lower pressure pipe 12 of the inter-unit pipe 10.

The indoor unit 5*a*, 5*b* has an indoor fan 23*a*, 23*b*, a remote controller and an indoor control device. The indoor fans 23*a*, 23*b* are disposed in proximity to the indoor heat exchangers 6*a*, 6*b* respectively, and blow air to the indoor heat exchangers 6*a*, 6*b*, respectively. Furthermore, each remote controller is connected to each indoor unit 5*a*, 5*b*, and outputs a cooling or heating operation instruction, a stop instruction or the like to each indoor unit 5*a*, 5*b*.

In the hot water stocking unit 50, one end of the hot water stocking heat exchanger 41 is connected to the high pressure pipe 11 through a switching valve 48, and the other end of the hot water stocking heat exchanger 41 is connected to the intermediate pressure pipe 13 through the expansion valve 47. A water pipe 46 is connected to the hot water stocking heat exchanger 41, and the hot water stocking tank 43 is connected to the water pipe 46 through the circulating pump 45.

In this embodiment, carbon dioxide refrigerant is filled in the pipes in the outdoor unit 1, the indoor units 5*a*, 5*b* and the hot water stocking unit 50.

Figure 3:
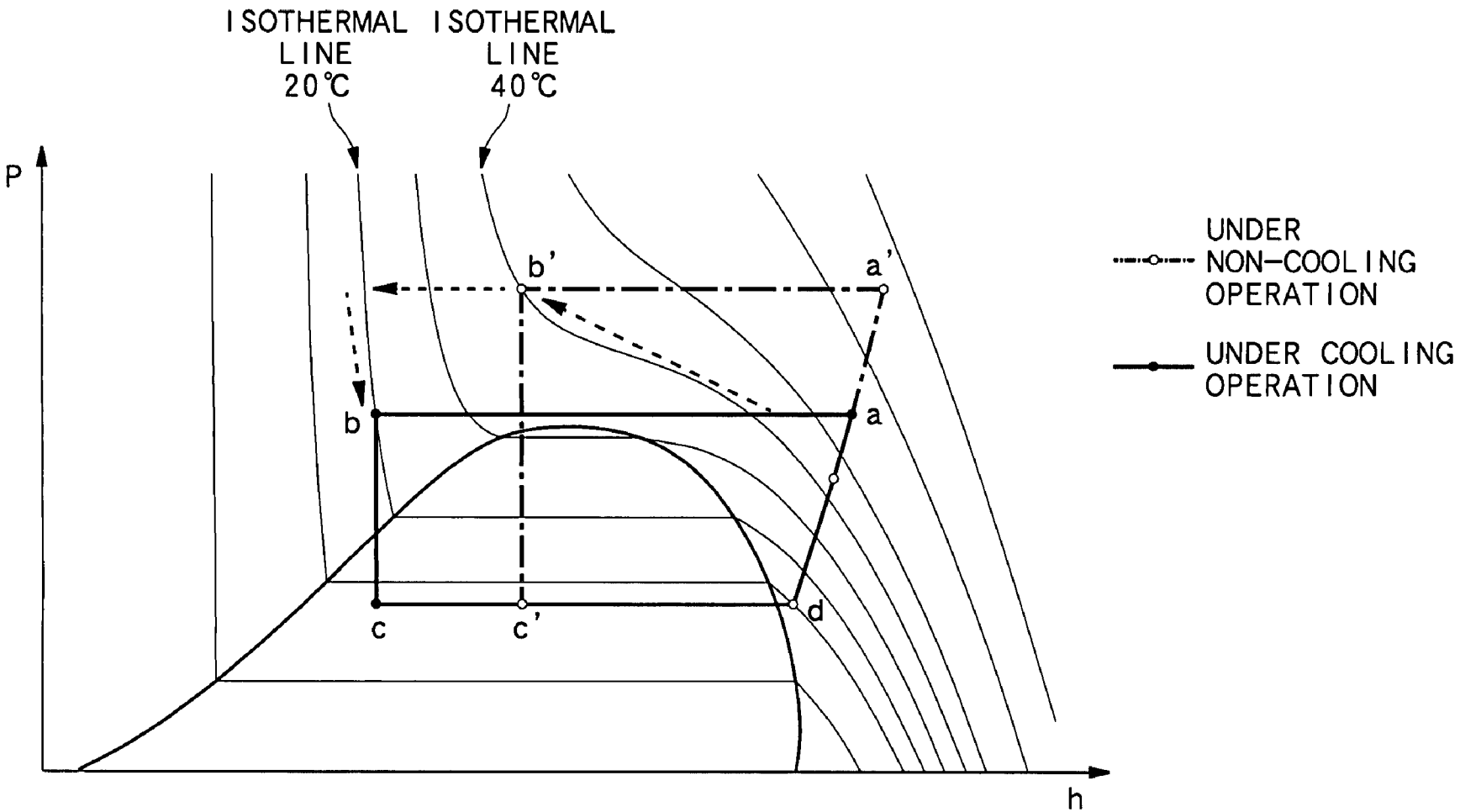
FIG. 3 is a pressure-enthalpy chart of the first embodiment.

FIG. 3 is a pressure-enthalpy chart of the first embodiment.

When carbon dioxide refrigerant is filled as the refrigerant, the inside of the high-pressure pipe 11 is operated under supercritical pressure during operation as shown in FIG. 3. That is, the pressure of the refrigerant at the high pressure side is supercritical during operation. In addition to the carbon dioxide refrigerant, ethylene, diborane, ethane, nitrogen oxide or the like may be used as the refrigerant with which the inside of the high pressure pipe 11 is operated under supercritical pressure.

In FIG. 3, when no cooling operation is carried out in the water cooling devices 28*a*, 28*b* (for example, when the cooling is allowed till 40° C. at maximum), it is necessary to increase the high-pressure side pressure (=the refrigerant pressure in the discharge pipe 7 of the compressor 2) to achieve a necessary enthalpy difference as indicated by a one-dotted chain line of symbols a'→b'→c'→d in the pressure-enthalpy chart.

On the other hand, when cooling is carried out in the water cooling devices 28*a*, 28*b* of this embodiment (for example, cooling is allowed till 20° C.), the high-pressure side pressure to achieve a necessary enthalpy difference can be reduced as indicated by a solid line of symbols a→b→c→d, and the compression driving force in the compressor 2 can be reduced.

Next, the operation of the refrigerating machine 30 will be described.

Cooling Operation

First, the operation of the refrigerating machine during cooling operation will be described.

When cooling operation is carried out in the indoor units 5*a*, 5*b*, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the stop state.

In this case, the opening degrees of the outdoor expansion valves 27*a*, 27*b* and the indoor expansion valves 18*a*, 18*b* are controlled so that a temperature sensor S4 detects a predetermined temperature and the difference between the detected temperature of a temperature sensor S1 and the detected temperature of a temperature sensor S2 (corresponding to the superheat degree) is equal to a fixed value.

When the compressor 2 is driven under the above state, the refrigerant discharged from the compressor 2 successively flows through the discharge pipe 7, the change-over valves 9*a*, 19*a* and the outdoor heat exchangers 3*a*, 3*b* in this order.

The refrigerant is heat-exchanged in the outdoor heat exchangers 3*a*, 3*b*, and then reaches the water cooling type heat exchangers 51 constituting the water cooling devices 28*a*, 28*b*.

Accordingly, the respective water cooling type heat exchangers 51 cool (heat-exchange) the refrigerant discharged from the outdoor heat exchangers 3*a*, 3*b* with water, and then make the refrigerant thus cooled to the outdoor expansion valves 27*a*, 27*b*.

At this time, the water that has been heat-exchanged in the water cooling type heat exchangers 51 are fed to the cooling towers 52, and cooled with the outside air. Thereafter, the water is circulated through the cooling water pumps 53 to the water cooling type heat exchangers 51 again.

The refrigerant passing through the water cooling devices 28*a*, 28*b* passes through the outdoor expansion valves 27*a*, 27*b*, flows into the intermediate pressure pipe 13, and then is distributed to the indoor expansion valves 18*a*, 18*b* of the indoor units 5*a*, 5*b* to be reduced in pressure.

Thereafter, the refrigerant is evaporated in the indoor heat exchangers 6*a*, 6*b*, and flows through the suction side valves 17*a*, 17*b*. Thereafter, the refrigerant is successively passed through the low pressure pipe 12, the suction pipe 8 and the accumulator 4, and then sucked into the compressor 2. As described above, cooling operation is carried out in all the indoor units 5*a*, 5*b* at the same time by the action of each indoor heat exchanger 6*a*, 6*b* functioning as an evaporator.

According to the construction as described above, the water cooling devices 28*a*, 28*b* cool (heat-exchange) the refrigerant discharged from the outdoor heat exchangers 3*a*, 3*b* with water, and thus the high pressure side pressure to achieve a necessary enthalpy difference can be reduced, so that the compression driving force in the compressor 2 can be reduced.

Heating Operation

Next, the operation of the refrigerating machine under heating operation will be described. In this case, the water cooling devices 28*a*, 28*b* are controlled so that they do no operation.

When heating operation is carried out in the indoor units 5*a*, 5*b*, the change-over valves 9*a*, 19*a* of the outdoor heat exchangers 3*a*, 3*b* are closed, and the other change-over valves 9*b*, 19*b* are opened. In addition, the discharge side valves 16*a*, 16*b* are opened, and the suction side valves 17*a*, 17*b* are closed.

Accordingly, the refrigerant discharged from the compressor 2 successively passes through the discharge pipe 7 and the high pressure pipe 11, and then flows to the discharge side valves 16*a*, 16*b* and the indoor heat exchangers 6*a*, 6*b*. The refrigerant is not condensed, but heat-exchanged in the indoor heat exchangers 6*a*, 6*b*, and it is passed through the indoor expansion valves 18*a*, 18*b*, and distributed through the intermediate pressure pipe 13 to the indoor expansion valves 27*a*, 27*b* of the outdoor units 3*a*, 3*b* to be reduced in pressure.

Thereafter, the refrigerant is passed through the water cooling devices 28*a*, 28*b* without being heat-exchanged, and evaporated in the outdoor heat exchangers 3*a*, 3*b*. Thereafter, the refrigerant thus evaporated flows through the change-over valves 9*b*, 19*b*, and then it is successively passed through the low pressure pipe 12, the suction pipe 8 and the accumulator 4 and sucked into the compressor 2.

As described above, heating operation is simultaneously carried out in all the indoor units 5*a*, 5*b*, not by the condensation action, but by the heat-exchange action in the indoor heat exchangers 6*a*, 6*b*.

Cooling and Heating Mixed Operation

Next, the operation of the refrigerating machine under cooling and heating mixed operation will be described.

When cooling operation and heating operation are simultaneously carried out indifferent indoor units, for example when cooling operation is carried out in the indoor unit 5*a* while heating operation is carried out in the indoor unit 5*b* and a cooling load is larger than a heating load, the change-over valves 9*a*, 19*a* of the outdoor heat exchangers 3*a*, 3*b* are opened, and the other change-over valves 9*b*, 19*b* are closed. Furthermore, the discharge side valve 16*a* corresponding to the indoor unit 5*a* to be cooled is closed and the suction side valve 17*a* is opened. Still furthermore, the discharge side valve 16*b* corresponding to the indoor unit 5*b* to be heated is opened, and the suction side valve 17*b* is closed.

As a result, a part of the refrigerant discharged from the compressor 2 successively passes through the discharge pipe 7 and the change-over valves 9*a*, 19*a* and then flows to the outdoor heat exchanger 3*a*. The refrigerant is heat-exchanged in the outdoor heat exchanger 3*a*, and then reaches the water cooling type heat exchanger 51 constituting the water cooling device 28*a*.

Accordingly, the water cooling type heat exchanger 51 cools (heat-exchanges) the refrigerant discharged from the outdoor heat exchanger 3*a* with water, and makes the refrigerant thus cooled to the outdoor expansion valve 27*a*. At this time, the water heat-exchanged in the water cooling type heat exchanger 51 flows to the cooling tower 52 to be cooled with the outside air, and then circulated through the cooling water pump 53 to the cooling type heat exchanger 51 again. The refrigerant passing through the water cooling device 28*a* flows through the outdoor expansion valve 27*a* to the intermediate pressure pipe 13.

Furthermore, the residual refrigerant which does not flow to the outdoor heat exchanger 3 passes through the high pressure pipe 11 and flows to the discharge side valve 16*b* and the indoor heat exchanger 6*b* corresponding to the indoor unit 5*b* to be heated, and subjected to the non-condensation heat-exchange action in the indoor heat exchanger 6*b* and the outdoor heat exchanger 3.

The refrigerant heat-exchanged in the indoor heat exchanger 6*b* and the outdoor heat exchanger 3 is passed through the intermediate pressure pipe 13, and reduced in pressure in the indoor expansion valve 18*a* of the indoor unit 5*a*, and then evaporated in the indoor heat exchanger 6*a*. Thereafter, the refrigerant flows to the suction side valve 17*a* and interflows in the low pressure pipe 12, and then it is successively passed through the suction pipe 8 and the accumulator 4, and sucked into the compressor 2. As described above, heating operation is carried out in the indoor unit 5*b* by the heat-exchange action of the indoor heat exchanger 6*b*, and cooling operation is carried out in the indoor unit 5*a* by the action of the other indoor heat exchanger 6*a* functioning as an evaporator.

Cooling Operation+Hot-Water Stocking Operation (Part 1)

Next, the operation of the refrigerating machine under the (cooling operation+hot-water stocking operation) will be described.

When the (cooling operation+hot-water stocking operation) is carried out, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the driving state. Furthermore, the switching valve 48 for connecting the high pressure pipe 11 to the hot-water stocking heat exchanger 41 is opened.

When the compressor 2 is driven under the above state, a part of the refrigerant discharged from the compressor 2 is led through the discharge pipe 7, the high pressure pipe 11 and the switching valve 48 to the hot-water stocking heat-exchanger 41. In the hot-water stocking heat exchanger 41, water passing through the water pipe 46 is heated and the high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant after the heat-exchange reaches through the expansion valve 47 to the intermediate pipe 13, and it is distributed to the indoor expansion valves 18*a*, 18*b* of the indoor units 5*a*, 5*b* to be reduced in pressure. The refrigerant is further evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator 4, and then sucked into the compressor 2.

On the other hand, the other part of the refrigerant discharged from the compressor 2 successively flows through the discharge pipe 7, the change-over valves 9*a*, 19*a* an the outdoor heat exchangers 3*a*, 3*b* in this order, The refrigerant is heat-exchanged in the outdoor heat exchangers 3*a*, 3*b*, and then reaches the water cooling type heat exchangers 51 constituting the water cooling devices 28*a*, 28*b*.

Accordingly, each water cooling type heat exchanger 51 cools (heat-exchanges) the refrigerant discharged from the outdoor heat exchangers 3*a*, 3*b* with water, and then makes the refrigerant thus cooled to the outdoor expansion valve 27*a*, 27*b*.

At this time, the water heat-exchanged in the water cooling type heat exchangers 51 is fed to the cooling tower 52 and cooled with the outside air, and then circulated through the cooling water pumps 53 to the cooling water type heat exchangers 51 again.

The refrigerant passing through the water cooling devices 28*a*, 28*b* flows through the outdoor expansion valves 27*a*, 27*b* to the intermediate pressure pipe 13, and it is distributed to the indoor expansion valves 18*a*, 18*b* of the indoor units 5*a*, 5*b* to be reduced in pressure.

Thereafter, the refrigerant is evaporated in the indoor heat exchangers 6*a*, 6*b*, and flows through the suction valves 17*a*, 17*b*. Thereafter, it is successively passed through the low pressure pipe 12, the suction pipe 8 and the accumulator 4, and then sucked into the compressor 2. As described above, cooling operation is simultaneously carried out in all the indoor units 5*a*, 5*b* by the action of the indoor heat exchangers 6*a*, 6*b* functioning as evaporators.

Cooling Operation+Hot-Water Stocking Operation (Part 2)

Next, the second operation of the refrigerating machine under the (cooling operation+hot-water stocking operation) will be described.

When the (cooling operation+hot-water stocking operation) is carried out, the change-over valves 9*a*, 19*a*, 9*b* and 19*b* of the outdoor heat exchangers 3*a*, 3*b* are closed. In addition, the discharge side valves 16*a*, 16*b* are closed, and the suction side valves 17*a*, 17*b* are opened. Furthermore, the outdoor fans 29*a*, 29*b* are set to the stop state, the indoor fans 23*a*, 23*b* are set to the driving state, and the circulating pup 45 is set to the driving state. Furthermore, the switching valve 48 for connecting the high pressure pipe 11 and the hot-water stocking heat exchanger 41 is opened.

When the compressor 2 is driven under the above state, the refrigerant discharged from the compressor 2 is led through the discharge pipe 7, the high pressure pipe 11 and the switching valve 48 to the hot-water stocking heat exchanger 41. In the hot-water heat exchanger 41, water passing through the water pipe 46 is heated, and high-temperature water thus achieved is stocked in the hot-water stocking tank 43. Carbon dioxide refrigerant is used as the refrigerant, and the high-pressure supercritical cycle is established, so that the hot water stocked in this tank is kept at about 80° C. or more. The hot water stocked in the hot-water stocking tank 43 is fed to various facilities through pipes (not shown) (hot-water stocking operation).

The refrigerant after the heat-exchange reaches the intermediate pressure pipe 13 through the expansion valve 47, and then it is distributed to the indoor expansion valves 18*a*, 18*b* of the indoor units 5*a*, 5*b* to be reduced in pressure. The refrigerant is further evaporated in the indoor heat exchangers 6*a*, 6*b*, and flows through the suction side valves 17*a*, 17*b*. Thereafter, the refrigerant is successively passed through the low pressure pipe 12, the suction pipe 8 and the accumulator 4, and then sucked into the compressor 2.

Hot-Water Stocking Operation

Next, the operation of the refrigerating machine under the hot-water stocking operation will be described.

When the hot-water stocking operation is carried out, the change-over valves 9*a*, 19*a* of the outdoor heat exchangers 3*a*, 3*b* are closed, and the other change-over valves 9*b*, 19*b* are opened. In addition, the discharge side valves 16*a*, 16*b* and the suction side valves 17*a*, 17*b* are closed. Furthermore, the outdoor fans 29*a*, 29*b* are set to the driving state, the indoor fans 23, 23*b* are set to the stop state and the circulating pump 45 is set to the driving state. Furthermore, the switching valve 48 for connecting the high pressure pipe 11 and the hot-water stocking heat exchanger 41 is opened.

When the compressor 2 is driven under the above state, a part of the refrigerant discharged from the compressor 2 is led through the discharge pipe 7, the high pressure pipe 11 and the switching valve 48 to the hot-water stocking heat exchanger 41. In the hot-water stocking heat exchanger 41, water passing through the water pipe 46 is heated, and high-temperature water thus achieved is stocked in the hot-water stocking tank 43. Carbon dioxide refrigerant is used as the refrigerant, and the high-pressure supercritical cycle is established, so that the hot water stocked in this tank is kept at about 80° C. or more. The hot water stocked in the hot-water stocking tank 43 is fed to various facilities through pipes (not shown) (hot-water stocking operation).

The refrigerant after the heat-exchange reaches to the intermediate pressure pipe 13 through the expansion valve 47, and then it is distributed to the indoor expansion valves 27*a*, 27*b* to be reduced in pressure.

Thereafter, the refrigerant is passed through the water cooling devices 28*a*, 28*b* without being heat-exchanged, and evaporated in the outdoor heat exchangers 3*a*, 3*b*. Thereafter, the refrigerant thus evaporated flows through the change-over valves 9*b*, 19*b*, and then it is successively passed through the low pressure pipe 12, the suction pipe 8 and the accumulator 4 and then sucked into the compressor.

[2] Second Embodiment

Figure 4:
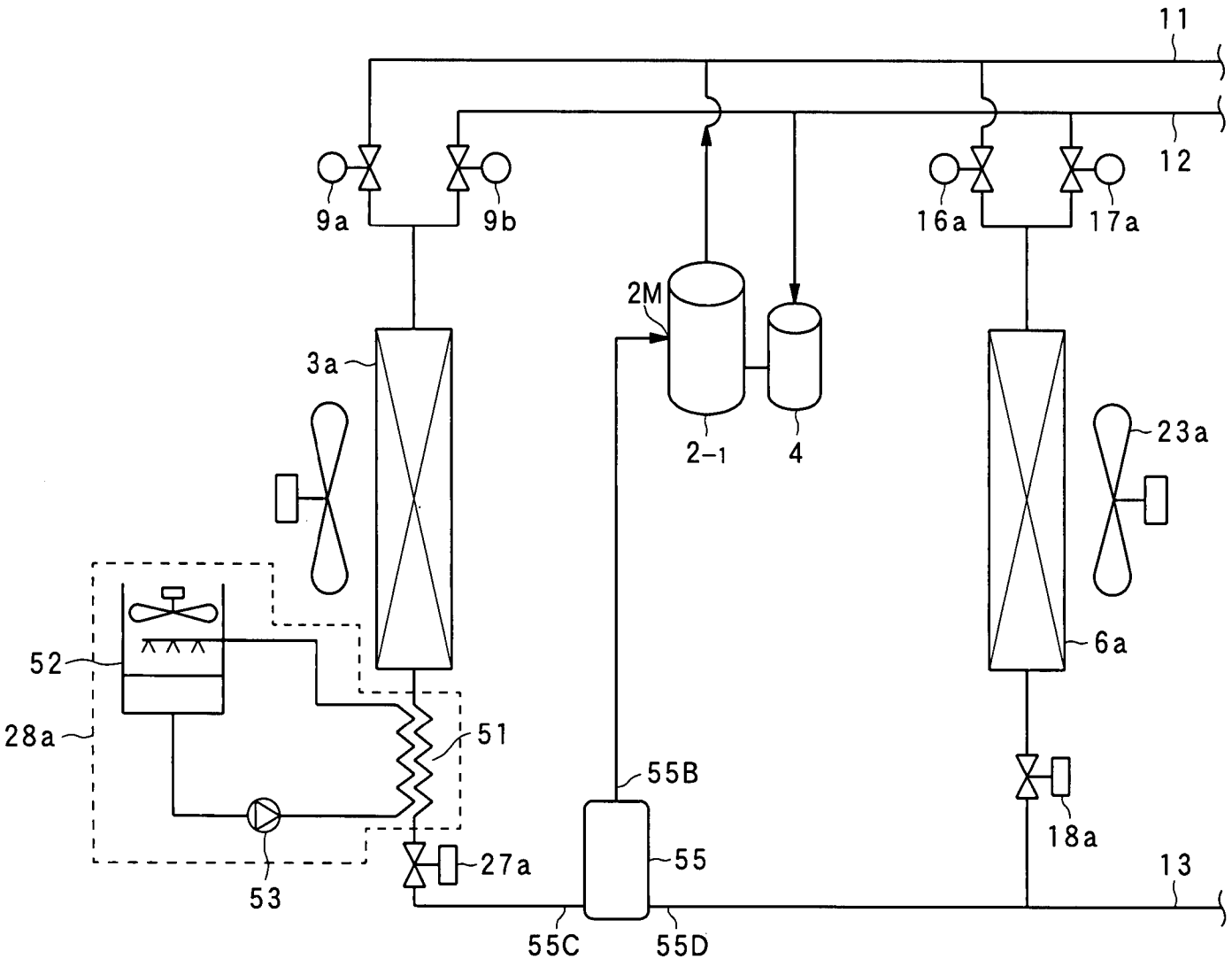
FIG. 4 is a diagram showing the main part of a second embodiment.

FIG. 4 is a diagram showing the details of the main part of the second embodiment. The refrigerating machine of the second embodiment is different from the refrigerating machine of the first embodiment in that a two-stage compressor 2-1 is used as the compressor and an intermediate pressure receiver 55 for carrying out gas-liquid separation and returning gas-phase refrigerant to an intermediate pressure portion 2M of the compressor 2-1 is provided between the outdoor expansion valve 27*a*, 27*b* and the indoor expansion valve 18*a*, 18*b*.

Figure 5:
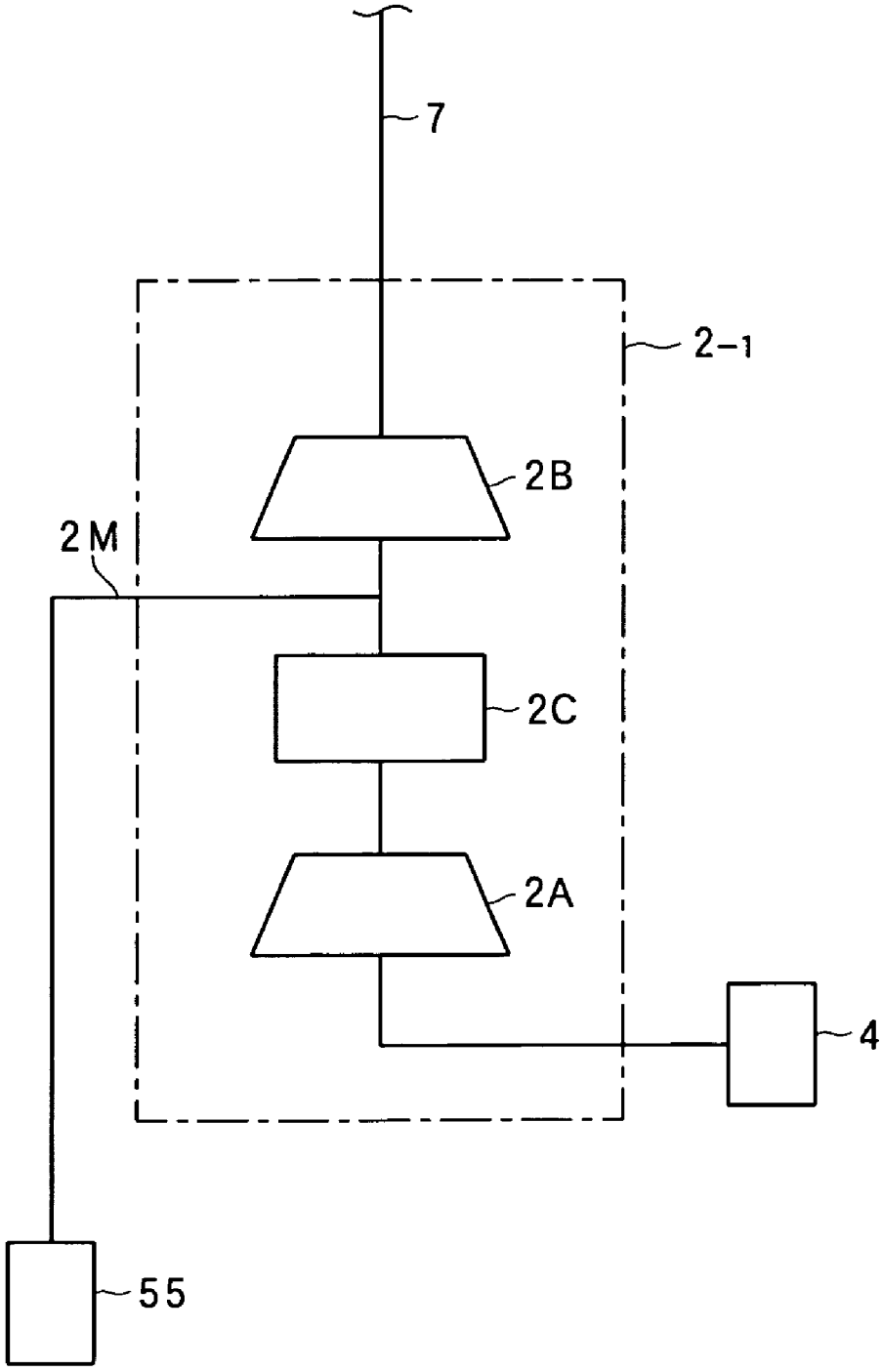
FIG. 5 is a block diagram showing the construction of a compressor.

FIG. 5 is a block diagram showing the construction of the two-stage compressor 2-1.

As shown in FIG. 5, the compressor 2-1 comprises a first-stage compressing portion 2A for compressing the refrigerant at the low pressure suction side, a second-stage compressing portion 2B for compressing the refrigerant at the high pressure discharge side, and an intermediate cooler 2C for cooling the refrigerant discharged from the first-stage compressing portion 2B and then discharging the refrigerant thus cooled to the second-stage compressing portion 2B side. The intermediate pressure portion 2M into which refrigerant can be introduced from the outside is provided at the midpoint between the second-stage compressing portion (high pressure discharge side) 2B and the intermediate cooler 2C.

As described above, the intermediate pressure receiver (gas-liquid separator) 55 is connected between the intermediate pressure pipe 13 and the outdoor expansion valve 27*a*, 27*b*, and a gas outlet pipe 55B of the intermediate pressure receiver 55 is connected to the intermediate pressure portion 2M of the compressor 2 so that the gas-phase refrigerant is introduced from the gas outlet pipe 55B into the compressor 2-1. The intermediate pressure receiver 55 is designed as a bi-directional type gas-liquid separating device into which the refrigerant can be introduced from both the outdoor heat exchanger 3*a*, 3*b* side and the indoor heat exchanger 6*a*, 6*b* side.

Figure 6:
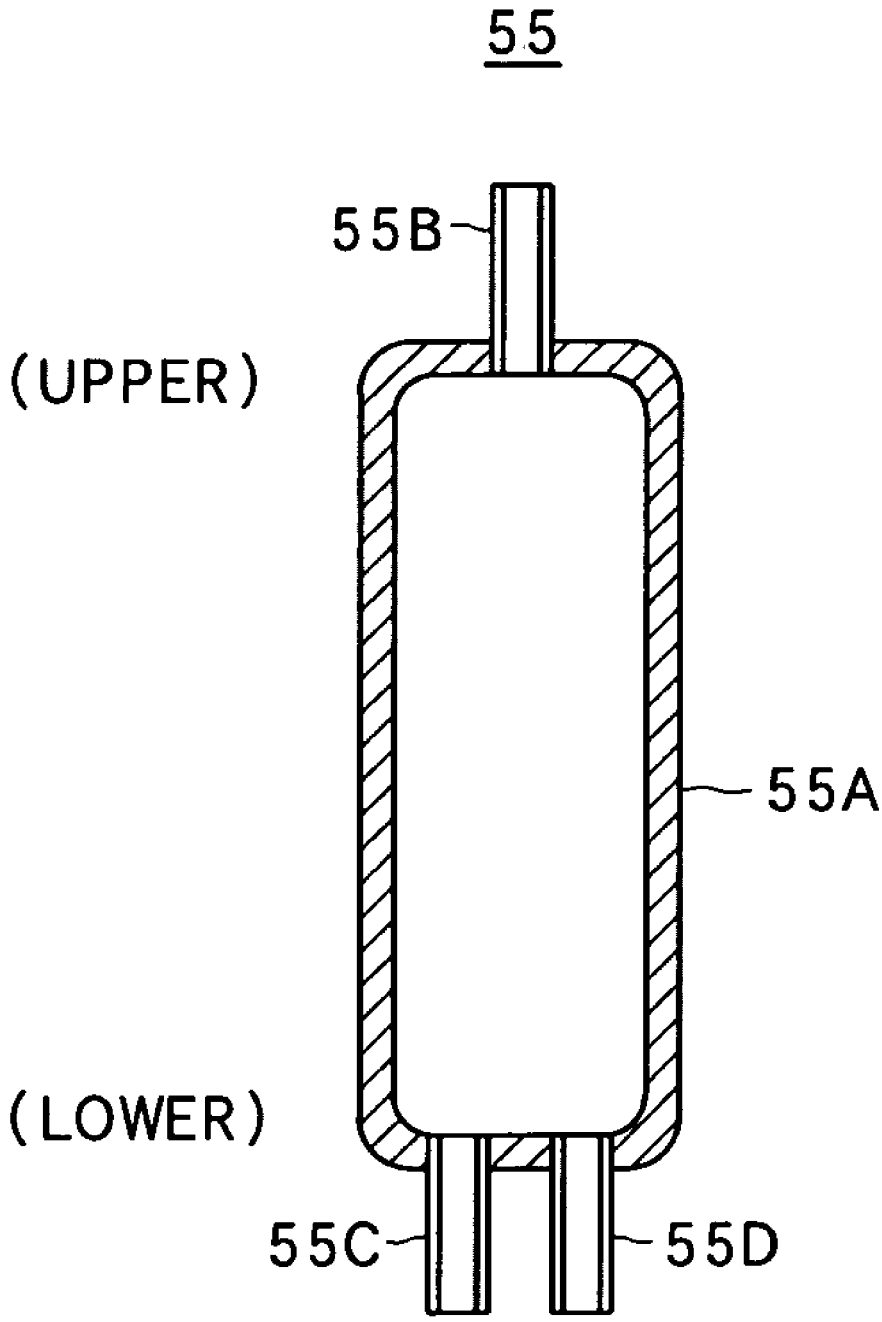
FIG. 6 is a diagram showing the construction of an intermediate pressure receiver according to the second embodiment.

FIG. 6 is a diagram showing the construction of the intermediate pressure receiver of the second embodiment.

Here, the specific construction of the intermediate pressure receiver 55 will be described.

The intermediate pressure receiver 55 mainly comprises a receiver body 55A, a gas outlet pipe 55B, a first inlet/outlet pipe 55C and a second inlet/outlet pipe 55D.

The receiver body 55A is formed as a hollow body whose outlook has a substantially cylindrical shape. A suction port (opening end) of the gas outlet pipe 55B is provided at the center of the top surface corresponding to the upper side of the receiver body 55A so as to face the inside of the receiver body 55A. Furthermore, the first inlet/outlet pipe 55C and the second inlet/outlet pipe 55D are disposed substantially vertically on the bottom surface of the receiver body 55A so that the opening end of the first inlet/outlet pipe 55C and the opening end of the second inlet/outlet pipe 55D are disposed so as to be symmetric with each other.

In this case, in accordance with the flow direction of the refrigerant in the intermediate pressure pipe 13, one of the first inlet/outlet pipe 55C and the second inlet/outlet pipe 55D functions as an inlet pipe into which gas-liquid mixed refrigerant and the other pipe functions as a liquid outlet pipe from which liquid refrigerant after gas-liquid separation is carried out flows out. In FIG. 6, the opening ends (discharge port or suction port) of the first inlet/outlet pipe 55C and the second inlet/outlet pipe 55D are illustrated as being coincident with the bottom surface of the receiver body 55A. However, the opening ends (discharge port or suction port) of the first inlet/outlet pipe 55C and the second inlet/outlet pipe 55D may be located at any height at the lower side of the receiver body 55A insofar as they can be disposed at the same height so as to be spaced from the gas outlet pipe 55B at a predetermined distance or more so that the liquid refrigerant is not sucked into the gas outlet pipe 55B.

Figure 7:
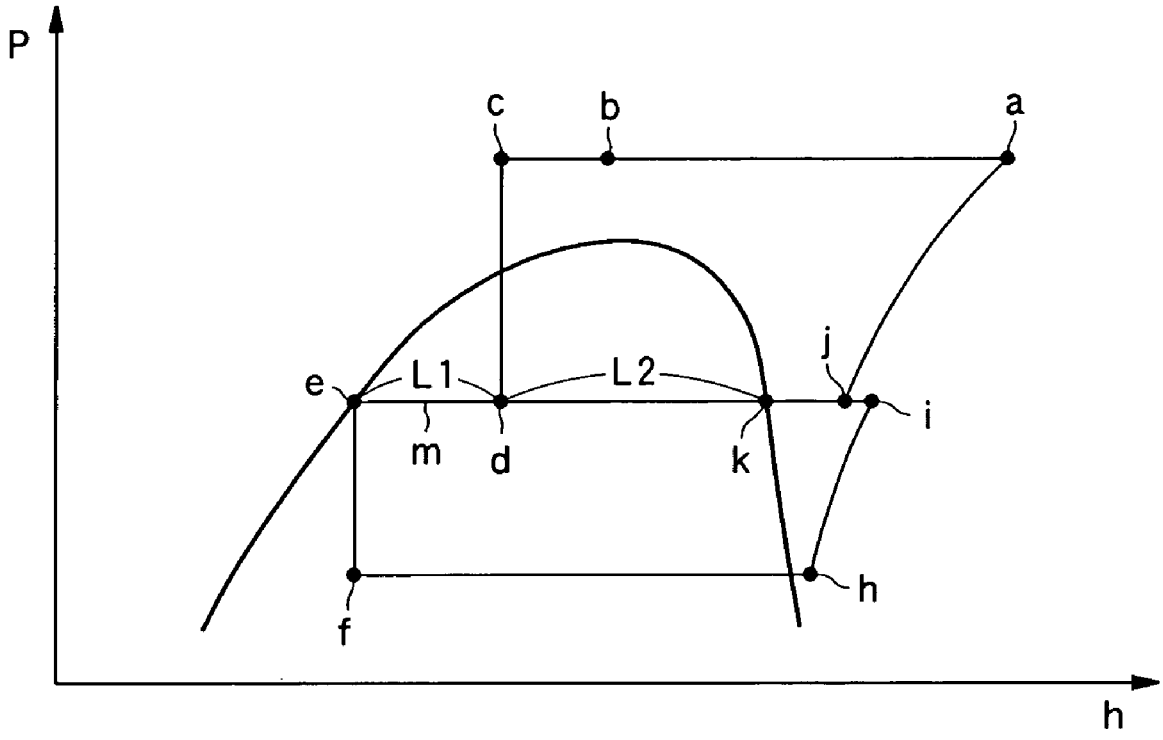
FIG. 7 is a pressure-enthalpy chart of the second embodiment.

FIG. 7 is a pressure-enthalpy chart of the second embodiment.

When carbon dioxide refrigerant is filled, the inside of the high-pressure pipe 11 is operated under supercritical pressure during operation as shown in FIG. 7. In addition to the carbon dioxide refrigerant, ethylene, diborane, ethane, nitrogen oxide or the like may be used as the refrigerant with which the inside of the high pressure pipe 11 is operated under supercritical pressure.

In FIG. 7, the state of the refrigerant at the exit of the compressor 2-1 is indicated by a state a. The refrigerant is passed through the radiation-side heat exchanger and circulated, and cooled till a state c there to radiate heat to cooling air, cooling water or the like. Then, the refrigerant is reduced in pressure in the expansion valve serving as a pressure-reducing device so that the state thereof reaches a state d and two-phase mixture of gas-phase/liquid-phase refrigerant is formed there, and then it reaches the intermediate pressure receiver 55.

In the intermediate pressure receiver 55, the refrigerant is subjected to gas-liquid separation, and the gas-phase part of the refrigerant is set to a state k in the intermediate pressure receiver. Then, the gas-phase part of the refrigerant is returned to the intermediate pressure portion 2M of the compressor 2-1. A state j indicates a state at the entrance of the second-stage compressing portion 2B of the compressor 2-1.

The liquid-phase part of the refrigerant is set to a state e in the intermediate pressure receiver 55, and reduced in pressure in the expansion valve serving as a pressure-reducing device so that the state thereof is set to a state f, and then the refrigerant reaches the evaporator. The liquid-phase part of the refrigerant is further evaporated in the evaporator to absorb heat. A state h indicates a state of the refrigerant at the exit of the evaporator, and the refrigerant evaporated in the evaporator is fed to the suction pipe of the compressor 2-1. Then, the refrigerant is set to a state I at the exit of the first-stage compressing portion 2A, cooled in the intermediate cooler 2C, mixed with the gas-phase refrigerant from the intermediate pressure receiver 55 and then set to a state j at the entrance of the second-stage compressing portion 2B.

In the supercritical cycle described above, the high-pressure gas-phase refrigerant discharged from the compressor 2-1 is not condensed, but reduce in temperature in the radiation-side heat exchanger. In the case of cooing operation, the final temperature of the refrigerant in the outdoor heat exchanger 3*a*, 3*b* used as a radiator is higher than the temperature of the cooling air by several degrees (state b). The high-pressure refrigerant is cooled till a state c under which the temperature of the refrigerant concerned is lower than the outside air dry-bulb temperature with cooling water in the water cooling devices 28*a*, 28*b*.

Next, the operation of the refrigerating machine 30 of the second embodiment will be described.

Cooling Operation

First, the operation of the refrigerating machine under cooling operation will be described.

When cooling operation is carried out in the indoor units 5*a*, 5*b*, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the stop state.

In this case, the opening degrees of the outdoor expansion valves 27*a*, 27*b* and the indoor expansion valves 18*a*, 18*b* are controlled so that the temperature sensor S4 detects a predetermined temperature and the difference between the detection temperature of the temperature sensor S1 and the detection temperature of the temperature sensor S2 (corresponding to the superheat degree) is equal to a fixed value.

When the compressor 2 is driven under this state, the refrigerant discharged from the compressor 2 successively flows through the discharge pipe 7, the change-over valves 9*a*, 19*a* and the outdoor heat exchangers 3*a*, 3*b*. Then, the refrigerant is heat-exchanged in the outdoor heat exchangers 3*a*, 3*b*, and then reaches the water cooling type heat exchangers 51 constituting the water cooling devices 28*a*, 28*b*.

Accordingly, the water cooling type heat exchangers 51 cool (heat-exchange) the refrigerant discharged from the outdoor heat exchangers 3*a*, 3*b* with water, and then make the refrigerant flow to the outdoor expansion valves 27*a*, 27*b*.

At this time, the water heat-exchanged in the water cooling type heat exchangers 51 flow to the cooling towers 52, and is cooled with the outside air. Thereafter, the water thus cooled is circulated through the cooling water pumps 53 to the water cooling type heat exchangers 51 again.

The refrigerant passing through the water cooling devices 28*a*, 28*b* is reduced in pressure in the outdoor expansion valves 27*a*, 27*b*, and reaches the first inlet/outlet pipe 55C (functioning as an inlet pipe) of the intermediate pressure receiver 55. The refrigerant is subjected to gas-liquid separation in the receiver body 55A.

As a result, the gas-phase refrigerant is supplied through the gas outlet pipe 55B to the intermediate pressure portion 2M of the compressor 2-1, and compressed by the compressor 2-1.

Furthermore, the liquid-phase refrigerant flows through the second inlet/outlet pipe 55D to the intermediate pressure pipe 13, and it is distributed to the indoor expansion valves 18*a*, 18*b* of the indoor units 5*a*, 5*b* and reduced in pressure.

Thereafter, the refrigerant is evaporated in the indoor heat exchangers 6*a*, 6*b*, and flows to the suction side valves 17*a*, 17*b*. Thereafter, the refrigerant thus evaporated is successively passed through the low pressure pipe 12, the suction pipe 8 and the accumulator 4, and then sucked into the compressor 2-1. As described above, cooling operation is carried out in all the indoor units 5*a*, 5*b* by the action of each indoor heat exchanger 6*a*, 6*b* serving as an evaporator.

Heating Operation

Next, the operation of the refrigerating machine under heating operation will be described. In this case, the water cooling devices 28*a*, 28*b* are controlled so that they do not operate.

When heating operation is carried out in the indoor units 5*a*, 5*b*, the change-over valves 9*a*, 19*a* of the outdoor heat exchangers 3*a*, 3*b* are closed, and the other change-over valves 9*b*, 19*b* are opened. In addition, the discharge side valves 16*a*, 16*b* are opened, and the suction side valves 17*a*, 17*b* are closed.

Accordingly, the refrigerant discharged from the compressor 2 successively passes through the discharge pipe 7 and the high pressure pipe 11, and flows to the discharge side valves 16*a*, 16*b* and the indoor heat exchangers 6*a*, 6*b*. The refrigerant is heat-exchanged without being condensed in the indoor heat exchangers 6*a*, 6*b*, reduced in pressure in the indoor expansion valves 18*a*, 18*b*, and reaches the second inlet/outlet pipe 55D (functioning as an inlet pipe) of the intermediate pressure receiver 55 through the intermediate pressure pipe 13. Then, the refrigerant is subjected to gas-liquid separation in the receiver body 55A.

As a result, the gas-phase refrigerant is supplied through the gas outlet pipe 55B, supplied to the intermediate pressure portion 2M of the compressor 2, and compressed in the compressor 2.

Furthermore, the liquid-phase refrigerant is distributed through the first inlet/outlet pipe 55C (functioning as liquid outlet pipe) to the outdoor expansion valves 27*a*, 27*b* of the outdoor unit 1 to be reduced in pressure.

Thereafter, the liquid-phase refrigerant is passed through the water cooling devices 28*a*, 28*b*, evaporated in the outdoor heat exchangers 3*a*, 3*b* and then flows to the change-over valves 9*b*, 19*b*. Thereafter, the refrigerant is successively passed through the low pressure pipe 12, the suction pipe 8 and the accumulator 4, and then sucked into the compressor 2-1.

As described above, heating operation is carried out in all the indoor units 5*a*, 5*b* by the non-condensing heat-exchange action in the indoor heat exchangers 6*a*, 6*b*.

Cooling and Heating Mixed Operation

Next, the operation of the refrigerating machine under cooling and heating mixed operation will be described.

When cooling operation and heating operation are simultaneously carried out in the different indoor units, for example when heating operation is carried out in the indoor unit 5*a* while cooling operation is carried out in the indoor unit 5*b* and the cooling load is larger than the heating load, the change-over valves 9*a*, 19*a* of the outdoor heat exchangers 3 are opened, and the other change-over valves 9*b*, 19*b* are closed. In addition, the discharge side valve 16*b* corresponding to the indoor unit 5*b* to be cooled is closed while the suction side valve 17*b* is opened, and the discharge side valve 16*a* corresponding to the indoor unit 5*a* to be heated is opened while the suction side valve 17*a* is closed. At this time, the refrigerant discharged from the compressor 2 is successively passed through the discharge pipe 7 and the high pressure pipe 11, distributed to the discharged side valve 16*a*, and heat-exchanged without being condensed in the indoor heat exchanger 6*a*. The refrigerant thus heat-exchanged is reduced in pressure in the indoor expansion valve 18*a*, and reaches the intermediate pressure pipe 13.

On the other hand, the other part of the refrigerant discharged from the compressor 2-1 successively flows through the discharge pipe 7, the change-over valves 9*a*, 19*a* and the outdoor heat exchangers 3*a*, 3*b*. The refrigerant is heat-exchanged in the outdoor heat exchangers 3*a*, 3*b*, and then reaches the water cooling type heat exchangers 51 constituting the water cooling devices 28*a*, 28*b*.

Accordingly, each water cooling type heat exchanger 51 cools (heat-exchanges) the refrigerant discharged from the outdoor heat exchanger 3*a*, 3*b* with water, and then feeds the refrigerant thus cooled to the outdoor expansion valve 27*a*, 27*b*.

At this time, the water heat-exchanged in the water cooling type heat exchanger 51 is fed to the cooling tower 52 to be cooled by the outside air, and circulated through the cooling water pump 53 to the water cooling type heat exchanger 51.

The refrigerant passing through the water cooling devices 28*a*, 28*b* is reduced in pressure in the outdoor expansion valves 27*a*, 27*b*, fed to the first inlet/outlet pipe 55C (functioning as an inlet pipe) of the intermediate pressure receiver 55, and then subjected to gas-liquid separation in the receiver body 55A.

As a result, the gas-phase refrigerant is supplied through the gas outlet pipe 55B to the intermediate pressure portion 2M of the compressor 2-1, and compressed in the compressor 2-1.

The liquid-phase refrigerant flows through the second inlet/outlet pipe 55*d* (functioning as a liquid outlet pipe) into the intermediate pressure pipe 13. The refrigerant in the intermediate pressure pipe 13 is reduced in pressure in the indoor expansion valve 18*b*, and heat-exchanged in the indoor heat exchanger 6*b*. Then, the refrigerant flows through the suction side valve 17*b*, successively passes through the low pressure pipe 12, the suction pipe 8 and the accumulator 4, and then is sucked into the compressor 2-1.

As described above, heating operation is carried out in the indoor unit 5*a* by the non-condensing heat-exchange action of the indoor heat exchanger 6*a*, and cooling operation is carried out in the indoor unit 5*b* by the action of the indoor heat exchanger 6*b* functioning as an evaporator.

Cooling+Hot-Water Stocking Operation (Part 1)

When (cooling+hot-water stocking) operation is carried out, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. The outdoor fans 29*a*, 29*b* and the indoor fans 23*a*, 23*b* are set to the driving state, and the circulating pump 45 is set to the driving state. Furthermore, the switching valve 48 for connecting the high pressure pipe 11 and the hot-water stocking heat exchanger 41 is opened.

When the compressor 2-1 is driven under the above state, a part of the refrigerant discharged from the compressor 201 is passed through the discharge pipe 7, the high pressure pipe 11 and the switching valve 48, and then led to the hot-water stocking heat exchanger 4. In the hot-water stocking heat exchanger 4, water passing through the water pipe 46 is heated, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant thus heat-exchanged is reduced in pressure through the expansion valve 47, and reaches the intermediate pressure pipe 13. Thereafter, the refrigerant is distributed to the indoor expansion valves 18*a*, 18*b* of the indoor units 5*a*, 5*b*, and reduced in pressure again there. Furthermore, the refrigerant is evaporated in the indoor heat exchangers 6*a*, 6*b*, and the refrigerant thus evaporated flows through the suction side valves 17*a*, 17*b*. Thereafter, the refrigerant is successively passed through the low pressure pipe 12, the suction pipe 8 and the accumulator 4, and then sucked into the compressor 2.

On the other hand, the other part of the refrigerant discharged from the compressor 2 successively flows through the discharge pipe 7, the change-over valves 9*a*, 19*a* and the outdoor heat exchangers 3*a*, 3*b*.

Then, the refrigerant is heat-exchanged in the outdoor heat exchanger 3*a*, 3*b*, and then reaches the water cooling type heat exchangers 51 constituting the water cooling devices 28*a*, 28*b*.

Accordingly, the respective water cooling type heat exchangers 51 cool (heat-exchange) the refrigerant discharged from the outdoor heat exchangers 3*a*, 3*b* with water, and then feed the refrigerant to the outdoor expansion valves 27*a*, 27*b*.

At this time, the water heat-exchanged in the water cooling type heat exchangers 51 is fed to the cooling towers 52 to be cooled with the outside air, and then circulated through the cooling water pumps 53 into the water cooling type heat exchangers 51.

The refrigerant passing through the water cooling devices 28*a*, 28*b* is reduced in pressure in the outdoor expansion valves 27*a*, 27*b*, fed to the first inlet/outlet pipe 55C (functioning as an inlet pipe) of the intermediate pressure receiver, and then subjected to gas-liquid separation in the receiver body 55A.

As a result, the gas-phase refrigerant is supplied through the gas outlet pipe 55B to the intermediate pressure portion 2M of the compressor 2-1, and then compressed in the compressor 2-1.

Furthermore, the liquid-phase refrigerant flows through the second inlet/outlet pipe 55D into the intermediate pressure pipe 13, and it is distributed to the indoor expansion valves 18*a*, 18*b* of the indoor units 5*a*, 5*b* to be reduced in pressure.

Thereafter, the refrigerant is evaporated in the indoor heat exchangers 6*a*, 6*b*, and flows through the suction side valves 17*a*, 17*b*. Thereafter, the refrigerant is successively passed through the low pressure pipe 12, the suction pipe 8 and the accumulator 4, and then sucked into the compressor 2-1. As described above, cooling operation is carried out in all the indoor units 5*a*, 5*b* by the action of the indoor heat exchangers 6*a*, 6*b* functioning as evaporators.

Cooling+Hot-Water Stocking Operation (Part 2)

The operation of the refrigerating machine under the (cooling+hot-water stocking) operation will be described.

When the (cooling+hot-water stocking) operation is carried out, the change-over valves 9*a*, 19*a*, 9*b*, 19*b* of the outdoor heat exchangers 3*a*, 3*b* are closed. In addition, the discharge side valves 16*a*, 16*b* are closed, and the suction side valves 17*a*, 17 are opened. Furthermore, the outdoor fans 29*a*, 29*b* are set to the stop state, the indoor fans 23*a*, 23*b* are set to the driving state, and the circulating pump 45 is set to the driving state. Furthermore, the switching valve 48 for connecting the high pressure pipe 11 and the hot-water stocking heat exchanger 41 is opened.

When the compressor 2-1 is driven under the above state, the refrigerant discharged from the compressor 2 is passed through the discharge pipe 7, the high pressure pipe 11 and the switching valve 48, and then led to the hot-water heat exchanger 41. In the hot-water stocking heat exchanger 41, water passing through the water pipe 46 is heated, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant after the heat-exchange is reduced in pressure through the expansion valve 47, and reaches the intermediate pressure pipe 13. Thereafter, the refrigerant is distributed to the indoor expansion valves 18*a*, 18*b* of the indoor units 5*a*, 5*b*, and reduced in pressure again there. Furthermore, the refrigerant is evaporated in the indoor heat exchangers 6*a*, 6*b*, flows through the suction side valves 17*a*, 17*b*, successively passes through the low pressure pipe 12, the suction pipe 8 and the accumulator 4, and then is sucked into the compressor 2.

Hot-Water Stocking Operation

Next, the operation of the refrigerating machine under hot-water stocking operation will be described.

When hot-water stocking operation is carried out, the change-over valves 9*a*, 19*a* of the outdoor heat exchangers 3*a*, 3*b* are closed, and the other change-over valves 9*b*, 19*b* are opened. In addition, the discharge side valves 16*a*, 16*b* and the suction side valves 17*a*, 17*b* are closed. The outdoor fans 29*a*, 29*b* are set to the driving state, the indoor fans 23*a*, 23*b* are set to the stop state and the circulating pump 45 is set to the driving state. Furthermore, the switching valve 48 for connecting the high pressure pipe 11 and the hot-water stocking heat exchanger 41 is opened.

When the compressor 2-1 is driven under the above state, the refrigerant discharged from the compressor 2-1 is passed through the discharge pipe 7, the high pressure pipe 11 and the switching valve 48, and then led to the hot-water stocking heat exchanger 41. In the hot-water stocking heat exchanger 41, water passing through the water pipe 46 is heated, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant after the heat-exchange is reduced in pressure through the expansion valve 47, and reaches the intermediate pressure pipe 13. Then, the refrigerant reaches the second inlet/outlet pipe 55D (functioning as an inlet pipe) of the intermediate pressure receiver 55, and passes through the receiver body 55A. Thereafter, the refrigerant is distributed through the first inlet/outlet pipe 55C to the indoor expansion valves 27*a*, 27*b* of the outdoor unit 1, and reduced in pressure there.

Thereafter, the liquid-phase refrigerant is passed through the water cooling devices 28*a*, 28*b*, evaporated in the outdoor heat exchangers 3*a*, 3*b*, and flows to the change-over valves 9*b*, 19*b*. Thereafter, the refrigerant is successively passed through the low pressure pipe 12, the suction pipe 8 and the accumulator 4, and then sucked into the compressor 2-1.

The ration between the gas-phase component and the liquid-phase component in the refrigerant before the refrigerant enters the intermediate pressure receiver 55 corresponds to the ratio between L1 (gas-phase component) and L2 (liquid-phase component) in FIG. 7. Accordingly, when the temperature at the exit of the radiation side heat exchanger is increased or the like, the amount of the gas-phase in the refrigerant before the refrigerant enters the intermediate pressure receiver 55 is increased, and the refrigerant amount of the gas-phase refrigerant introduced into the intermediate pressure portion 2M of the compressor 2-1 is increased. Therefore, the efficiency of the refrigerating cycle is enhanced because the gas-phase component which do not contribute to cooling is not circulated to the low pressure circuit subsequent to the intermediate pressure pipe 13. Particularly, in this construction, carbon dioxide refrigerant is filled in the refrigerant circuit, and thus the amount of the gas-phase component is more greatly increased in the ration between the gas-phase component and the liquid-phase component separated in the intermediate pressure receiver 55 as compared with conventional Freon-based refrigerant. Therefore, the large amount of gas-phase component is introduced into the intermediate pressure portion 2M of the compressor 201 to thereby further enhance the efficiency.

Furthermore, as described above, when the cooling/heating mixed operation is carried out (one indoor unit carries out cooling operation and the other indoor unit carries out heating operation, or the like), or when hot-water stocking operation is carried out, the refrigerant is circulated so that the indoor heat exchangers, the outdoor heat exchanger and the hot-water stocking heat exchanger are thermally balanced with one another. According to this circulation, the operation can be performed while the indoor heat and the outdoor heat are efficiently used. Particularly, hot water stocking (hot water supply) can be performed by the indoor heat during the mixing operation of the cooling operation of the indoor unit and the hot-water stocking operation. Therefore, the heat can be remarkably effectively used, and occurrence of the heat island phenomenon caused by the heat radiation of the outdoor unit can be suppressed to the minimum level.

[3] Third Embodiment

Figure 8:
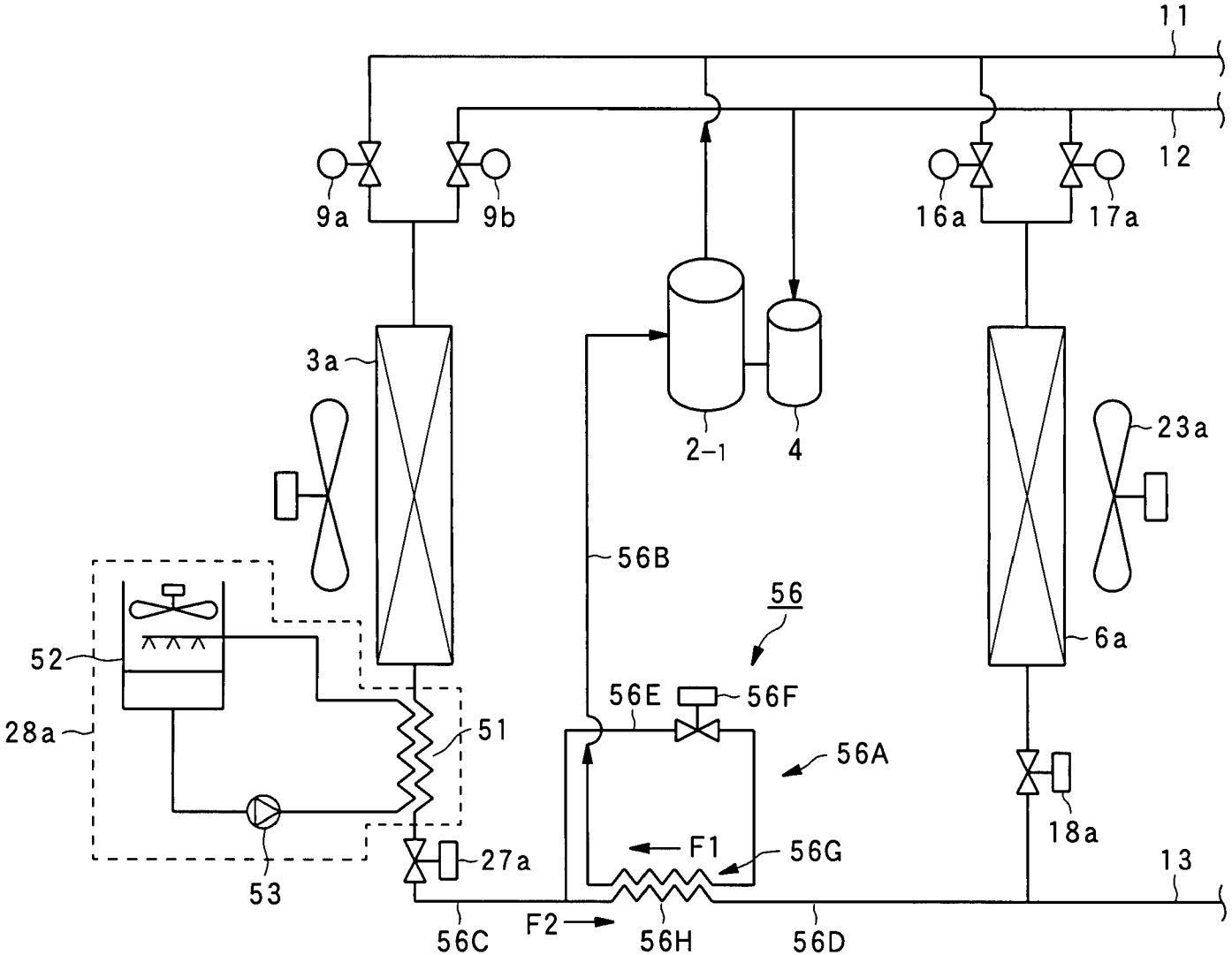
FIG. 8 is a diagram showing the main part of a third embodiment.

FIG. 8 is a diagram showing the details of the main part of a third embodiment according to the present invention. The refrigerating machine of the third embodiment is different from the refrigerating machine of the second embodiment in that a heat exchange circuit 56 is provided in place of the intermediate pressure receiver 55.

First, the heat exchange circuit 56 mainly comprises a heat-exchange portion 56A, a gas outlet pipe 56B, a first inlet/outlet pipe 56C and a second inlet/outlet pipe 56D.

The heat-exchange portion 56A is equipped with a branch pipe 56E branched from the first inlet/outlet pipe 56C, a heat-exchange expansion valve 56F connected to the branch pipe 56E, a first heat exchange portion 56G that is connected to the heat exchange expansion valve 56F at one end thereof and intercommunicates with the gas outlet pipe 56B at the other end thereof to perform actual heat exchange, and a second heat-exchange portion 56H that is branched from the first inlet/outlet pipe 56C and intercommunicates with the second inlet/outlet pipe 56D to carry out heat exchange with the first heat exchange portion 56G.

In this case, the pipes constituting the first heat exchange portion 56G and the second heat exchange portion 56H are arranged so that during cooling operation, the flow F1 of the refrigerant in the first heat exchange portion 56G and the flow F2 of the refrigerant in the second heat exchange portion 56H are opposite to each other, that is, counter-flow is established therebetween as shown in FIG. 8.

Furthermore, in accordance with the flow direction of the refrigerant in the intermediate pressure pipe 13, one of the first inlet/outlet pipe 56C and the second inlet/outlet pipe 56D functions as an inlet pipe into which the refrigerant flows, and the other pipe functions as a liquid outlet pipe from which the refrigerant flows out.

The indoor heat exchangers 6*a*, 6*b* of the indoor units 5*a*, 5*b* are connected through the discharge side valves 16*a*, 16*b* to the high-pressure pipe 11 at one ends thereof, and further connected through the suction side valves 17*a*, 17*b* to the lower pressure pipe 12. Furthermore, the indoor heat exchangers 6*a*, 6*b* are connected through the indoor expansion valves 18*a*, 18*b* to the intermediate pressure pipe 13 at the other ends thereof. When one of the discharge side valve 16*a* and the suction side valve 17*a* is opened, the other valve is closed. Likewise, when one of the discharge side valve 16*b* and the suction side valve 17*b* is opened, the other valve is closed.

Accordingly, one ends of the indoor heat exchangers 6*a*, 6*b* are selectively connected to one of the high pressure pipe 11 and the lower pressure pipe 12 of the inter-unit pipe 10.

The indoor unit 5*a* (5*b*) has an indoor fan 23*a* (23*b*), a remote controller and an indoor control device. The indoor fans 23*a*, 23*b* are disposed in proximity to the indoor heat exchangers 6*a*, 6*b* respectively to blow air to the indoor heat exchangers 6*a*, 6*b*, respectively. Furthermore, each remote controller is connected to the indoor unit 5*a* (5*b*) and outputs a cooling or heating operation instruction, a stop instruction, etc. to the indoor control device of the indoor unit 5*a* (5*b*).

In the hot-water stocking unit 50, one end of the hot-water stocking heat exchanger 41 is connected through the switching valve 48 to the high pressure pipe 11, and the other end of the hot-water stocking heat exchanger 41 is connected through the expansion valve 47 to the intermediate pressure pipe 13. The water pipe 46 is connected to the hot-water stocking heat exchanger 41, and the hot-water stocking tank 43 is connected through the circulating pump 45 to the water pipe 46.

In the third embodiment, carbon dioxide refrigerant is filled in the pipes of the outdoor unit 1, the indoor units 5*a*, 5*b* and the hot-water stocking unit 50 and the inter-unit pipe 10.

Next, the operation of the refrigerating machine 30 will be described.

Cooling Operation

First, the operation of the refrigerating machine under cooling operation will be described.

When cooling operation is carried out in the indoor units 5*a*, 5*b*, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. The outdoor fans 29*a*, 29*b* and the indoor fans 23*a*, 23*b* are set to the driving state, and the circulating pump 45 is set to the stop state.

When the compressor 2-1 is driven under this state, the refrigerant discharged from the compressor 2-1 successively flows through the discharge pipe 7, the change-over valves 9*a*, 19*a* and the outdoor heat exchangers 3*a*, 3*b*. After heat-exchanged in the outdoor heat exchangers 3*a*, 3*b*, the refrigerant reaches the water cooling type heat exchangers 51 constituting the water cooling type devices 28*a*, 28*b*. Accordingly, the water cooling type heat exchangers 51 cool (heat-exchange) the refrigerant discharged from the outdoor heat exchangers 3*a*, 3*b* with water and then feed the water to the outdoor expansion valves 27*a*, 27*b*.

At this time, the water heat-exchanged in the water cooling type heat exchangers 51 is fed to the cooling towers 52 to be cooled with the outside air, and then circulated through the cooling water pumps 53 to the water cooling type heat exchangers 51 again.

The refrigerant passing through the water cooing devices 28*a*, 28*b* is fed through the outdoor expansion valves 27*a*, 27*b* to the first inlet/outlet pipe 56C (functioning as an inlet pipe) of the heat exchange circuit 56.

The refrigerant fed to the first inlet/outlet pipe 56C of the heat exchange circuit 56 is branched in the heat exchange circuit 56, and a part of the refrigerant flows to the branch pipe 56E while the other part of the refrigerant flows to the second heat exchange portion 56H. The gas-liquid mixed refrigerant flowing into the branch pipe 56E is reduced in pressure in the heat exchange expansion valve 56F and reaches the first heat exchange portion 56G.

As a result, the heat exchange is carried out between the first heat exchange portion 56G and the second heat exchange portion 56H, and the first heat exchange portion 56G functions as an evaporator. The refrigerant in the first heat exchange portion 56G substantially becomes gas-phase refrigerant, and it is supplied through the gas outlet pipe 56B to the intermediate pressure portion 2M of the compressor 2-1 and compressed in the compressor 201.

The liquid-phase refrigerant flowing through the second heat exchanger portion 56H flows through the second inlet/outlet pipe 56D into the intermediate pressure pipe 13, and it is distributed to the indoor expansion valves 18*a*, 18*b* of the indoor units 5*a*, 5*b* and reduced in pressure there.

Thereafter, the refrigerant is evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator 4, and then sucked into the compressor 201. As described above, heating operation is carried out in all the indoor units 5*a*, 5*b* at the same time by the action of the indoor heat exchangers 6*a*, 6*b* serving as evaporators.

Heating Operation

Next, the operation of the refrigerating machine under heating operation will be described. In this case, the water cooling devices 28*a*, 28*b* are controlled so that they carry out no operation.

When heating operation is carried out in the indoor units 5*a*, 5*b*, the change-over valves 9*a*, 19*a* of the outdoor heat exchangers 3*a* 3*b* are closed, and the other change-over valves 9*b*, 19*b* are opened. In addition, the discharge side valves 16*a*, 16*b* are opened, and the suction side valves 17*a*, 17*b* are closed.

In this case, the opening degrees of the outdoor expansion valves 27*a*, 27*b* are controlled so that the difference between the detection temperature of the temperature sensor S1 and the detection temperature of the temperature sensor S2 (corresponding to the superheat degree) is equal to a fixed value (superheat control), and the opening degrees of the indoor expansion valves 18*a*, 18*b* are controlled in accordance with the loads of the indoor units 5*a*, 5*b*.

Accordingly, the refrigerant discharged from the compressor 2-1 successively passes through the discharge pipe 7 and the high pressure pipe 11, and flows to the discharge side valves 16*a*, 16*b* and the indoor heat exchangers 6*a*, 6*b*. The refrigerant is heat-exchanged without being condensed in the indoor heat exchangers 6*a*, 6*b*, and then it flows through the intermediate pressure pipe 13 to the second inlet/outlet pipe 56D (functioning as an inlet pipe) of the heat exchange circuit 56, and flows into the second heat exchanger portion 56H. Apart of the refrigerant flows to the branch pipe 56E.

The refrigerant flowing into the branch pipe 56E is reduced in pressure by the heat exchange expansion valve 56F, and reaches the first heat exchange portion 56G.

As a result, the heat exchange is carried out between the first heat exchange portion 56G and the second heat exchange portion 56H, and the first heat exchange portion 56G functions as an evaporator. The gas-liquid mixed refrigerant in the first heat exchange portion 56G substantially becomes gas-phase refrigerant, and it is supplied through the gas outlet pipe 56B to the intermediate pressure portion 2M of the compressor 2-1 and compressed in the compressor 2-1.

Furthermore, the liquid-phase refrigerant flowing in the second heat exchanger 56H is distributed through the first inlet/outlet pipe 56C (functioning as a liquid outlet pipe) to the outdoor expansion valves 27*a*, 27*b* of the outdoor unit 1 and reduced in pressure there.

Thereafter, the liquid-phase refrigerant is passed through the water cooling devices 28*a*, 28*b* and evaporated in the outdoor heat exchangers 3*a*, 3*b*. The refrigerant thus evaporated flows through the change-over valves 9*b*, 19*b*, and then it is successively passed through the low pressure pipe 12, the suction pipe 8 and the accumulator 4, and then sucked into the compressor 2-1. As described above, heating operation is carried out in all indoor units 5*a*, 5*b* at the same time by the non-condensation heat-exchange action of the indoor heat exchangers 6*a*, 6*b*.

Cooling and Heating Mixed Operation

The operation of the refrigerating machine under cooling and heating mixed operation will be described.

When heating is carried out in the indoor unit 5*a*, cooling operation is carried out in the indoor unit 5*b* and a cooling load is larger than a heating load, the change-over valves 9*a*, 19*a* of the outdoor heat exchangers 3 are opened, and the other change-over valves 9*b*, 19*b* are closed. In addition, the discharge side valve 16*b* corresponding to the indoor unit 5*b* which carries out cooling operation is closed, and the suction side valve 17*b* is opened. Furthermore, the discharge side valve 16*a* corresponding to the indoor unit 5*a* which carries out heating operation is opened, and the suction side valve 17*a* is closed.

A part of the refrigerant discharged from the compressor 2-1 is successively passed through the discharge pipe 7 and the high pressure pipe 11 and distributed to the discharge side valve 16*a* corresponding to the indoor unit 5*a* which carries out heating operation. The refrigerant is heat-exchanged without being condensed in the indoor heat exchanger 6*a*. The refrigerant thus heat-exchanged passes through the indoor expansion valve 18*a* and then flows to the intermediate pressure pipe 13.

On the other hand, a part of the refrigerant discharged from the compressor 2-1 is successively passed through the discharge pipe 7 and the change valve 9*a*, 19*a* and then flows to the outdoor heat exchangers 3*a*, 3*b*. Then, the refrigerant is heat-exchanged in the outdoor heat exchangers 3*a*, 3*b*, and then reaches the water cooling type heat exchangers 51 constituting the water cooling devices 28*a*, 28*b*.

Accordingly, the water cooling type heat exchangers 51 cool (heat-exchange) the refrigerant discharged from the outdoor heat exchangers 3*a*, 3*b* with water, and then feed the refrigerant thus cooled to the cooling towers 52 to be cooled with the outside air. Then, the refrigerant thus cooled is circulated through the cooling water pumps 53 to the water cooling type heat exchangers 51 again. The refrigerant passing through the water cooling devices 28*a*, 28*b* reaches through the outdoor expansion valves 27*a*, 27*b* to the second inlet/outlet pipe 56C (functioning as an inlet pipe) of the heat exchange circuit 56. A part of the refrigerant flows to the branch pipe 56E, and the other part of the refrigerant flows into the second heat exchanger 56H. The gas-liquid mixed refrigerant flowing into the branch pipe 56E is reduced in pressure by the heat exchange expansion valve 56F, and reaches the first heat exchange portion 56G.

As a result, the heat exchange is carried out between the first heat exchange portion 56G and the second heat exchange portion 56H, and the first heat exchange portion 56G functions as an evaporator. The gas-liquid mixed refrigerant in the first heat exchange portion 56G substantially becomes gas-phase refrigerant, and flows through the gas outlet pipe 56B into the intermediate pressure pipe 13.

The refrigerant heat-exchanged in the indoor heat exchangers 6*a*, 6*b* and the outdoor heat exchangers 3 is passed through the intermediate pressure pipe 13, reduced in pressure by the indoor expansion valves 18*a*, 18*b* of the indoor units 5*a*, 5*b*, and then evaporated in the indoor heat exchangers 6*a*, 6*b*. Thereafter, the refrigerant flows through the suction side valves 17*a*, 17*b*, and successively passes through the low pressure pipe 12, the suction pipe 8 and the accumulator 4, and then it is sucked into the compressor 2-1. As described above, heating operation is carried out in the indoor unit 5*a* by the heat-exchange action of the indoor heat exchanger 6*a*, and cooling operation is carried out in the indoor unit 5*b* by the action of the other indoor heat exchanger 6*b* functioning as an evaporator.

Cooling+Hot-Water Stocking Operation (Part 1)

A first operation of the refrigerating machine under (cooling+hot-water stocking) operation will be described.

When the (cooling+hot-water stocking) operation is carried out, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the driving state. Furthermore the switching valve 48 for connecting the high pressure pipe 11 and the hot-water stocking heat exchanger 41 is opened.

When the compressor 2-1 is driven under the above state, a part of the refrigerant discharged from the compressor 2-1 is led through the discharge pipe 7, the high pressure pipe 11 and the change-over valve 48 to the hot-water stocking heat exchanger 41 In the hot-water stocking heat exchanger 41, water passing through the water pipe 46 is heated, and high-temperature water thus achieved is stocked in the hot-water stocking tank 43. Carbon dioxide refrigerant is used as the refrigerant, and thus the high-pressure supercritical cycle is established. The temperature of the water thus stocked there is increased to about 80° C. or more. The hot water stocked in the hot-water stocking tank 43 is fed to various kinds of facilities through pipes (not shown) (hot-water stocking operation).

The refrigerant thus heat-exchanged reaches the intermediate pressure pipe 13 through the expansion valve 47, and it is distributed to indoor expansion valves 18*a*, 18*b* of the indoor units 5*a*, 5*b* to be reduced in pressure. The refrigerant is further evaporated in the indoor heat exchangers 6*a*, 6*b*, and flows to the suction side valves 17*a*, 17*b*. Thereafter, the refrigerant is successively passed through the low pressure pipe 12, the suction pipe 12, the suction pipe 8 and the accumulator 4, and then sucked into the compressor 2-1.

On the other hand, the other part of the refrigerant discharged from the compressor 2-1 successively flows through the discharge pipe 7, the change-over valves 9*a*, 19*a* and the outdoor heat exchangers 3*a*, 3*b*.

The refrigerant is heat-exchanged in the outdoor heat exchangers 3*a*, 3*b*, cooled in the water cooling devices 28*a*, 28*b*, and then fed to the first inlet/outlet pipe 56C (functioning as an inlet pipe) of the heat exchanger 56 through the outdoor expansion valves 27*a*, 27*b*.

The refrigerant fed to the first inlet/outlet pipe 56C of the heat exchange circuit 56 is branched in the heat exchange circuit 56, and a part of the refrigerant flows to the branch pipe 56E while the other part of the refrigerant flows to the second heat exchange portion 56H. The refrigerant flowing to the branch pipe 56E is reduced in pressure by the heat exchange expansion valve 56F, and then reaches the first heat exchange portion 56G.

As a result, the heat exchange is carried out between the first heat exchange portion 56G and the second heat exchange portion 56H, and the first heat exchange portion 56G functions as an evaporator. The gas-liquid mixed refrigerant in the first heat exchange portion 56G substantially becomes gas-phase refrigerant, and it is supplied through the gas outlet pipe 56B to the intermediate pressure portion 2M of the compressor 201, and compressed in the compressor 2-1.

The liquid-phase refrigerant flows through the second inlet/outlet pipe 56D into the intermediate pressure pipe 13, and it is distributed to the indoor expansion valves 18*a*, 18*b* of the indoor units 5*b*, 5*b* and reduced in pressure there.

Thereafter, the refrigerant is evaporated in the indoor heat exchangers 6*a*, 6*b*, flows through the suction side valves 17*a*, 17*b* and successively passes through the low pressure pipe 12, the suction pipe 8 and the accumulator 4. Finally, the refrigerant is sucked into the compressor 2-1. As described above, cooling operation is carried out in all the indoor units 5*a*, 5*b* at the same time by the action of the indoor heat exchangers 6*a*, 6*b* functioning as evaporators.

Cooling+Hot-Water Stocking Operation (Part 2)

Next, a second operation of the refrigerating machine under (cooling+hot-water stocking) operation will be described.

When the (cooling+hot-water stocking) operation is carried out, the change-over valves 9*a*, 19*a*, 9*b*, 19*b* of the outdoor heat exchangers 3*a*, 3*b* are closed. In addition, the discharge side valves 16*a*, 16*b* are closed, the suction side valves 17*a*, 17*b* are opened. Furthermore, the outdoor fans 29*a*, 29*b* are set to the stop state, the indoor fans 23*a*, 23*b* are set to the driving state and the circulating pump 45 is set to the driving state. Furthermore, the switching valve 48 for connecting the high pressure pipe 11 and the hot-water stocking heat exchanger 41 is opened.

When the compressor 2-1 is driven under the above state, the refrigerant discharged from the compressor 2-1 is led through the discharge pipe 7, the high pressure pipe 11 and the switching valve 48 to the hot-water stocking heat exchanger 41. In the hot-water stocking heat exchanger 41, water passing through the water pipe 46 is heated, and high-temperature water thus achieved is stocked in the hot-water stocking tank 43. Carbon dioxide refrigerant is used as the refrigerant. The temperature of the water thus stocked there is increased to about 80° C. or more. The hot water stocked in the hot-water stocking tank 43 is fed to various kinds of facilities through pipes (not shown) (hot-water stocking operation).

The refrigerant thus heat-exchanged reaches through the expansion valve 47 to the intermediate pressure pipe 13, and it is distributed to the indoor expansion valves 18*a*, 18*b* of the indoor units 5*a*, 5*b* and reduced in pressure there. Furthermore, the refrigerant is evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator 4, and then sucked into the compressor 2-1.

Hot-Water Stocking Operation

When hot-water stocking operation is carried out, the change-over valves 9*a*, 19*a* of the outdoor heat exchangers 3*a*, 3*b* are closed, and the other change-over valves 9*b*, 19*b* are opened. In addition, the discharge side valves 16*a* 16*b* and the suction side valves 17*a*, 17*b* are closed. Furthermore, the outdoor fans 29*a*, 29*b* are set to the driving state, the indoor fans 23*a*, 23*b* are set to the stop state and the circulating pump 45 is set to the driving state. Furthermore, the switching valve 48 for connecting the high pressure pipe 11 and the hot-water stocking heat exchanger 41 is opened.

When the compressor 2-1 is driven under the above state, a part of the refrigerant discharged from the compressor 2-1 is led through the discharge pipe 7, the high pressure pipe 11 and the switching valve 48 to the hot-water stocking heat exchanger 41. In the hot-water stocking heat exchanger 41, water passing through the water pipe 46 is heated, and high-temperature water thus achieved is stocked in the hot-water stocking tank 43. The temperature of the water thus stocked there is increased to about 80° C. or more. The hot water stocked in the hot-water stocking tank 43 is fed to various kinds of facilities through pipes (not shown) (hot-water stocking operation).

The refrigerant thus heat-exchanged reaches the intermediate pressure pipe 13 through the expansion valve 47, also reaches the second inlet/outlet pipe 56D (functioning as the inlet pipe) of the heat exchange circuit 56, flows to the second heat exchange portion 56H and a part of the refrigerant flows to the branch pipe 56G.

The gas-liquid mixed refrigerant flowing into the branch pipe 56E is reduced in pressure by the heat exchange expansion valve 56F, and reaches the first heat exchange portion 56G.

As a result, the heat exchange is carried out between the first heat exchange portion 56G and the second heat exchange portion 56H, and the first heat exchange portion 56G functions as an evaporator. The gas-liquid mixed refrigerant in the first heat exchange portion 56G substantially becomes gas-phase refrigerant, and it is supplied through the gas outlet pipe 56B to the intermediate pressure portion 2M of the compressor 2-1 and compressed in the compressor 2-1.

The liquid-phase refrigerant flowing to the second heat exchange portion 56H is distributed through the first inlet/outlet pipe 56C (functioning as the liquid outlet pipe) to the indoor expansion valves 27*a*, 27*b* of the outdoor units 3*a*, 3*b*, and reduced in pressure there. Thereafter, the liquid-phase refrigerant is evaporated in the outdoor heat exchangers 3*a*, 3*b*, fed through the change-over valves 9*b*, 19*b*, successively passed through the low pressure pipe 12, the suction pipe 8 and the accumulator 4 and then sucked into the compressor 2-1.

Furthermore, as described above, when cooling and heating mixed operation is carried out (one indoor unit carries out cooling operation and the other indoor unit carries out heating operation, or the like), or when hot-water stocking operation is carried out, the refrigerant is circulated so that the indoor heat exchangers, the outdoor heat exchangers and the hot-water stocking heat exchanger are thermally balanced with one another. According to this operation, the operation can be performed by effectively using the indoor heat and the outdoor heat. Particularly when the mixed operation of the cooling operation and the hot-water stocking operation by the indoor units, hot water stocking (hot water supply) can be performed by the indoor heat, and thus the heat can be used extremely effectively, so that the effect of suppressing occurrence of the heat island phenomenon caused by the heat of the indoor units can be achieved.

[4] Fourth Embodiment

Figure 9:
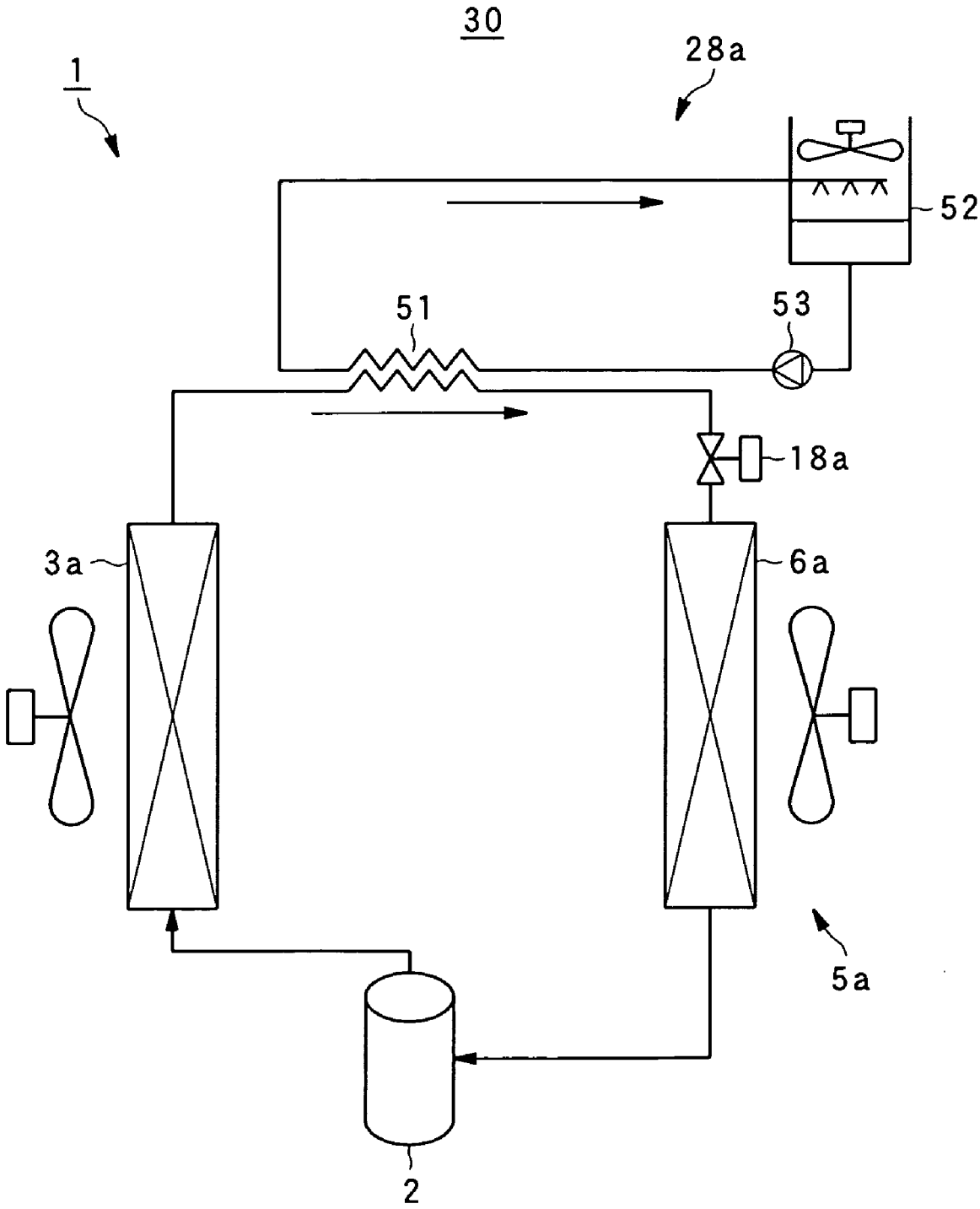
FIG. 9 is a refrigerant circuit diagram of a refrigerating machine according to a fourth embodiment.

FIG. 9 is a refrigerant circuit diagram showing a refrigerating machine of a fourth embodiment. In FIG. 8, the same parts as shown in FIG. 9 are represented by the same reference numerals.

The refrigerating machine 30 is used for only cooling operation, and it has the same basic construction as shown in FIG. 2. That is, it mainly includes the outdoor unit 1 having the compressor 2, the outdoor heat exchanger 3*a*, the outdoor expansion valve 27*a* (not shown) and the water cooling device 28*a*, and the indoor unit 5*a* having the indoor heat exchanger 6*a* and the indoor expansion valve 18*a*.

The operation of the refrigerating machine 30 under cooling operation will be described.

When the compressor 2 is driven, the refrigerant discharged from the compressor 2 flows through the pipe to the outdoor heat exchanger 3*a*. The refrigerant is heat-exchanged in the outdoor heat exchanger 3*a*, and then reaches the water cooling type heat exchanger 51 constituting the water cooing device 28*a*.

Accordingly, the water cooling type heat exchanger 51 cools (heat-exchanges) the refrigerant discharged from the outdoor heat exchanger 3*a* with water, and then feeds the refrigerant thus cooled to the outdoor expansion valve 27*a*. At this time, the water heat-exchanged in the water cooling type heat exchanger 51 is fed to the cooling tower 52 and cooled with the outside air, and then it is circulated through the cooing water pump 53 to the water cooling type heat exchanger 51 again.

The refrigerant passing through the water cooling device 28*a* is reduced in pressure by the outdoor expansion valve 27*a*, and reaches the indoor heat exchanger 6*a*. Then, the refrigerant is evaporated in the indoor heat exchanger 6*a*, and sucked into the compressor 2. As described above, the indoor unit 5*a* carries out cooling operation by the action of the indoor heat exchanger 6*a* functioning as an evaporator.

[5] Fifth Embodiment

Figure 10:
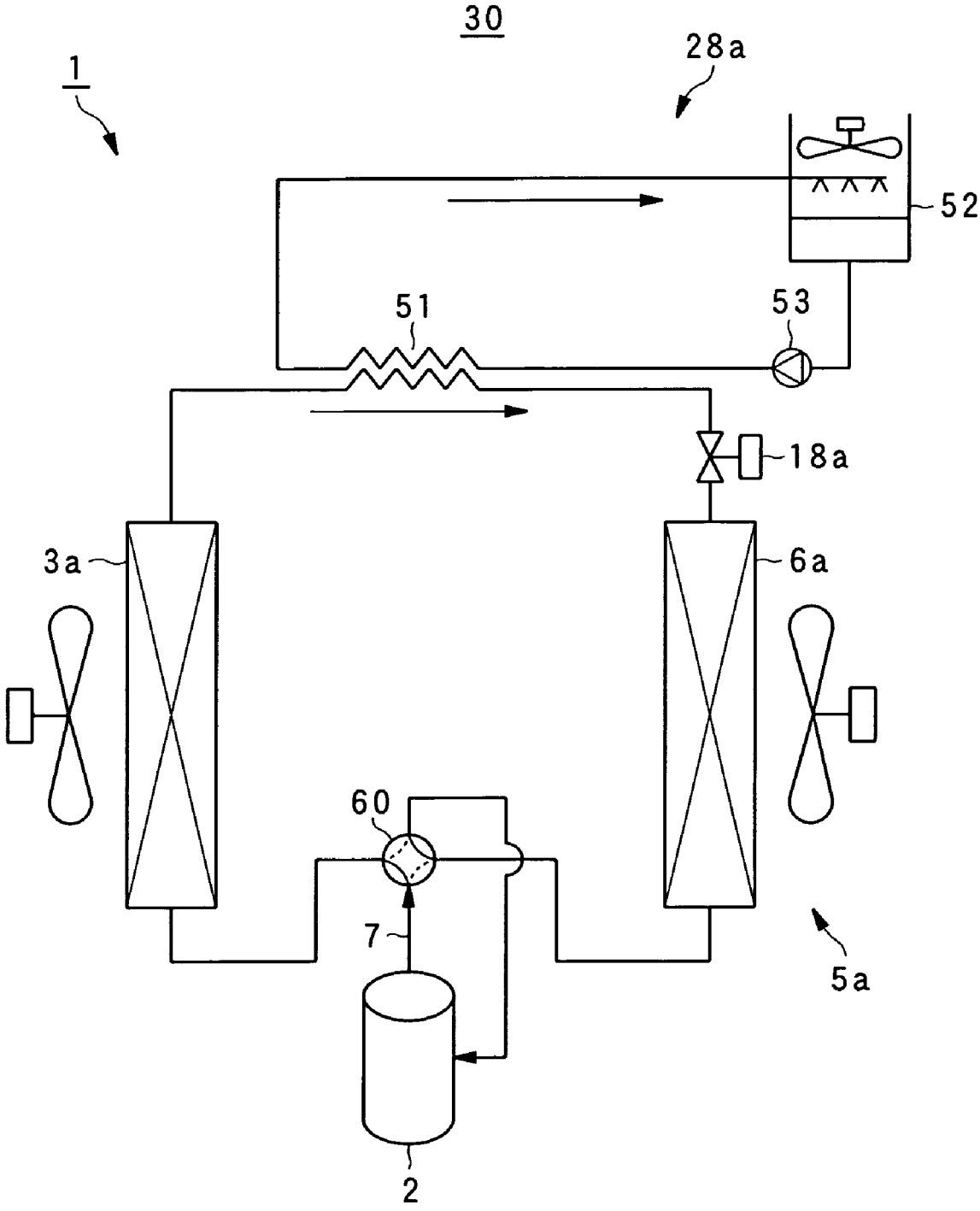
FIG. 10 is a refrigerant circuit diagram showing a refrigerating machine according to a fifth embodiment.

FIG. 10 is a refrigerant circuit diagram showing a refrigerating machine according to a fifth embodiment. In FIG. 10, the same parts as shown in FIG. 1 are represented by the same reference numerals.

The refrigerating machine 30 comprises an outdoor unit 1 having a compressor 2, an outdoor heat exchanger 3*a*, an outdoor expansion valve 27*a* and a water cooling device 28*a*, and an indoor unit 5*a* having an indoor heat exchanger 6*a*, and a four-way valve 60.

Cooling Operation

First, the operation of the refrigerating machine under cooling operation will be described.

When the compressor 2 is driven, the refrigerant discharged form the compressor 2 flows through the four-way valve 60 and the pipe to the outdoor heat exchanger 3*a*. Then, the refrigerant is heat-exchanged in the outdoor heat exchanger 3*a*, and then reaches the water cooling type heat exchanger 51 constituting the water cooling type device 28*a*. Accordingly, the water cooling type heat exchanger 51 cools (heat-exchanges) the refrigerant discharged from the outdoor heat exchanger 3*a* with water, and then feeds the refrigerant thus cooled to the outdoor expansion valve 27*a*.

At this time, the water heat-exchanged in the water cooling type heat exchanger 51 is fed to the cooling tower 52 and cooled with the outside air. Thereafter, the refrigerant thus cooled is circulated through the cooling water pump 53 to the water cooling type heat exchanger 51 again.

The refrigerant passing through the water cooling device 28*a* is reduced in pressure by the outdoor expansion valve 27*a*, fed to the indoor heat exchanger 6*a*, evaporated in the indoor heat exchanger 6*a* and then sucked through the four-way valve 60 into the compressor 2. As described above, the indoor unit 5*a* carries out cooling operation by the action of the indoor heat exchanger 6*a* functioning as an evaporator.

Heating Operation

The refrigerant discharged from the compressor 2 flows through the four-way valve 60 and the pipe to the indoor heat exchanger 6*a*, and it is heat-exchanged without being condensed in the indoor heat exchanger 6*a*, reduced in pressure by the outdoor expansion valve 27*a*, and then heat-exchanged in the outdoor heat exchanger 3*a* through the water cooling device 28*a*. Thereafter, the refrigerant thus heat-exchanged is passed through the four-way valve 60 and sucked into the compressor 2.

As described above, heating operation is carried out in the indoor units 5*a* by the non-condensing heat exchange action of the indoor heat exchanger 6*a*.

[6] Sixth Embodiment

Figure 11:
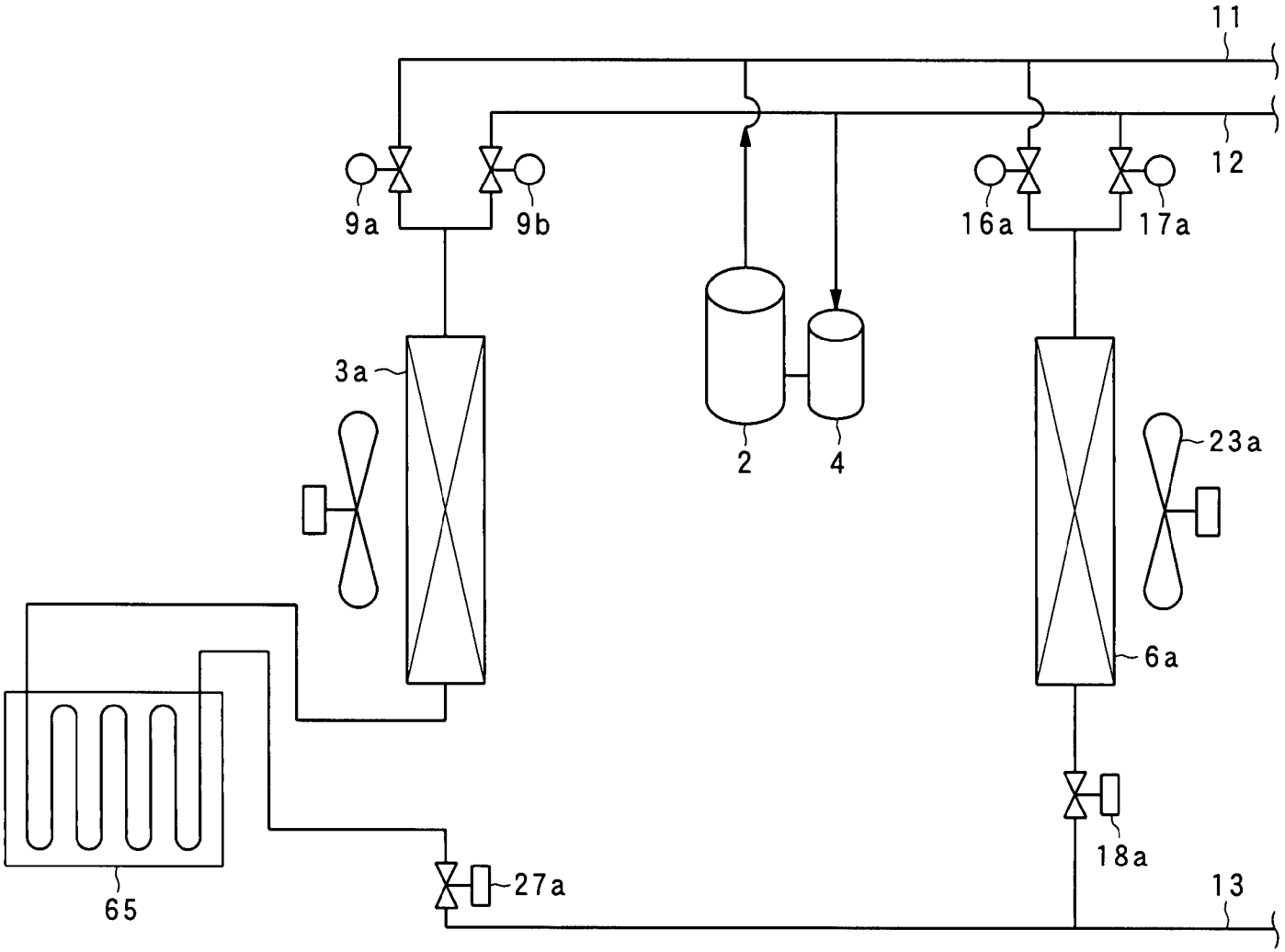
FIG. 11 is a diagram showing the main part of a refrigerant circuit diagram of a refrigerating machine according to a sixth embodiment.

FIG. 11 is a diagram showing the details of the main part of the refrigerant circuit diagram of a refrigerating machine according to a sixth embodiment. In FIG. 11, the same parts as shown in FIG. 2 are represented by the same reference numerals. The sixth embodiment is different from the first embodiment in that an ice heat storage tank 65 is provided in place of the water cooling device 28*a*.

As shown in FIG. 3, when cooling is carried out in the water cooling devices 28*a*, 28*b* (for example, cooling can be carried out until 20° C.), the pressure at the high-pressure side can be reduced to achieve a necessary enthalpy difference as indicated by symbols a→b→c→d in the pressure-enthalpy chart, and the compression power of the compressor 2 can be reduced. The same effect can be also achieved by the ice heat storage tank 65 of the sixth embodiment.

Next, the operation of the refrigerating machine 30 will be described. In the following description, the same operation as the first embodiment is carried out except for the ice heat storage operation, and thus only the cooling operation, the ice heat storage operation and the (hot-water stocking+ice heat storage) operation will be described.

Cooling Operation

When the indoor units 5*a*, 5*b* carry out cooling operation, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the stop state.

When the compressor 2 is driven under the above state, the refrigerant discharged from the compressor 2 successively flows to the discharge pipe 7, the change-over valves 9*a*, 19*a* and the outdoor heat exchangers 3*a*, 3*b*.

The refrigerant is heat-exchanged in the outdoor heat exchangers 3*a*, 3*b*, and then reaches the ice heat storage tank 65.

Accordingly, the ice heat storage tank 65 cools (heat-exchanges) the refrigerant discharged from the outdoor heat exchangers 3*a*, 3*b* with ice and then feeds the refrigerant thus cooled to the outdoor expansion valves 27*a*, 27*b*.

The refrigerant passing through the ice heat storage tank 65 flows through the outdoor expansion valves 27*a*, 27*b* to the intermediate pressure pipe 13, and it is distributed to the indoor expansion valves 18*a*, 18*b* of the indoor units 5*a*, 5*b* and reduced in pressure there.

Thereafter, the refrigerant is evaporated in the indoor heat exchangers 6*a*, 6*b*, and flows through the suction side valves 17*a*, 17*b*. Thereafter, the refrigerant is successively passed through the low pressure pipe 12, the suction side pipe 8 and the accumulator 4, and then sucked into the compressor 2. As described above, cooling operation is carried out in all the indoor units 5*a*, 5*b* by the action of the indoor heat exchangers 6*a*, 6*b* functioning as evaporators.

As described above, according to the above construction, the ice heat storage tank 65 cools (heat-exchanges) the refrigerant discharged from the outdoor heat exchangers 3*a*, 3*b* with ice, and thus the pressure at the high-pressure side to achieve the necessary enthalpy difference can be reduced, so that the compression power of the compressor 2 can be reduced.

Ice Heat Storage Operation

Next, the operation of the refrigerating machine under ice heat storage operation will be described.

When ice heat storage operation is carried out, the change-over valves 9*a*, 19*a* of the outdoor heat exchangers 3*a*, 3*b* are closed, and the other valves 9*b*, 19*b* are opened. In addition, the discharge side valves 16*a*, 16*b* are opened, and the suction side valves 17*a*, 17*b* are closed.

Accordingly, the refrigerant discharged from the compressor 2 is successively passed through the discharge pipe 7 and the high-pressure pipe 11, and then flows to the discharge side valves 16*a*, 16*b* and the indoor heat exchangers 6*a*, 6*b*. The refrigerant is heat-exchanged without being condensed in the indoor heat exchangers 6*a*, 6*b*, and distributed through the indoor expansion valves 18*a*, 18*b* and the intermediate pressure pipe 13 to the outdoor expansion valves 27*a*, 27*b* of the outdoor unit 1 to be reduced in pressure.

Thereafter, the refrigerant is evaporated and heat-exchanged in the ice heat storage 65 to freeze the water in the ice heat storage tank 65, and then passed through the outdoor heat exchangers 3*a*, 3*b*. Thereafter, the refrigerant flows through the change-over valves 9*b*, 19*b*, and then it is successively passed through the low pressure pipe 12, the suction pipe 8 and the accumulator 4 and then sucked into the compressor 2. As described above, ice heat storage is carried out in the ice heat storage tank 65.

Hot-Water Stocking+Ice Heat Storage Operation

When (hot-water stocking+ice heat storage) operation is carried out, the change-over valves 9*a*, 19*a* of the outdoor heat exchangers 3*a*, 3*b* are closed, and the other change-over valves 9*b*, 19*b* are opened. In addition, the circulating pump 45 is set to the driving state. Furthermore, the switching valve 48 for connecting the high pressure pipe 11 and the hot-water stocking heat exchanger 41 is opened.

The refrigerant discharged from the compressor 2 is led through the discharge pipe 7, the high pressure pipe 11 and the switching valve 48 to the hot-water stocking heat exchanger 41. Water passing through the water pipe 46 is heated in the hot-water stocking heat exchanger 41, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

Thereafter, the refrigerant is distributed through the expansion valve 47 and the intermediate pressure pipe 13 to the outdoor expansion valves 27*a*, 27*b* of the outdoor units 3*a*, 3*b*, and reduced in pressure there.

Thereafter, the refrigerant is heat-exchanged and evaporated in the ice heat storage tank 65 to freeze the water in the ice heat storage tank 65, and then the refrigerant thus evaporated passes through the outdoor heat exchangers 3*a*, 3*b* and the change-over valves 9*b*, 19*b*. Thereafter, the refrigerant is successively passed through the low pressure pipe 12 and the suction pipe 8, and then sucked into the compressor 2. As described above, the ice heat storage is carried out in the ice heat storage tank 65.

[7] Seventh Embodiment

Figure 12:
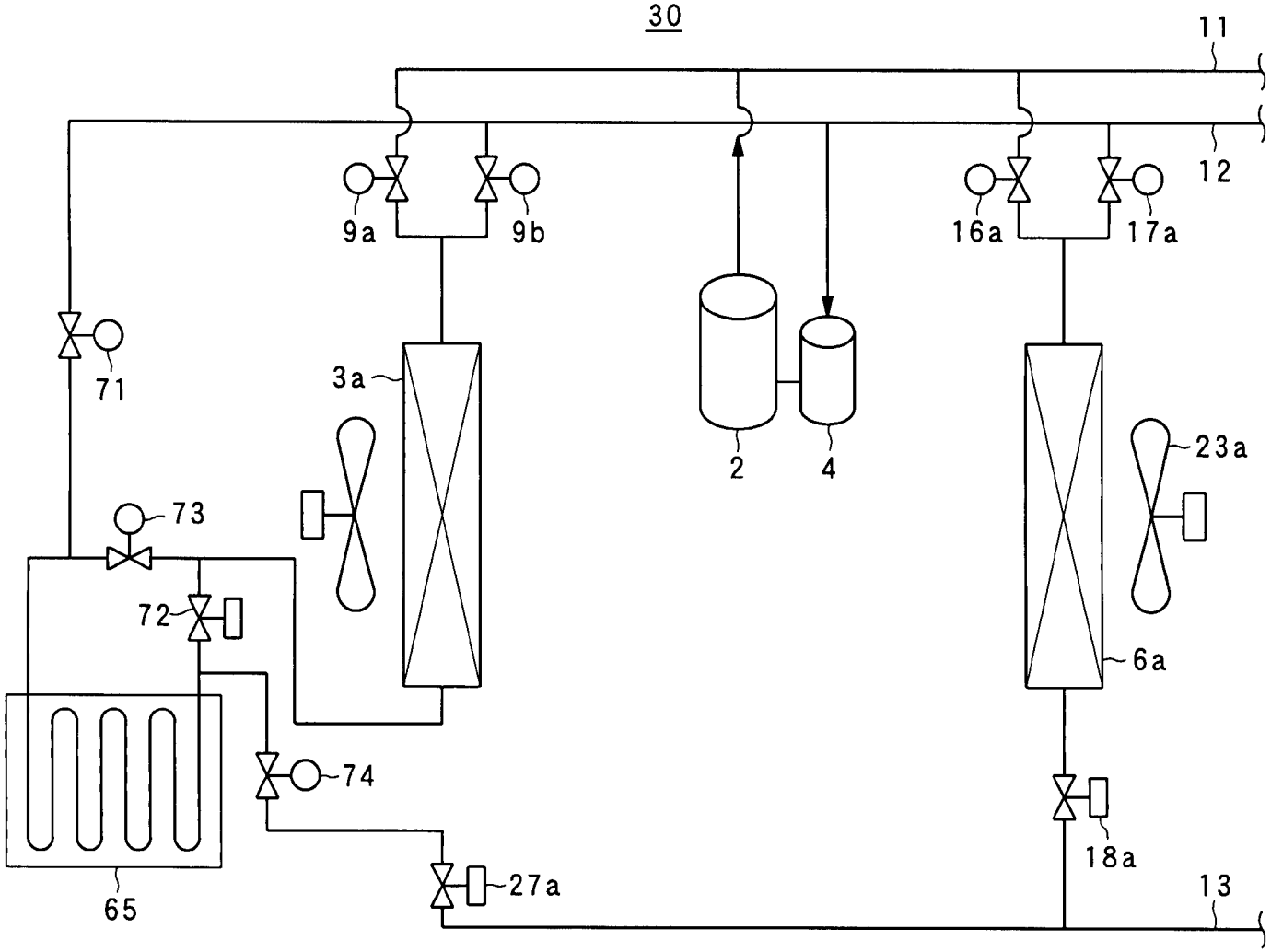
FIG. 12 is a diagram showing the main part of a refrigerant circuit diagram of a refrigerating machine according to a seventh embodiment.

FIG. D12 is a diagram showing the details of the main part of a refrigerating machine according to a seventh embodiment. In FIG. 12, the same parts as shown in FIG. 11 are represented by the same reference numerals.

The seventh embodiment is different from the sixth embodiment in the following point. In the sixth embodiment, when the ice heat storage operation is carried out, the heating operation or the hot-water stocking operation is carried out in the indoor units 5*a*, 5*b*. However, in the seventh embodiment, when the ice heat storage operation is carried out, no heating operation is carried out in the indoor units 5*a*, 5*b*, and also no hot-water stocking operation is carried out in the hot-water stocking unit 50.

Next, the operation of the refrigerating machine 30 will be described. In the following description, the same operation as the first embodiment is carried out except for the ice heat storage operation, and thus only the cooling operation, the ice heat storage operation and the (hot-water stocking+Ice Heat Stocking) operation will be described.

Cooling Operation

First, the operation of the refrigerating machine under cooling operation will be described.

When cooling operation is carried out in the indoor units 5*a*, 5*b*, the change-over valves 9*a*, 19*a* of the outdoor heat exchangers 3*a*, 3*b* are opened, and the other change-over valves 9*b*, 19*b* are closed. Furthermore, the change-over valve 71 is closed, and the amount of the refrigerant flowing through the ice heat storage tank 65 is controlled, the opening degree of an expansion valve 72 is adjusted so that the refrigerant temperature after interflow is adjusted, and change-over valves 73, 74 are opened. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the stop state.

When the compressor 2 is driven under the above state, the refrigerant discharged from the compressor 2 successively flows through the discharge pipe 7, the high pressure pipe 11, the change-over valves 9*a*, 19*a* and the outdoor heat exchangers 3*a*, 3*b*. Then, the refrigerant is heat-exchanged in the outdoor heat exchangers 3*a*, 3*b*, and then reaches the ice heat storage tank 65 through the change-over valves 73.

Accordingly, the ice heat storage tank 65 cools (heat-exchanges) the refrigerant discharged from the outdoor heat exchangers 3*a*, 3*b*. Apart of the refrigerant from the outdoor heat exchangers 3*a*, 3*b* bypasses the ice heat storage tank 65 and reaches the expansion valve 72 (i.e., the part of the refrigerant reaches the expansion valve 72 without passing through the ice heat storage tank 65). The opening degree of the expansion valve 72 is adjusted so as to adjust the refrigerant temperature after the refrigerant passing through the expansion valve 72 is confluent with the refrigerant which is passed through the ice heat storage tank 65 and cooled. The refrigerant passing through the expansion valve 72 flows through the change-over valve 74 to the outdoor expansion valves 27*a*, 27*b*.

The refrigerant passing through the ice heat storage tank 65 passes through the outdoor heat expansion valves 27*a*, 27*b*, and flows to the intermediate pressure pipe 13. Thereafter, the refrigerant is distributed to the indoor expansion valves 18*a* 18*b* of the indoor units 5*a*, 5*b* and reduced in pressure there.

Thereafter, the refrigerant is evaporated in the indoor heat exchangers 6*a*, 6*b*, and flows through the suction side valves 17*a*, 17*b*. Thereafter, the refrigerant is successively passed through the low pressure pipe 12, the suction pipe 8 and the accumulator 4, and then sucked into the compressor 2. As described above, cooling operation is carried out in all the indoor units 5*a*, 5*b* at the same time by the action of the indoor heat exchangers 6*a*, 6*b* functioning as evaporators.

As described above, according to the above construction, the ice heat storage tank 65 cools (heat-exchanges) the refrigerant discharged from the outdoor heat exchangers 3*a*, 3*b* with ice, so that the pressure at the high pressure side to achieve the necessary enthalpy difference can be reduced and thus the compression power of the compressor 2.

Ice Heat Storage Operation

Next, the operation of the refrigerating machine under ice heat stocking operation will be described.

When the ice heat stocking operation is carried out, the change-over valves 9*a*, 19*a* of the outdoor heat exchangers 3*a*, 3*b* are opened, and the other change-over valves 9*b*, 19*b* are closed. Furthermore, the change-over valve 71 is opened, the opening degree of the expansion valve 72 is suitably adjusted, and the change-over valves 73, 74 are closed. In addition, the discharge side valves 16*a*, 16*b* and the suction side vales 17*a*, 17*b* are closed.

The refrigerant discharged from the compressor 2 successively flows to the discharge pipe 7, the high pressure pipe 11, the change-over valves 9*a*, 19*a* and the outdoor heat exchangers 3*a*, 3*b*. Then, the refrigerant is reduced in pressure by the expansion valve 72, and flows into the ice heat storage tank 65. Thereafter, the refrigerant is heat-exchanged and evaporated in the ice heat storage tank 65 to freeze the water in the ice heat storage tank 65, and then the refrigerant is successively passed through the change-over valve 71, the low pressure pipe 12, the suction pipe 8 and the accumulator 4, and then sucked into the compressor 2. As described above, ice heat storage is carried out in the ice heat storage tank 65.

Hot-Water Stocking+Ice Heat Storage Operation

Next, the operation of the refrigerating machine under (hot-water stocking+ice heat storage) operation is carried out, the change-over valves 9*a*, 19*a*, 9*b*, 19*b* of the outdoor heat exchangers 3*a*, 3*b* are closed. In addition, the change-over valves 71, 74 are opened, and the expansion valve 72 and the change-over valve 73 is closed. In addition, the circulating pump 45 is set to the driving state. Furthermore, the switching valve 48 for connecting the high pressure pipe 11 and the hot-water stocking heat exchanger 41 is opened. Accordingly, the refrigerant discharged from the compressor 2 flows through the discharge pipe 7, the high pressure pipe 11, the change-over valve 48 and the hot-water stocking heat exchanger 41. The refrigerant is heat-exchanged (radiates heat) in the hot-water stocking heat exchanger 41 to heat water, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

Subsequently, the refrigerant is passed through the expansion valve 47 and the intermediate pressure pipe 13, and reduced in pressure by the outdoor expansion valve 27*a*. Then, the refrigerant flows through the change-over valve 74 into the ice heat storage tank 65.

Thereafter, the refrigerant is heat-exchanged and evaporated in the ice heat storage tank 65 to freeze the water in the ice heat storage tank 65, and then the refrigerant is successively passed through the change-over valve 71, the low pressure pipe 12, the suction pipe 8 and the accumulator 4, and then sucked into the compressor 2 (ice heat storage operation). As described above, the ice heat storage is carried out in the ice heat storage tank 65.

[8] Eighth Embodiment

Figure 13:
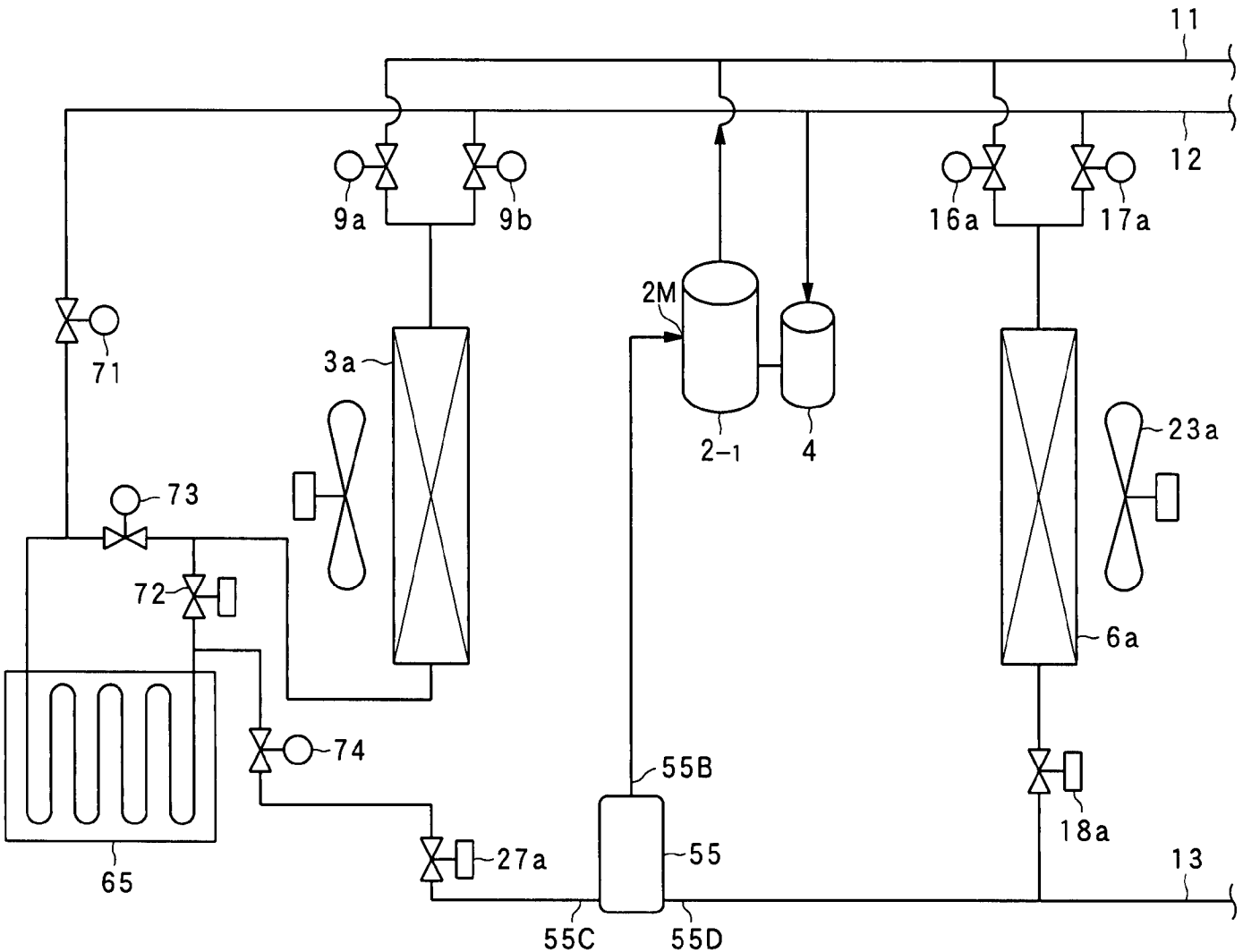
FIG. 13 is a diagram showing the main part of a refrigerant circuit diagram of a refrigerating machine according to an eighth embodiment.

FIG. 13 is a diagram showing the details of the main part of the refrigerant circuit of a refrigerating machine according to an eighth embodiment. In FIG. 13, the same parts as shown in FIG. 4 or 12 are represented by the same reference numerals The eighth embodiment is different from the seventh embodiment in that the intermediate pressure receiver 55 of the second embodiment is provided. The operation and effect of the eighth embodiment are the same as the second embodiment and the seventh embodiment, and thus the description thereof is omitted.

[9] Ninth Embodiment

Figure 14:
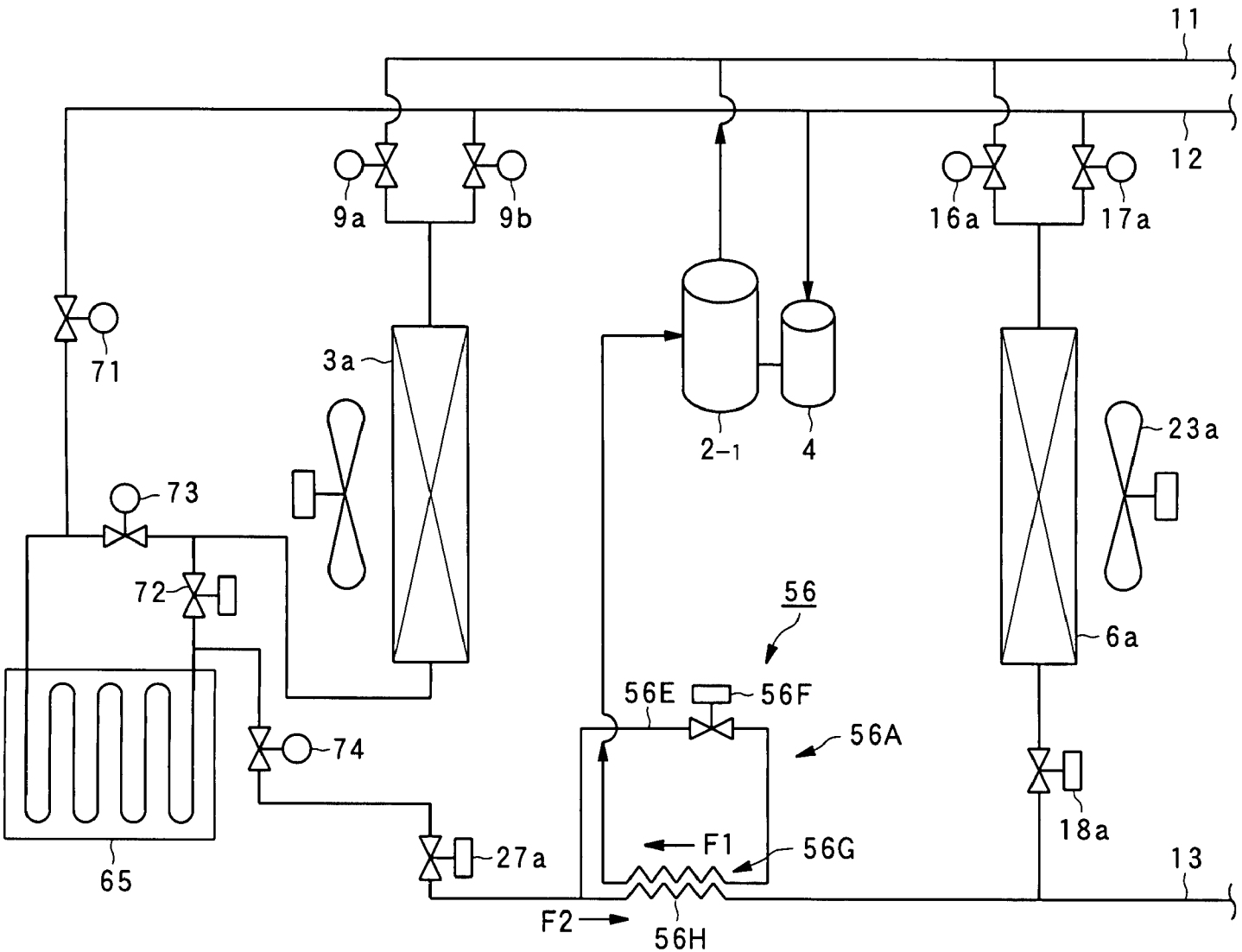
FIG. 14 is a diagram showing the main part of a refrigerant circuit diagram of a refrigerating machine according to a ninth embodiment.

FIG. 14 is a diagram showing the details of the main part of the refrigerant circuit of a refrigerating machine according to a ninth embodiment. In FIG. 14, the same parts as shown in FIG. 8 or 12 are represented by the same reference numerals. The ninth embodiment is different from the eighth embodiment in that the heat exchange circuit 56 of the third embodiment is provided. The operation and effect of the ninth embodiment are the same as the third embodiment and the eighth embodiment, and thus the description thereof is omitted.

[10] Tenth Embodiment

Figure 15:
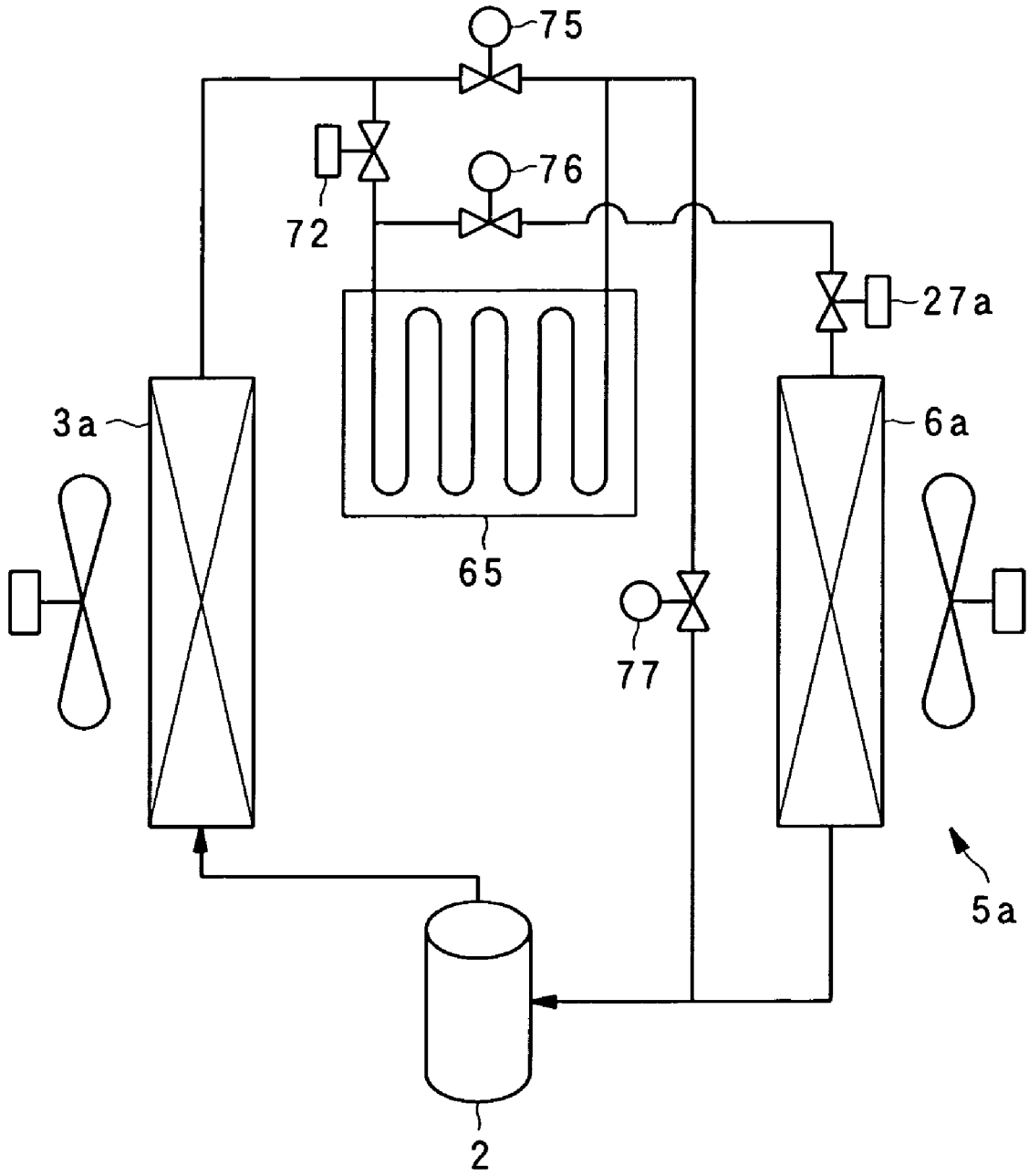
FIG. 15 is a refrigerant circuit diagram of a refrigerant machine according to a tenth embodiment.

FIG. 15 is a refrigerant circuit diagram showing a refrigerating machine according to a tenth embodiment. In FIG. 15, the same parts as shown in FIG. 9 are represented by the same reference numerals.

Cooling Operation

First, the operation of the refrigerating machine under cooling operation will be described. In the following description, the same operation as the fourth embodiment is carried out except for the cooling operation and the ice heat storage operation, and thus only the cooling operation and ice heat storage operation will be described.

The refrigerating machine 30 is exclusively used for the cooling operation, and it comprises an outdoor unit 1 including a compressor 2, an outdoor heat exchanger 3*a*, an outdoor expansion valve 27*a* and an expansion valve 72, an indoor unit 5*a* having an indoor heat exchanger 6*a*, an ice heat storage tank 65 and change-over valves 75, 76 and 77.

Next, the operation of the refrigerating machine 30 under cooling operation will be described.

In this case, the opening degree of the expansion valve 72 is adjusted so as to control the flow amount of the refrigerant bypassing the ice heat storage tank 65, and the change-over valve 77 is closed while the change-over valves 75 76 are opened. When the compressor 2 is driven under the above state, the refrigerant discharged from the compressor 2 flows through the pipe to the outdoor heat exchanger 3*a*.

The refrigerant is heat-exchanged in the outdoor heat exchanger 3*a*, and then reaches through the change-over valve 75 to the ice heat storage tank 65.

Accordingly, the refrigerant discharged from the outdoor heat exchanger 3*a* is heat-exchanged and cooled with ice in the heat storage tank 65, and then flows through the change-over valve 76 to the outdoor expansion valve 27*a*. Then, the refrigerant is reduced in pressure by the outdoor expansion valve 27*a*, and reaches the indoor heat exchanger 6*a*. The refrigerant is evaporated in the indoor heat exchanger 6*a*, and sucked into the compressor 2. As described above, cooling operation is carried out in the indoor unit 5*a* by the action of the indoor heat exchanger 6*a* functioning as an evaporator.

Ice Heat Storage Operation

Next, the operation of the refrigerating machine under ice heat storage operation will be described.

In this case, the change-over valve 77 is opened, and the change-over valves 75, 76 are closed. Accordingly, the refrigerant discharged from the compressor 2 flows to the outdoor heat exchanger 3*a*, and then is reduced in pressure by the expansion valve 72. Thereafter, the refrigerant is heat-exchanged and evaporated in the ice heat storage tank 65 to freeze the water in the ice heat storage tank 65, and then sucked through the change-over valve 77 into the compressor 2.

As described above, the ice heat storage is carried out in the ice heat storage tank 65.

[11] Eleventh Embodiment

Figure 16:
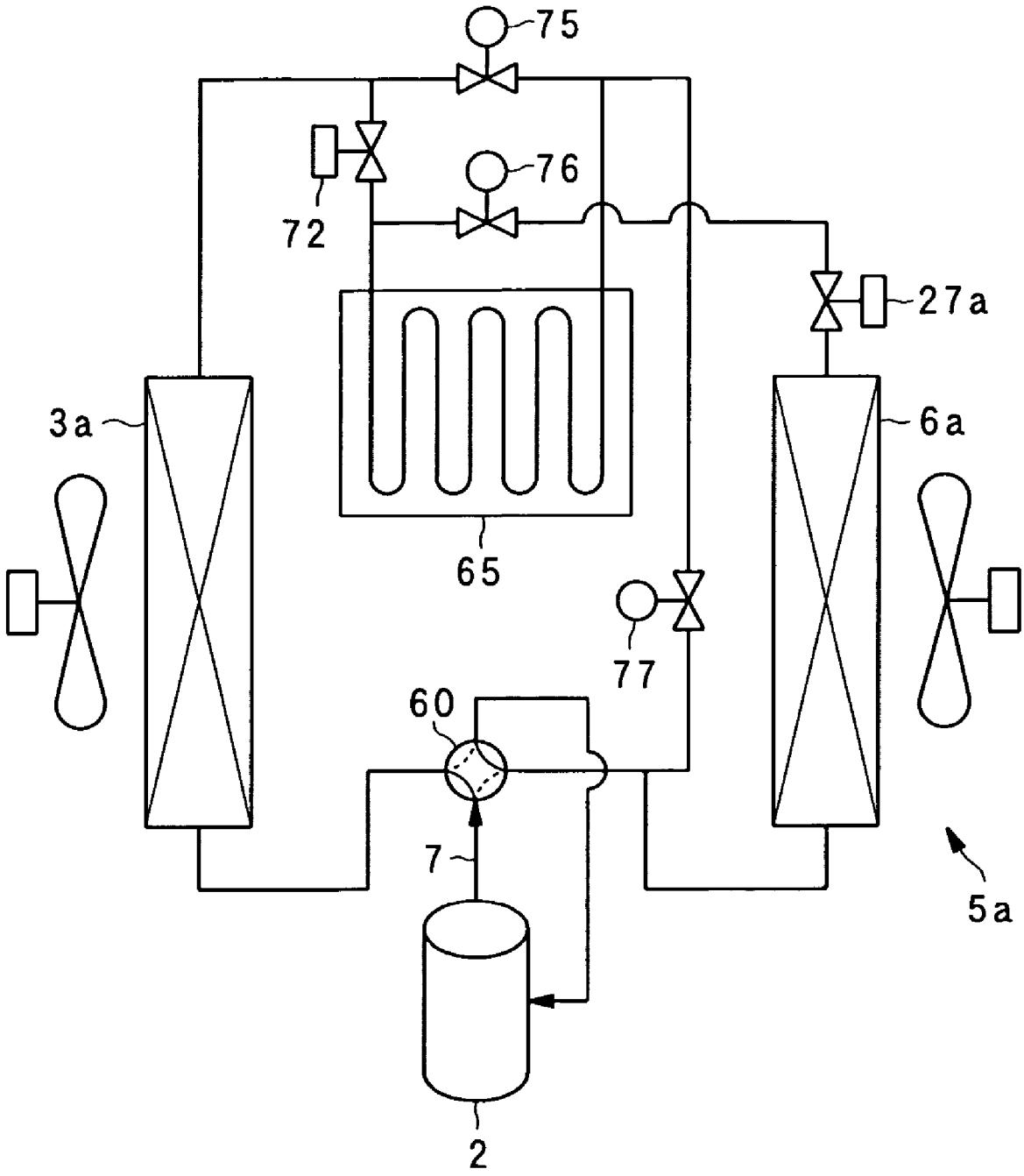
FIG. 16 is a refrigerant circuit of a refrigerating machine according to an eleventh embodiment.

FIG. 16 is a diagram showing the details of the main part of the refrigerant circuit of a refrigerating machine according to an eleventh embodiment. In FIG. 16, the same parts as shown in FIG. 10 or FIG. 15 are represented by the same reference numerals. The eleventh embodiment is different from the fifth embodiment in that the ice heat storage tank 65 of the tenth embodiment described above and an incidental circuit are provided. The same operation and effect as the fifth embodiment and the tenth embodiment are implemented, and the detailed description thereof is omitted.

[12] Twelfth Embodiment

Figure 17:
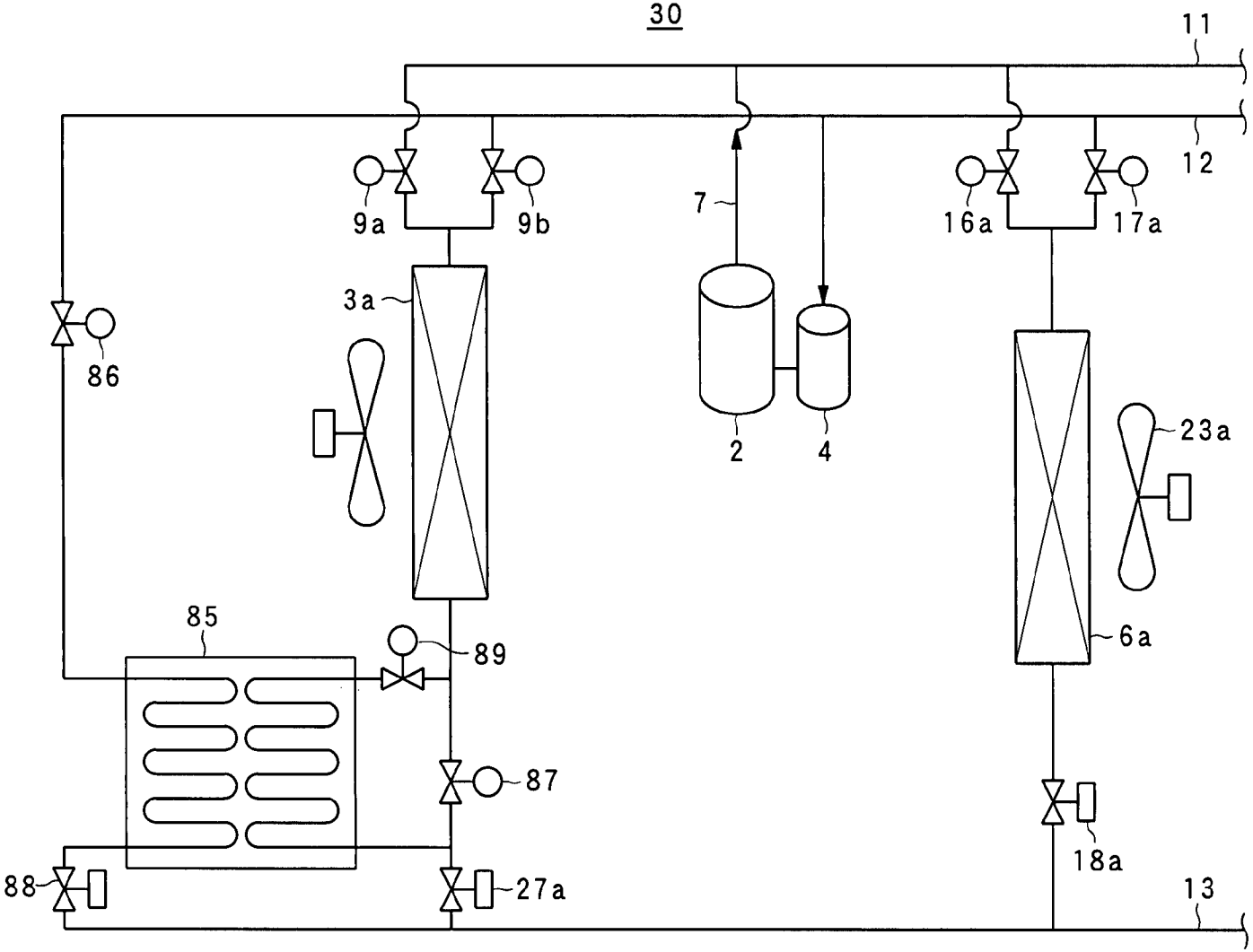
FIG. 17 is a diagram showing the main part of a refrigerant circuit diagram of a refrigerating machine according to a twelfth embodiment.

FIG. 17 is a diagram showing the details of the main part of the refrigerant circuit of a refrigerating machine according to a twelfth embodiment. In FIG. 17, the same parts as shown in FIG. 12 are represented by the same reference numerals. The twelfth embodiment is different from the sixth embodiment in that an ice heat storage tank 85, change-over valves 86, 89 and expansion valves 87, 88 are provided in place of the ice heat storage tank 65.

Next, the operation of the refrigerating machine 30 will be described. In the following description, the same operation as the first embodiment is carried out except for the ice heat storage operation, and thus only the cooling operation and the ice heat storage operation will be described.

Cooling Operation

First, when cooling operation is carried out in the indoor units 5*a*, 5*b*, the change-over valves 9*a*, 19*a* of the outdoor heat exchangers 3*a*, 3*b* are opened, and the other change-over valves 9*b*, 19*b* are closed. The change-over valves 86 are closed, the opening degree of the expansion valve 87 is adjusted so that the flow amount is adjusted to adjust the refrigerant temperature, the expansion valve 88 is closed, and the change-over valve 89 is opened. In addition, the discharge side valves 16*a*, 16*b* are closed, and the suction side valves 17*a*, 17*b* are opened. The outdoor fans 29*a*, 29*b* and the indoor fans 23*a*, 23*b* are set to the driving state, and the circulating pump 45 is set to the stop state.

When the compressor 2 is driven under the above state, the refrigerant discharged from the compressor 2 successively flows through the discharge pipe 7, the high pressure pipe 11, the change-over valves 9*a*, 19*a* and the outdoor heat exchangers 3*a*, 3*b*. Then, the refrigerant passes through the change-over valve 89 and reaches the ice heat storage tank 85. Accordingly, the ice storage heat tank 85 cools (heat-exchanges) the refrigerant discharged from the outdoor heat exchangers 3*a*, 3*b* with ice, and then feed the refrigerant thus cooled to the outdoor expansion valves 27*a*, 27*b*.

The refrigerant passing through the ice heat storage tank 85 flows through the outdoor expansion valves 27*a*, 27*b* to the intermediate pressure pipe 13, and it is distributed to the indoor expansion valves 18*a*, 18*b* of the indoor units 5*a*, 5*b* and reduced in pressure there.

Thereafter, the refrigerant is evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator 4, and then sucked into the compressor 2. As described above, cooling operation is carried out in all the indoor units 5*a*, 5*b* at the same time by the action of the indoor heat exchangers 6*a*, 6*b* functioning as evaporators.

According to the construction as described above, the ice heat storage tank 85 cools (heat-exchanges) the refrigerant discharged from the outdoor heat exchangers 3*a*, 3*b* with ice. Therefore, the pressure at the high-pressure side to achieve a necessary enthalpy difference can be reduced, and thus the compression power of the compressor 2 can be reduced.

Ice Heat Storage Operation

Next, the operation of the refrigerating machine under ice heat storage operation will be described.

When the ice heat storage operation is carried out, the change-over valves 9*a*, 19*a* of the outdoor heat exchangers 3*a*, 3*b* are opened, and the other change-over valves 9*b*, 19*b* are closed. Furthermore the outdoor expansion valve 27*a*, the change-over valve 86 and the expansion valve 87 are opened, and the opening degree of the expansion valve 88 is adjusted to adjust the refrigerant flow amount. Furthermore the change-over valve 89 is closed, and the discharge side valves 16*a*, 16*b* and the suction side valves 17*a*, 17*b* are closed.

Accordingly, the refrigerant discharged from the compressor 2 successively passes through the discharge pipe 7 and the high pressure pipe 11, and then flows to the change-over valves 9*a*, 19*a* and the outdoor heat exchangers 3*a*, 3*b*. The refrigerant is heat-exchanged without being condensed in the outdoor heat exchangers 3*a*, 3*b*, passed through the expansion valve 87 and the outdoor expansion valve 27*a*, reduced in pressure through the expansion valve 88, and then fed into the ice heat storage tank 85.

Thereafter, the refrigerant is heat-exchanged in the ice heat storage tank 85 to freeze the water in the ice heat storage tank 85, and the refrigerant thus cooled is successively passed through the change-over valve 86, the low pressure pipe 12, the suction pipe 8 and the accumulator 4, and then sucked into the compressor 2. The ice heat storage is carried out in the ice heat storage tank 85 as described above.

[13] Thirteenth Embodiment

Figure 18:
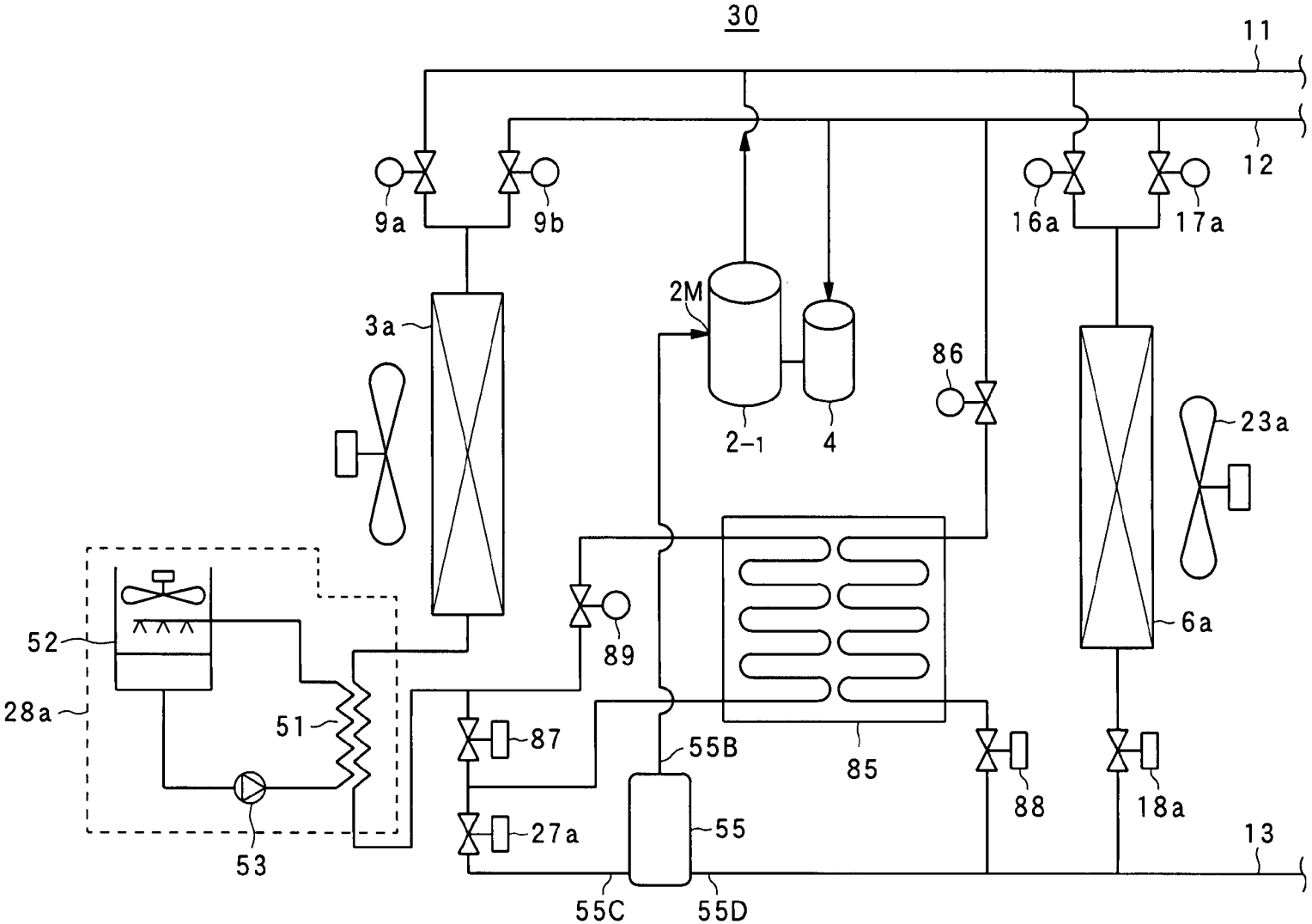
FIG. 18 is a diagram showing the main part of a refrigerant circuit diagram of a refrigerating machine according to a thirteenth embodiment.

FIG. 18 is a diagram showing the details of the main part of the refrigerant of a refrigerating machine according to a thirteenth embodiment. In FIG. 8, the same parts as shown in FIG. 2, 4 or 17 are represented by the same reference numerals.

The thirteenth embodiment is different from the twelfth embodiment in that the water cooling device of the first embodiment and the intermediate pressure receiver of the second embodiment are provided. The same operation and effect as the first, second and thirteenth embodiments are implemented, and the detailed description thereof is omitted.

[14] Fourteenth Embodiment

Figure 19:
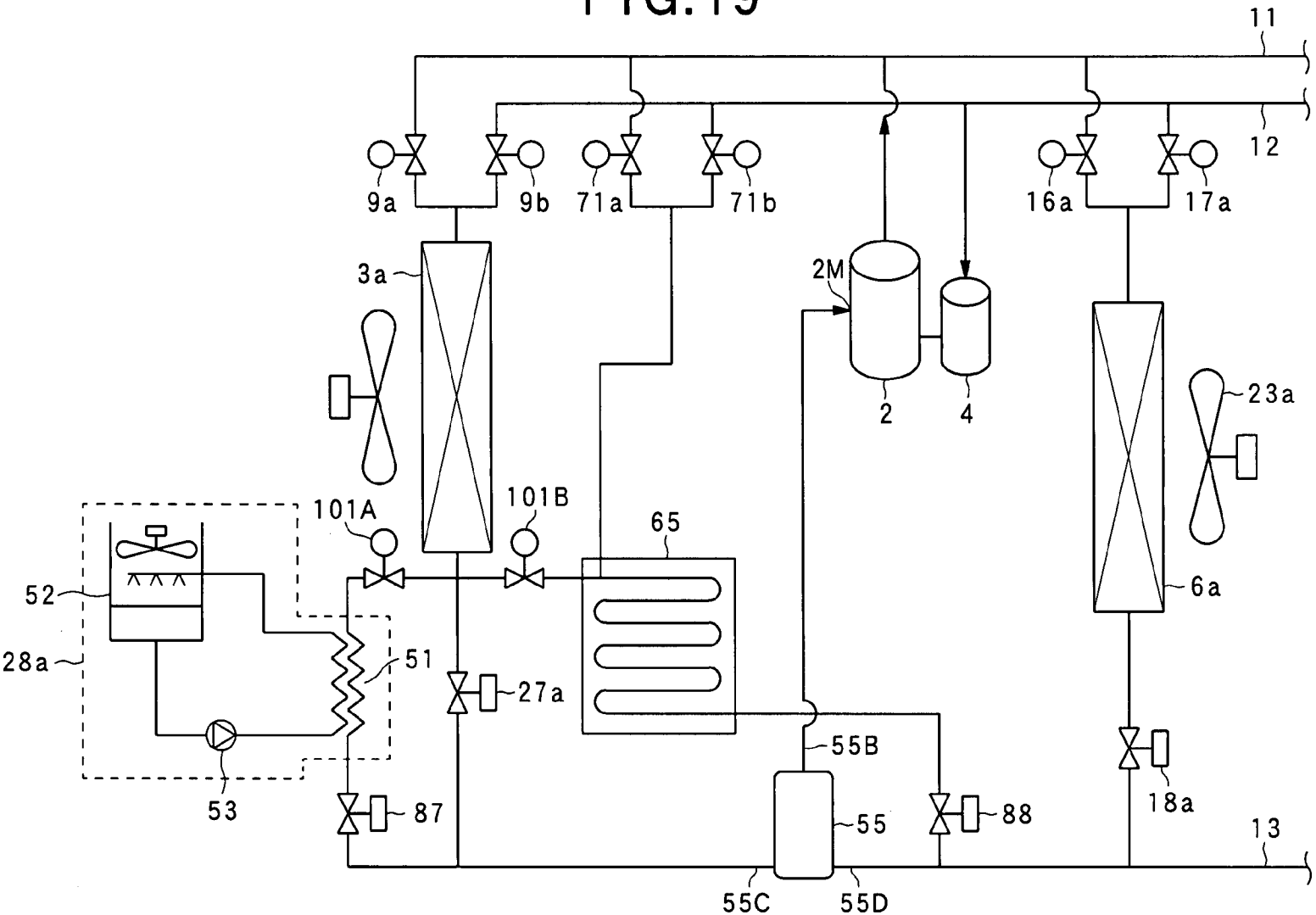
FIG. 19 is a diagram showing the main part of a refrigerant circuit diagram of a refrigerating machine according to a fourteenth embodiment.

FIG. 19 is a diagram showing the details of the main part of the refrigerant circuit of a refrigerating machine according to a fourteenth embodiment. In FIG. 19, the same parts as shown in FIG. 2, FIG. 4 or FIG. 17 are represented by the same reference numerals.

The fourteenth embodiment is different from the thirteenth embodiment in that the water cooling device 28*a* (28*b*), the ice heat storage tank 65 and the outdoor expansion valve 27*a* (27*b*) are arranged in parallel between the heat-source side heat exchanger and the intermediate pressure pipe 13.

In this case, when the heat storage operation is carried out, the change-over valves 9*a*, 19*a* of the outdoor heat exchangers 3*a*, 3*b* are opened, and the other change-over valves 9*b*, 19*b* are closed. Furthermore, the change-over valve 71*a* is closed, the change-over valve 71*b* is opened, the change-over valve 101A is opened, the change-over valve 101B is closed, the expansion valve 27*a* (27*b*) is closed, and the opening degree of the expansion valve 87 is adjusted. Accordingly, the refrigerant successively passes through the discharge pipe 7 and the high pressure pipe 11, and reaches the outdoor heat exchangers 3*a*, 3*b* through the change-over valves 9*a*, 19*b* to carry out heat exchange (radiate heat). Then, the refrigerant is fed through the change-over valve 101A to the water cooling device 28*a* (28*b*) to be heat-exchanged (radiate heat; additionally cooled). Then, the refrigerant is reduced in pressure by the expansion valve 87, and fed through the first inlet/outlet pipe 55C into the intermediate pressure receiver 55.

In the intermediate pressure receiver 55, the refrigerant is separated into liquid refrigerant and intermediate-pressure gas refrigerant. The liquid refrigerant is fed through the second inlet/outlet pipe 55D and the intermediate pressure pipe 13 to the expansion valve 88 to be expanded again, and then fed to the ice heat storage tank 65.

Thereafter, the refrigerant is heat-exchanged and evaporated in the ice heat storage tank 65 to freeze the water in the ice heat storage tank 65. Thereafter, the refrigerant is successively passed through the change-over valve 71B, the low pressure pipe 12, the suction pipe 8 and the accumulator 4, and sucked into the compressor 2. As described above, the ice heat storage is carried out in the ice heat storage tank 85.

On the other hand, the intermediate pressure gas refrigerant which is separated in the intermediate pressure receiver body 55A is sucked through the gas outlet pipe 55B into the intermediate pressure portion 2M of the compressor 2. As described above, the ice heat storage is carried out in the ice heat storage tank 65 while auxiliary cooling is carried out in the water cooling devices 28*a*, 28*b*.

Furthermore, during cooling operation, the auxiliary cooling based on the water cooling devices 28*a*, 28*b* and the auxiliary cooling based on the ice heat storage tank 65 can be switched to each other by the change-over valves 101A, 101B and selectively used.

Specifically, in such a time zone as morning or evening where cooling power is not so needed, cooling operation is carried out by using the auxiliary cooling operation based on the water cooling devices 28*a*, 28*b*, and in such a time zone as daytime where cooling power is needed, cooling operation is carried out by using the auxiliary cooling operation based on the ice heat storage tank 65.

The other operation and effect of this embodiment are the same as the first, second, twelfth and thirteenth embodiments, and thus the detailed description thereof is omitted.

[15] Fifteenth Embodiment

Figure 20:
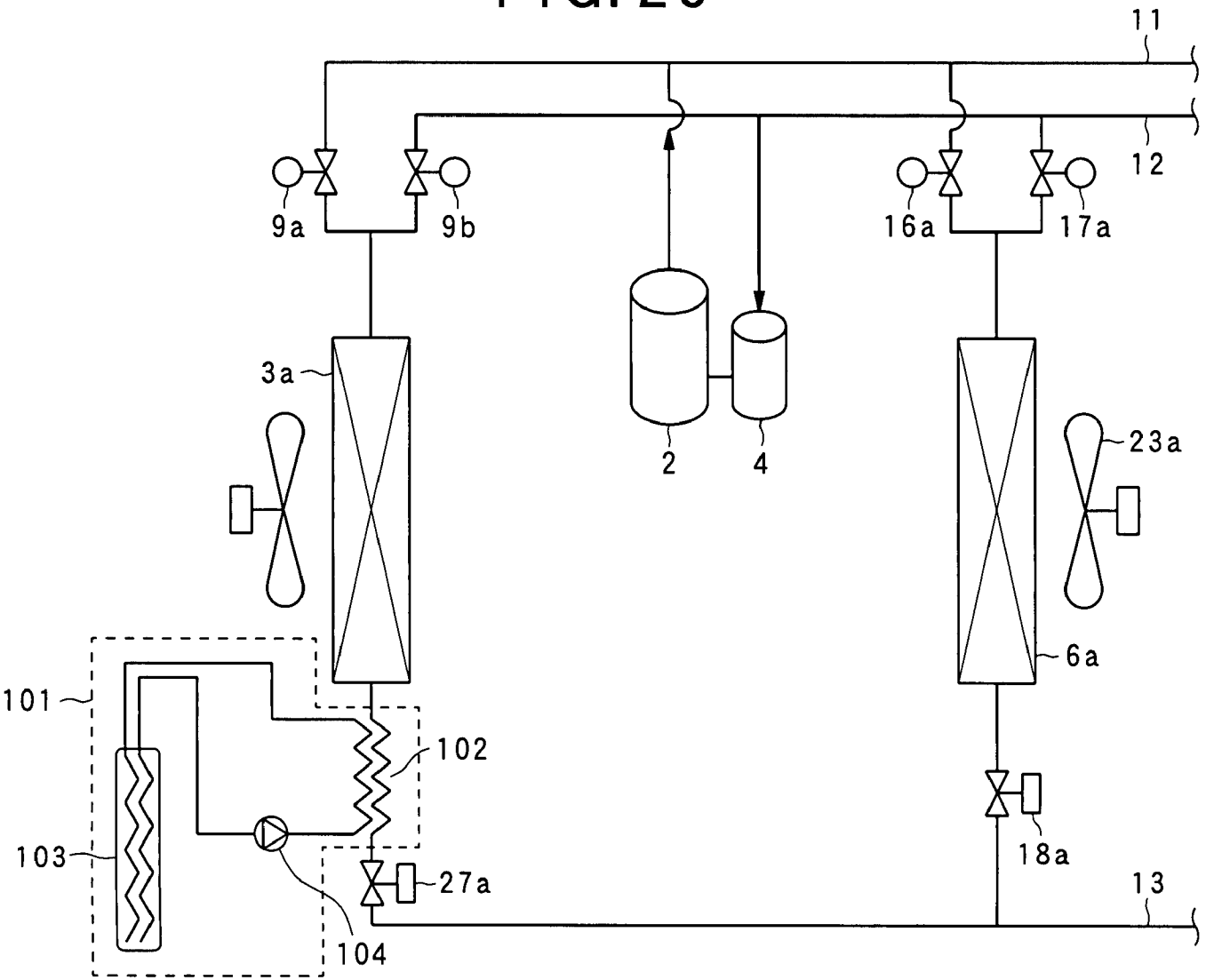
FIG. 20 is a diagram showing the main part of a refrigerant circuit diagram of a refrigerating machine according to a fifteenth embodiment.

FIG. 20 is a diagram showing the details of the main part of the refrigerant circuit of a refrigerating machine of a fifteenth embodiment. The refrigerating machine of the fifteenth embodiment is different from the refrigerating machine of the first embodiment in that an underground heat exchanger using underground-heat as a natural heat source is provided din place of the water cooling devices 28*a*, 28*b*. In FIG. 20, the underground heat exchanger 101 provided in place of the water cooling device 28*b* is not shown for simplification of illustration.

As shown in FIG. 20, the underground heat exchanger 101 comprises a first heat exchanger 102 that is connected to the outdoor heat exchangers 3*a*, 3*b* and the outdoor expansion valves 27*a*, 27*b* and carries out the heat exchange with the refrigerant discharged from the outdoor heat exchangers 3*a*, 3*b* during operation, a second heat exchanger 103 for cooling or heating a thermal medium (brine) after the heat exchange with underground-heat, and a brine pump 104 for circulating the thermal medium (brine).

In this case, by cooling or heating the refrigerant with the underground-heat, the pressure ratio can be reduced, and the enthalpy difference can be increased. Accordingly, when the same power is secured, the refrigerant circulating amount can be reduced. In other words, in addition to the reduction of the pressure ratio, the compression power can be reduced, so that the coefficient of performance of the heat exchange can be enhanced.

Next, the operation of the refrigerating machine 30 of the fifteenth embodiment will be described.

Cooling Operation

First, the operation of the refrigerating machine under cooling operation will be described.

When cooling operation is carried out in the indoor units 5*a*, 5*b*, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the stop state.

In this case, the opening degrees of the outdoor expansion valves 27*a*, 27*b* and the indoor expansion valves 18*a*, 18*b* are controlled so that the temperature sensor S4 detects a predetermined temperature and the difference between the detection temperature of the temperature sensor S1 and the detection temperature of the temperature sensor S2 (corresponding to the superheat degree) is equal to a fixed value.

When the compressor 2 is driven under the above state, the refrigerant discharged from the compressor 2 successively flows through the discharge pipe 7, the change-over valves 9*a*, 19*a* and the outdoor heat exchangers 3*a*, 3*b*.

The refrigerant is heat-exchanged in the outdoor heat exchangers 3*a*, 3*b*, and then reaches the first heat exchanger 102 constituting the geothermal heat exchanger 101. Accordingly, the first heat exchangers 102 cool (heat-exchange) the refrigerant discharged from the outdoor heat exchangers 3*a*, 3*b* with brine, and then feed the refrigerant to the outdoor expansion valves 27*a*, 27*b*.

At this time, the brine after the heat-exchange in the first heat exchanger 102 is fed to the second heat exchanger 103 to be cooled with underground-heat. Thereafter, the refrigerant is circulated through the brine pump 104 to the first heat exchanger 102. The refrigerant passing through the underground heat exchanger 101 is passed through the outdoor expansion valves 27*a*, 27*b*, fed to the intermediate pressure pipe 13, and distributed to the indoor expansion valves 18*a*, 18*b* of the indoor units 5*a*, 5*b* to be reduced in pressure.

Thereafter, the refrigerant is evaporated in the indoor heat exchangers 6*a*, 6*b* and fed to the suction side valves 17*a*, 17*b*. Thereafter, the refrigerant is successively passed through the low pressure pipe 12, the suction pipe 8 and the accumulator 4, and then sucked into the compressor 2. As described above, cooling operation is carried out in all the indoor units 5*a*, 5*b* at the same time by the action of the indoor heat exchangers 6*a*, 6*b* functioning as evaporators.

According to the construction as described above, the underground heat exchanger 101 cools (heat-exchanges) the refrigerant discharged from the outdoor heat exchangers 3*a*, 3*b* with underground-heat, and thus the pressure at the high pressure side to achieve a necessary enthalpy difference can be reduced, so that the compression power of the compressor 2 can be reduced.

Heating Operation

Next, the operation of the refrigerating machine under heating operation will be described.

When heating operation is carried out in the indoor units 5*a*, 5*b*, the change-over valves 9*a*, 19*a* of the outdoor heat exchangers 3*a*, 3*b* are closed, and the other change-over valves 9*b*, 19*b* are opened. In addition, the discharge side valves 16*a*, 16*b* are opened, and the suction side valves 17*a*, 17*b* are closed.

Accordingly, the refrigerant discharged from the compressor 2 successively passes through the discharge pipe 7 and the high pressure pipe 11, and then flows to the discharge side valves 16*a*, 16*b* and the indoor heat exchangers 6*a*, 6*b*. The refrigerant is heat-exchanged without being condensed in the indoor heat exchangers 6*a*, 6*b*, passed through the indoor expansion valves 18*a* 18*b*, and distributed through the intermediate pressure pipe 13 to the outdoor expansion valves 27*a*, 27*b* of the outdoor unit 1 to be reduced in pressure.

Thereafter, the refrigerant reaches the first heat exchanger 102. Accordingly, the first heat exchangers 102 heat (heat-exchanges) the refrigerant with brine, and then fees the refrigerant thus cooled to the outdoor heat exchangers 3*a*, 3*b*. At this time, the brine heat-exchanged in the first heat exchanger 102 is fed to the second heat exchanger 103 to be heated with underground-heat, and then circulated through the brine pump 104 to the first heat exchanger 102.

The refrigerant passing through the underground heat exchanger 101 is evaporated in the outdoor heat exchangers 3*a*, 3*b*, fed to the change-over valves 9*b*, 19*b*, successively passed through the low pressure pipe 12, the suction pipe 8 and the accumulator 4, and then sucked into the compressor 2.

As described above, heating operation is carried out in all the indoor units 5*a*, 5*b* at the same time by the non-condensing heat-exchange action of the indoor heat exchangers 6*a*, 6*b*.

Cooling and Heating Mixed Operation

Next, the operation of the refrigerating machine under cooling and heating mixed operation will be described.

When cooling operation and heating operation are carried out in the different indoor units, for example when cooling operation is carried out in the indoor unit 5*a*, heating operation is carried out in the indoor unit 5*b* and a cooling load is larger than a heating load, the change-over valves 9*a*, 19*a* of the outdoor heat exchangers 3*a*, 3*b* are opened, and the other change-over valves 9*b*, 19*b* are closed. Furthermore, the discharge side valve 16*a* corresponding to the indoor unit 5*a* carrying out cooling operation is closed, and the suction side valve 17*a* is opened. Furthermore, the discharge side valve 16*b* corresponding to the indoor unit 5*b* carrying out heating operation is opened, and the suction side valve 17*b* is closed. As a result, a part of the refrigerant discharged form the compressor 2 is successively passed through the discharge pipe 7 and the change-over valves 9*a*, 19*a*, and then flows to the outdoor heat exchanger 3*a*. Then, the refrigerant is heat-exchanged in the outdoor heat exchanger 3*a*, and then reaches the first heat exchanger 102 constituting the water cooling device 28*a*.

Accordingly, the first heat exchanger 102 cools (heat-exchanges) the refrigerant discharged form the outdoor heat exchanger 3*a* with brine, and then feeds the refrigerant to the outdoor expansion valve 27*a*. At this time, the brine heat-exchanged in the first heat exchanger 102 is fed to the second heat exchanger 103, cooled with underground-heat and then circulated through the brine pump 104 to the first heat exchanger 102. The refrigerant passing through the underground heat exchanger 101 flows through the outdoor expansion valve 27*a* into the intermediate pressure pipe 13.

The residual refrigerant which does not flow to the outdoor heat exchanger 3 is passed through the high pressure pipe 11, and then flows through the discharge side valve 16*b* corresponding to the indoor unit 5*b* carrying out heating operation and the indoor heat exchanger 6*b*. Then, the refrigerant is subjected to non-condensing heat exchange action in the indoor heat exchanger 6*b* and the outdoor heat exchanger 3.

Then, the refrigerant heat-exchanged in the indoor heat exchanger 6*b* and the outdoor heat exchanger 3 is passed through the intermediate pressure pipe 13, and reduced in pressure by the indoor expansion valve 18*a* of the indoor unit 5*a*. Thereafter, the refrigerant is evaporated in the indoor heat exchanger 6*a*. Thereafter, the refrigerant is passed through the suction side valve 17*a* and confluent in the low pressure pipe 12. Thereafter, the refrigerant is successively passed through the suction pipe 8 and the accumulator 4, and then sucked into the compressor 2. As described above, heating operation is carried out in the indoor unit 5*b* by the heat-exchange action of the indoor heat exchanger 6*a*, and cooling operation is carried out in the indoor unit 5*a* by the action of the indoor heat exchanger 5*a* by the action of the indoor heat exchanger 6*a* functioning as an evaporator.

Cooling+Hot-Water Stocking Operation (Part 1)

A first operation of the refrigerating machine under (cooling+hot-water stocking) operation will be described.

When the (cooling+hot-water stocking) operation is carried out, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the driving state. Furthermore, the switching valve 48 for connecting the high pressure pipe 11 and the hot-water stocking heat exchanger 41 is opened.

When the compressor 2 is driven under the above state, a part of the refrigerant discharged from the compressor 2 is fed through the discharge pipe 7, the high pressure pipe 11 and the switching valve 48 to the hot-water stocking heat exchanger 41. In the hot-water stocking heat exchanger 41, water passing through the water pipe is heated, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant thus heat-exchanged reaches through the expansion valve 47 to the intermediate pressure pipe 13, and it is distributed to the indoor expansion valves 18*a*, 18*b* of the indoor units 5*a*, 5*b* to be reduced in pressure. Furthermore, the refrigerant is evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator 4, and then sucked into the compressor 2.

The other part of the refrigerant discharged from the compressor 2 successively flows through the discharge pipe 7, the change-over valves 9*a*, 19*a* and the outdoor heat exchangers 3*a*, 3*b*. Then, the refrigerant is heat-exchanged in the outdoor heat exchangers 3*a*, 3*b*, and then reaches the first heat exchanger 102 constituting the underground heat exchanger 101.

Accordingly, the first heat exchangers 102 cool (heat-exchange) the refrigerant discharged from the outdoor heat exchangers 3*a*, 3*b* with brine and then feed the refrigerant to the outdoor expansion valves 27*a*, 27*b*. At this time, the bring heat-exchanged in the first heat exchanger 102 is fed to the second heat exchanger 103 to be cooled with underground-heat and then circulated through the brine pump 104 to the first heat exchanger 102.

The refrigerant passing through the underground heat exchanger 101 flows through the outdoor expansion valves 27*a*, 27*b* to the intermediate pressure pipe 13, and then it is distributed to the indoor expansion valves 18*a*, 18*b* of the indoor units 5*a*, 5*b* to be reduced in pressure.

Thereafter, the refrigerant is evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator, and then sucked into the compressor 2. As described above, cooling operation is carried out in all the indoor heat units 5*a*, 5*b* at the same time by the action of the indoor heat exchangers 6*a*, 6*b* functioning as evaporators.

Cooling+Hot-Water Stocking Operation (Part 2)

Next, a second operation of the refrigerating machine under (cooling+hot-water stocking) operation will be described.

When the (cooling+hot-water stocking) operation is carried out, the change-over valves 9*a*, 19*a*, 9*b*, 19*b* of the outdoor heat exchangers 3*a*, 3*b* are closed. In addition, the discharge side valves 16*a*, 16*b* are closed, and the suction side valves 17*a*, 17*b* are opened. Furthermore, the outdoor fans 29*a*, 29*b* are set to the stop state, the indoor fans 23*a*, 23*b* are set to the driving state, and the circulating pump 45 is set to the driving state. Furthermore, the switching valve 48 for connecting the high-pressure pipe 11 and the hot-water stocking heat exchanger 41 is opened.

When the compressor 2 is driven under the above state, the refrigerant discharged from the compressor 2 is fed through the discharge pipe 7, the high pressure pipe 11 and the switching valve 48 to the hot-water stocking heat exchanger 41. In the hot-water stocking heat exchanger 41, water passing through the water pipe 46, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant thus heat-exchanged reaches through the expansion valve 47 to the intermediate pipe 13, and it is distributed to the indoor expansion valves 18*a*, 18*b* of the indoor units 5*a*, 5*b* to be reduced in pressure. Furthermore, the refrigerant is evaporated in the indoor heat exchangers 6*a*, 6*b* and then flows to the suction side valves 17*a*, 17*b*. Thereafter, the refrigerant is successively passed through the low pressure pipe 12, the suction pipe 8 and the accumulator 4, and then sucked into the compressor 2. The other operation is the same as the first embodiment, and the effect thereof is the same as the first embodiment. Therefore, the detailed description thereof is omitted.

[16] Sixteenth Embodiment

Figure 21:
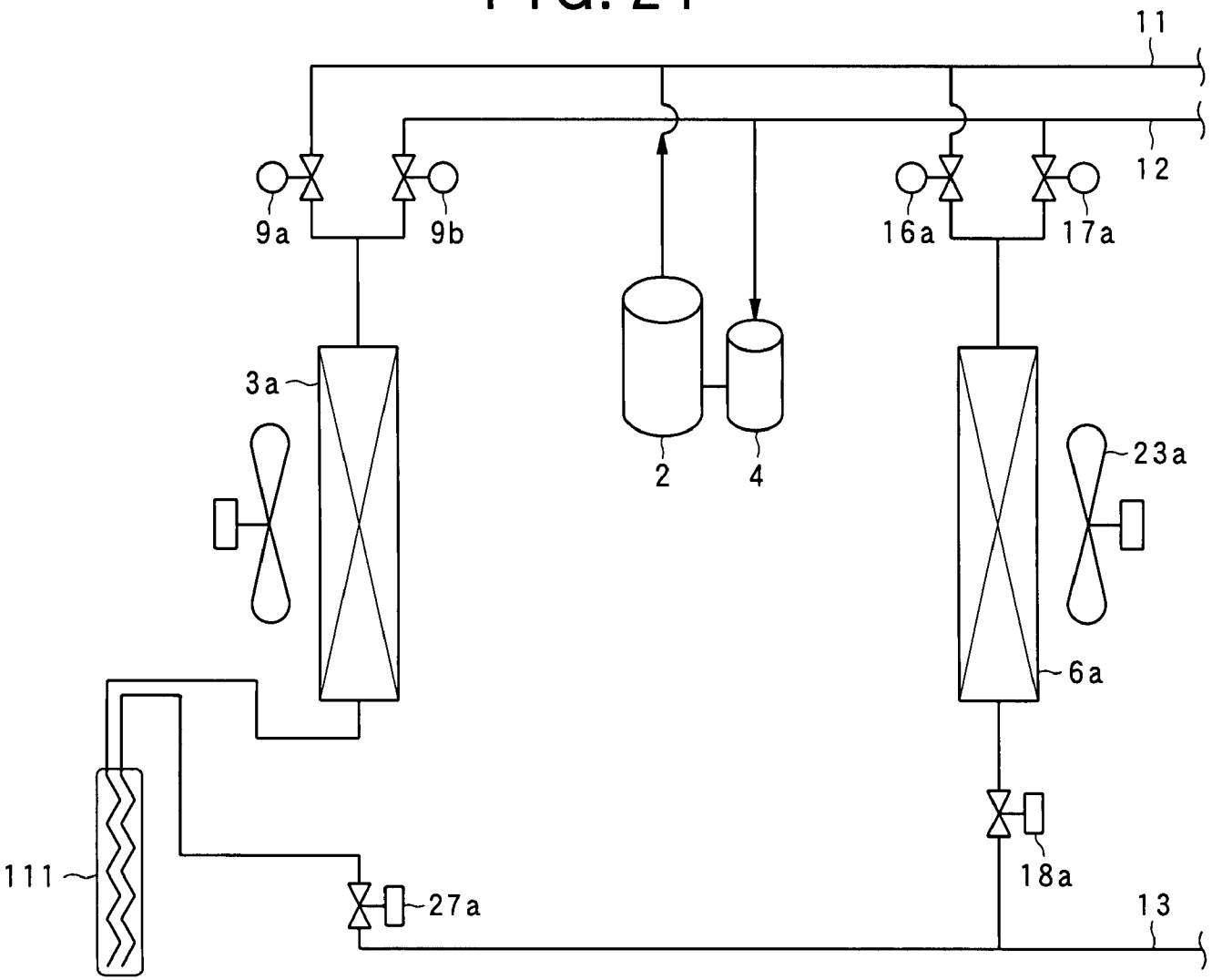
FIG. 21 is a diagram showing the main part of a refrigerant circuit diagram of a refrigerating machine according to a sixteenth embodiment.

FIG. 21 is a diagram showing the details of the main part of a sixteenth embodiment. The refrigerating machine of the sixteenth embodiment is different from the refrigerating machine of the fifteenth embodiment in that an underground-heat exchanger 111 (corresponding to the second heat exchanger 103 of the fifteenth embodiment) is provided in place of the underground heat exchanger 101. In FIG. 21, the underground heat exchanger 111 provided in place of the water cooling device 28*b* is not illustrated for simplification of the illustration.

These underground heat exchangers 111 are connected to the outdoor heat exchangers 3*a*, 3*b* and the outdoor expansion valves 27*a*, 27*b* as shown in FIG. 21.

In this case, by cooling or heating the refrigerant with underground-heat, the pressure ratio can be reduced, and also the enthalpy difference can be increased. Therefore, when the same power is secured, the refrigerant circulation amount can be reduced. In other words, in addition to the reduction of the pressure ratio, the compression power can be reduced, and the coefficient of performance (COP) of the heat exchange can be enhanced.

Next, the operation of the refrigerating machine 30 according to the sixteenth embodiment will be described.

Cooling Operation

First, the operation of the refrigerating machine under cooling operation will be described.

When cooling is carried out in the indoor units 5*a*, 5*b*, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. Furthermore, the outdoor fans 29*a*, 29*b* and the indoor fans 23*a*, 23*b* are set to the driving state, and the circulating pump 45 is set to the stop state.

In this case, the opening degrees of the outdoor expansion valves 27*a*, 27*b* and the indoor expansion valves 18*a*, 18*b* are controlled so that the temperature sensor S4 detects a predetermined temperature, and the difference between the detection temperature of the temperature sensor S1 and the detection temperature of the temperature sensor S2 (corresponding to the superheat degree) is equal to a fixed value.

When the compressor 2 is driven under the above state, the refrigerant discharged from the compressor 2 successively flows through the discharge pipe 7, the change-over valves 9*a*, 19*a* and the outdoor heat exchangers 3*a*, 3*b*.

The refrigerant is heat exchanged in the outdoor heat exchangers 3*a*, 3*b*, and then reaches the underground heat exchanger 111. Accordingly, the underground heat exchanger 111 cools (heat-exchanges) the refrigerant discharged from the outdoor heat exchangers 3*a*, 3*b* with underground-heat and feed the refrigerant to the outdoor expansion valves 27*a*, 27*b*.

The refrigerant passing through the underground heat exchanger 111 passes through the outdoor expansion valves 27*a*, 27*b* and flows into the intermediate pressure pipe 13. Thereafter, it is distributed to the indoor expansion valves 18*a*, 18*b* of the indoor units 5*a*, 5*b*, and reduced in pressure there.

Thereafter, the refrigerant is evaporated in the indoor heat exchangers 6*a*, 6*b*, and flows to the suction side valves 17*a*, 17*b*. Thereafter, it is successively passed through the low pressure pipe 12, the suction pipe 8 and the accumulator 4, and then sucked into the compressor 2. As described above, cooling operation is carried out in all the indoor units 5*a*, 5*b* at the same time by the action of the indoor heat exchangers 6*a*, 6*b* functioning as evaporators.

According to the construction as described above, the underground heat exchanger 111 cools (heat-exchanges) the refrigerant discharged from the outdoor heat exchangers 3*a*, 3*b* with underground-heat, so that the pressure at the high pressure side to achieve a necessary enthalpy difference can be reduced and the compression power in the compressor 2 can be reduced.

Heating Operation

Next, the operation of the refrigerating machine under heating operation will be described.

When heating operation is carried out in the indoor units 5*a*, 5*b*, the change-over valves 9*a*, 19*a* of the outdoor heat exchangers 3*a*, 3*b* are closed, and the other change-over valves 9*b*, 19*b* are opened. In addition, the discharge side valves 16*a*, 16*b* are opened, and the suction side valves 17*a*, 17*b* are closed. Accordingly, the refrigerant discharged from the compressor 2 successively flows through the discharge pipe 7 and the high pressure pipe 11, and then flows to the discharge side valves 16*a*, 16*b* and the indoor heat exchangers 6*a*, 6*b*. The refrigerant is heat-exchanged without being condensed in the indoor heat exchangers 6*a*, 6*b*, passed through the indoor expansion valves 18*a*, 18*b* and then distributed through the intermediate pressure pipe 13 to the indoor expansion valves 27*a*, 27*b* of the indoor unit 1 to be reduced in pressure.

Thereafter, the refrigerant reaches the underground heat exchangers 111. Accordingly, the round-heat heat exchangers 111 heat (heat-exchange) the refrigerant discharged from the outdoor heat exchangers 3*a*, 3*b* with underground-heat. The refrigerant passed through the underground heat exchangers 111 is evaporated in the outdoor heat exchangers 3*a*, 3*b*, and flows to the change-over valves 9*b*, 19*b*. Thereafter, the refrigerant is successively passed through the low pressure pipe 12, the suction pipe 8 and the accumulator 4, and then sucked into the compressor 2. As described above, heating operation is carried out in all the indoor units 5*a*, 5*b* at the same time by the non-condensed heat-exchange action of the indoor heat exchangers 6*a*, 6*b*.

Cooling and Heating Mixed Operation

Next, the operation of the refrigerating machine under cooling and heating mixed operation will be described.

When cooling operation and heating operation are carried out in different indoor units at the same time, for example when cooling operation is carried out in the indoor unit 5*a*, heating operation is carried out in the indoor unit 5*b* and a cooling load is larger than a heating load, the change-over valves 9*a*, 19*a* of the outdoor heat exchangers 3*a*, 3*b* are opened, and the other change-over valves 9*b*, 19*b* are closed. Furthermore, the discharge side valve 16*a* corresponding to the indoor unit 5*a* carrying out cooling operation is closed, and the suction side valve 17*a* is opened. Furthermore, the discharge side valve 16*b* corresponding to the indoor unit 5*b* carrying out heating operation is opened, and the suction side valve 17*b* is closed. As a result, a part of the refrigerant discharged from the compressor 2 is successively passed through the discharge pipe 7 and the change-over valves 9*a*, 19*a* and then fed to the outdoor heat exchanger 3*a*. Then, the refrigerant is heat-exchanged in the outdoor heat exchanger 3*a*, and then reaches the underground heat exchanger 111.

Accordingly, the underground heat exchanger 111 cools (heat-exchanges) the refrigerant discharged from the outdoor heat exchanger 3*a* with underground-heat. The refrigerant passing through the underground heat exchanger 111 flows through the outdoor expansion valve 27*a* into the intermediate pressure pipe 13.

Furthermore, the residual refrigerant which does not flow to the outdoor heat exchanger 3 passes through the high pressure pipe 11, and flows to the discharge side valve 16*b* corresponding to the indoor unit 5*b* carrying out heating operation and the indoor heat exchanger 6*b*. The refrigerant is subjected to non-condensing heat-exchange action in the indoor heat exchanger 6*b* and the outdoor heat exchanger 3.

The refrigerant heat-exchanged in the indoor heat exchanger 6*b* and the outdoor heat exchanger 3 is passed through the intermediate pressure pipe 13, reduced in pressure by the indoor expansion valve 18*a* of the indoor unit 5*a*, and then evaporated in the indoor heat exchanger 6*a*. Thereafter, the refrigerant flows through the suction side valve 17*a*, and it is confluent in the low pressure pipe 12. Thereafter, the refrigerant is successively passed through the suction pipe 8 and the accumulator 4 and then sucked into the compressor 2. As described above, heating operation is carried out in the indoor unit 5*b* by the heat-exchange action of the indoor heat-exchange action of the indoor heat exchanger 6*b*, and cooling operation is carried out in the indoor unit 5*a* by the action of the other indoor heat exchanger 6*a* functioning as an evaporator.

Cooling+Hot-Water Stocking Operation (Part 1)

Next, a first operation of the refrigerating machine under (cooling+hot-water stocking) operation will be described.

When (cooling+hot-water stocking) operation is carried out, the change-over valves 9*a*, 19*a* of the outdoor heat exchangers 3*a*, 3*b* are opened, and the other change-over valves 9*b*, 19*b* are closed. In addition, the discharge side valves 16*a*, 16*b* are closed, and the suction side valves 17*a*, 17*b* are opened. The outdoor fans 29*a*, 29*b* and the indoor fans 23*a*, 23*b* are set to the driving state, and the circulating pump 45 is set to the driving state. Furthermore, the switching valve 45 for connecting the high pressure pipe 11 and the hot-water stocking heat exchanger 41 is opened.

When the compressor 2 is driven under the above state, a part of the refrigerant discharged from the compressor 2 is led through the discharge pipe 7, the high pressure pipe 11 and the switching valve 48 to the hot-water stocking heat exchanger 41. In the hot-water stocking heat exchanger 41, water passing through the water pipe 46 is heated, and high-temperature water is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant thus heat-exchanged reaches through the expansion valve 47 to the intermediate pressure pipe 13, and it is distributed to the indoor expansion valves 18*a*, 18*b* of the indoor units 5*a*, 5*b* to be reduced in pressure. Furthermore, the refrigerant is evaporated in the indoor heat exchangers 6*a*, 6*b*, and flows to the suction side valves 17*a*, 17*b*. Thereafter, it is successively passed through the low voltage pipe 12, the suction pipe 8 and the accumulator 4, and then sucked into the compressor 2. The other part of the refrigerant discharged from the compressor 2 successively flows to the discharge pipe 7, the change-over valves 9*a*, 19*a* and the outdoor heat exchangers 3*a*, 3*b*. The refrigerant is heat-exchanged in the outdoor heat exchangers 3*a*, 3*b*, and reaches the underground heat exchangers 111.

Accordingly, the underground heat exchangers 111 cool (heat-exchange) the refrigerant discharged from the outdoor heat exchangers 3*a*, 3*b* with underground-heat, and then feed the refrigerant thus cooled to the outdoor expansion valves 27*a*, 27*b*.

The refrigerant passing through the underground heat exchangers 111 flows through the outdoor expansion valves 27*a*, 27*b* to the intermediate pressure pipe 13, and then it is distributed to the indoor expansion valves 18*a*, 18*b* of the indoor units 5*a*, 5*b* to be reduced in pressure.

Thereafter, the refrigerant is evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator 4, and then sucked into the compressor 2. As described above, cooling operation is carried out in all the indoor units 5*a*, 5*b* by the action of the indoor heat exchangers 6*a*, 6*b* functioning as evaporators.

Cooling+Hot-Water Stocking Operation (Part 2)

Next, a second operation of the refrigerating machine under (cooling+hot-water stocking) operation will be described.

When (cooling+hot-water stocking) operation is carried out, the change-over valves 9*a*, 19*a*, 9*b*, 19*b* of the outdoor heat exchangers 3*a*, 3*b* are closed. In addition, the discharge side valves 16*a*, 16*b* are closed, and the suction side valves 17*a*, 17*b* are opened. Furthermore, the outdoor fans 29*a*, 29*b* are set to the stop state, the indoor fans 23*a*, 23*b* are set to the driving state, and the circulating pump 45 is set to the driving state. Furthermore, the switching valve 48 for connecting the high pressure pipe 11 and the hot-water stocking heat exchanger 41 is opened.

When the compressor 2 is driven under the above state, the refrigerant discharged from the compressor 2 is led through the discharge pipe 7, the high pressure pipe 11 and the switching valve 48 to the hot-water stocking heat exchanger 41. In the hot-water stocking heat exchanger 41, water passing through the water pipe 46 is heated, and high-temperature water thus achieved is stocked in the hot-water stocking tank 43. Carbon dioxide refrigerant is used as the refrigerant, and the high-pressure supercritical cycle is established. Therefore, the temperature of the water thus stocked is increased to about 80° C. or more. The hot water stocked in the hot-water stocking tank 43 is fed to various facilities through pipes (not shown) (hot-water stocking operation).

The refrigerant thus heat-exchanged is fed through the expansion valve 47 to the intermediate pressure pipe 13, and distributed to the indoor expansion valves 18*a*, 18*b* of the indoor units 5*a*,5*b* to be reduced in pressure. Furthermore, the refrigerant is evaporated in the indoor heat exchangers 6*a*, 6*b*, and flows to the suction side valves 17*a*, 17*b*. Thereafter, the refrigerant is successively passed through the low pressure pipe 12, the suction pipe 8 and the accumulator 4 and then sucked into the compressor 2. The other operations are the same as the first embodiment, and the effect thereof is the same as the first embodiment. Therefore, the detailed description thereof is omitted.

[17] Seventeenth Embodiment

Figure 22:
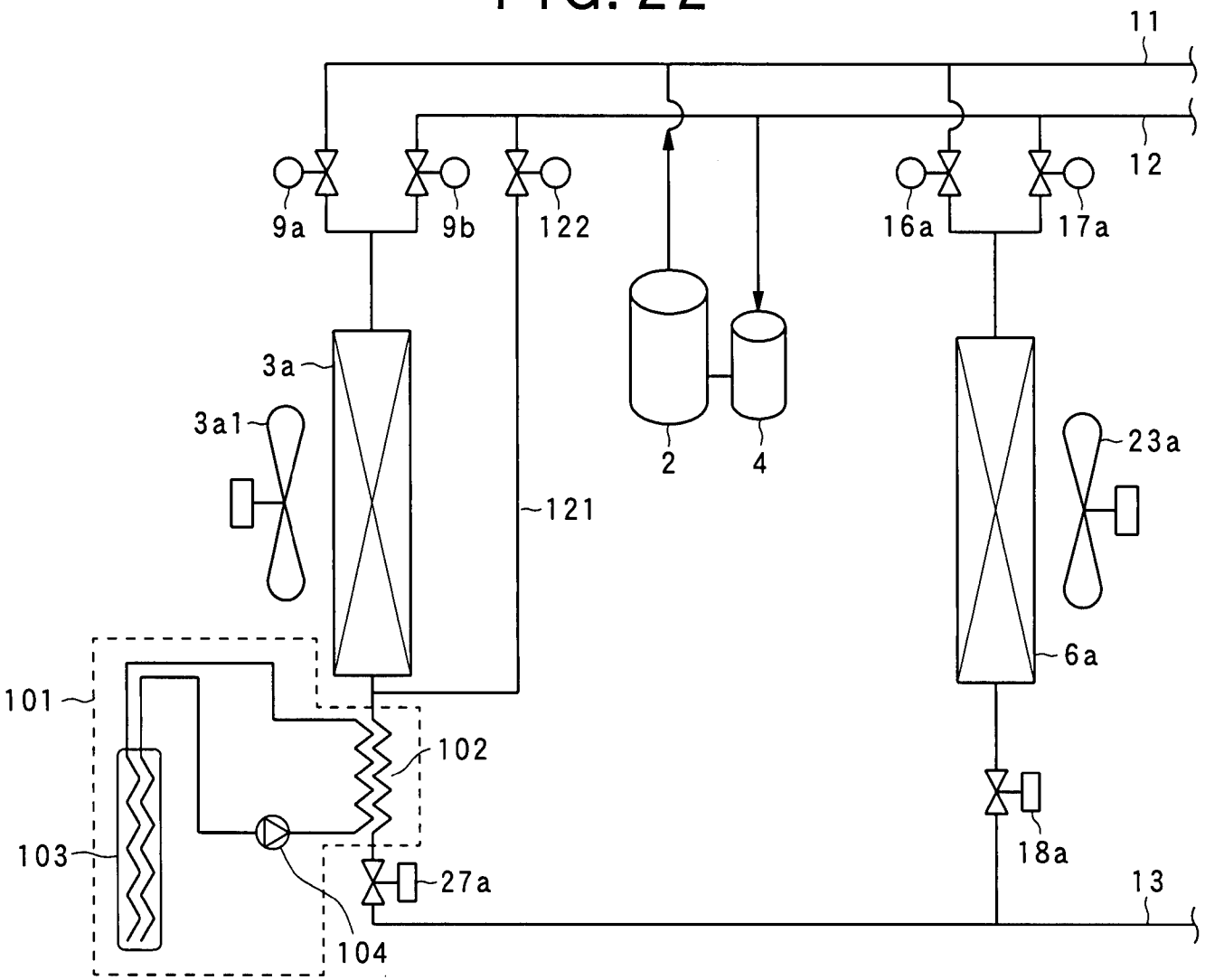
FIG. 22 is a diagram showing the main part of a refrigerant circuit diagram of a refrigerating machine according to a seventeenth embodiment.

FIG. 22 is a diagram showing the details of the main part of a seventh embodiment. The refrigerant machine of the seventh embodiment is different from the refrigerating machine of the fifteenth embodiment in that a bypass pipe 121 and a change-over valve 122 are provided by utilizing only underground-heat without using the outdoor heat exchangers 3*a*, 3*b* serving as the heat-source side heat exchangers under heating or hot-water supplying operation.

The bypass pipe 121 and the change-over valve 122 are connected between the connection point between the outdoor heat exchanger 3*a* (3*b*) and the underground heat exchanger 101 and the low pressure pipe 12. In this case, by heating the refrigerant with underground-heat, the pressure ratio can be reduced, and the enthalpy difference is increased. Therefore, in the case where the same power is secured, the circulating amount of the refrigerant can be reduced. In other words, in addition to the reduction of the pressure ratio, the compression power can be reduced, and thus the coefficient of performance (COP) of the heat exchange can be enhanced.

Next, the operation of the refrigerating machine 30 of the seventeenth embodiment will be described under heating or hot-water supplying operation.

Heating Operation

First, the operation of the refrigerating machine under heating operation will be described.

When heating operation is carried out in the indoor units 5*a*, 5*b*, the change-over valves 9*a*, 9*b*, 19*a*, 19*b* of the outdoor heat exchangers 3*a*, 3*b* are closed. In addition, the discharge side valves 16*a*, 16*b* are opened, and the suction side valves 17*a*, 17*b* are closed. Accordingly, the refrigerant discharged from the compressor 2 is successively passed through the discharge pipe 7 and the high pressure pipe 11, and flows to the discharge side valves 16*a*, 16*b* and the indoor heat exchangers 6*a*, 6*b*. The refrigerant is heat-exchanged without being condensed in the indoor heat exchangers 6*a*, 6*b*, passed through the indoor expansion valves 18*a*, 18*b*, and then distributed to the outdoor expansion valves 27*a*, 27*b* through the intermediate pressure pipe 13 to be reduced in pressure.

Thereafter, the refrigerant is fed to the first heat exchanger 102, and heated (heat-exchanged) with brine. At this time, the brine heat-exchanged in the first heat exchanger 102 is fed to the second heat exchanger 103 to be heated with underground-heat, and then circulated through the brine pump 104 to the first heat exchanger 102 again.

The refrigerant passing through the underground heat exchanger 101 is evaporated, and flows through the bypass pipe 121 and the change-over valve 122. Therefore, the refrigerant is successively passed through the low pressure pipe 12, the suction pipe 8 and the accumulator 4, and then sucked into the compressor 2. As described above, heating operation is carried out in all the indoor units 5*a*, 5*b* at the same time by the non-condensing heat-exchange action of the indoor heat exchangers 6*a*, 6*b*.

The operations of the underground heat exchangers 111, the bypass pipe 121 and the bypass valve 122 when the heating load is larger than the cooing load during the hot-water stocking operation, during the heating and hot-water stocking mixed operation or during the cooling and heating mixed operation, or when the heating and hot-water supplying load is larger than the cooling load during the cooling, heating and hot-water stocking mixed operation are the same as when the heating operation is carried out, and also the effect thereof is also the same. Therefore, the detailed description thereof is omitted.

[17.1] Modification of Seventeenth Embodiment

In the foregoing description, the bypass pipe 121 and the change-over valve 122 are provided so that the refrigerant is not passed through the outdoor heat exchangers 3*a*, 3*b* serving as the heat-source side heat exchangers during heating operation. However, it may be modified so that the fans (the outdoor fans 3*a*1 in FIG. 22) corresponding to the outdoor heat exchangers 3*a*, 3*b* are not operated, and the refrigerant is merely passed through the outdoor heat exchangers 3*a*, 3*b*.

[18] Effect of the Embodiments

As described above, according to the respective embodiments described above, the water cooling device or the ice heat storage tank cools (heat-exchanges) the refrigerant discharged from the outdoor heat exchangers 3*a*, 3*b* with water or ice. Therefore, the pressure at the high pressure side to achieve a necessary enthalpy difference can be reduced, and further the circulating amount of the refrigerant can be reduced by the amount corresponding to the increase in enthalpy difference, so that the compression power of the compressor 2 can be reduced.

As a result, the coefficient of performance (COP) can be enhanced.

[19] Modification of the Embodiments

[19.1] First Modification

In the foregoing description, the expansion valve of the second-stage (low pressure side) is controlled so that the temperature difference between the temperature sensor disposed at the center portion of the heat exchanger used as an evaporator and the temperature sensor disposed at the exit portion of the heat exchanger concerned (so-called superheat degree) is equal to each other, the expansion valve of the first-stage (high pressure side) is controlled so that the pressure at the high pressure side and the intermediate pressure temperature are equal to predetermined values, the predetermined values of the pressure at the high pressure side and the temperature at the intermediate pressure portion are determined from the exit temperature of the heat exchanger used as the radiator (radiation side heat exchanger) and the temperature of the heat exchanger functioning as an evaporator so that the cycle efficiency is optimal, and the compressor carries out capacitance control (rotational number control) in accordance with the load. However, the following other values may be used as the control amounts to implement the same control operation.

(1) The temperature at the intermediate pressure portion may be substituted by the pressure at the intermediate pressure portion.

(2) The temperature of the evaporator may be substituted by the pressure of the evaporator, the outside air temperature or the indoor temperature.

(3) The temperature at the exit of the radiation side heat exchanger may be substituted by the outside air temperature, the indoor temperature and the supply water temperature.

(4) The pressure at the high-pressure side may be substituted by the temperature at the discharge side.

[19.2] Second Modification

In the description of the fifteenth embodiment to the seventeenth embodiment, the underground-heat is not described in detail. However, it may underground water or ground heat. Furthermore, various kinds of natural heat sources such as atmospheric air, underground water, river water, seawater, underground heat, etc. may be utilized alone or in combination.

What is claimed is:

1. A heat exchange apparatus including an outdoor unit having a compressor (2), an outdoor heat exchanger (3*a*, 3*b*) serving as a heat-source side heat exchanger and an outdoor expansion valve (27*a*, 27*b*) and at least one indoor unit (5*a*, 5*b*) having an indoor expansion valve (18*a*, 18*b*) and an indoor heat exchanger (6*a*, 6*b*) serving as a use-side heat exchanger, the outdoor heat exchanger and the indoor heat exchanger being connected to each other through an inter-unit pipe to constitute an heat exchange cycle, characterized in that a heat exchanger (28*a*, 28*b*, 65, 85, 101, 111) for carrying out heat exchange between a heat medium and refrigerant after the refrigerant is heat-exchanged in the heat-source side heat exchanger (3*a*, 3*b*) or carrying out heat exchange between the heat medium and the refrigerant with no heat-exchange of the refrigerant in the heat-source side heat exchanger (3*a*, 3*b*) during operation is provided between the outdoor expansion valve (27*a*, 27*b*) and the heat-source side heat exchanger (3*a*, 3*b*).

2. The heat exchange apparatus according to claim 1, wherein the heat exchanger comprises a first heat exchanger (51, 102) that is disposed between the outdoor expansion valve (27*a*, 27*b*) and the heat-source side heat exchanger (3*a*, 3*b*) and carries out the heat exchange between the heat medium and the refrigerant after the refrigerant is heat-exchanged in the heat-source side heat exchanger (3*a*, 3*b*) or carries out the heat exchange between the refrigerant and the heat medium with no heat-exchange of the refrigerant in the heat-source side heat exchanger (3*a*, 3*b*) during operation, and a second heat exchanger (52, 103) for carrying out heat exchange between the heat medium and a heat source.

3. The heat exchange apparatus according to claim 2, wherein the heat source is at least one of atmospheric air, underground water, river water, seawater and underground heat.

4. The heat exchange apparatus according to claim 1, wherein the heat exchanger comprises a cooling heat exchanger for cooling the refrigerant after the heat-exchange of the refrigerant in the heat-source side heat exchanger during cooling operation.

5. The heat exchange apparatus according to claim 4, wherein the cooling heat exchanger comprises a cooling heat exchanger (51, 102) that is disposed between the outdoor expansion valve and the heat-source side heat exchanger and cools the refrigerant after the heat-exchange of the refrigerant in the heat-source side heat exchanger (3*a*, 3*b*) with a cooling medium during cooing operation, and a second heat exchanger (52, 103) for cooling the cooling medium of the cooling heat exchanger with a heat source.

6. The heat exchange apparatus according to claim 5, wherein the cooling medium is water or brine.

7. The heat exchange apparatus according to claim 5, wherein the heat source is at least one of atmospheric air, underground water, river water, seawater and underground heat.

8. A refrigerating machine comprising:

an outdoor unit having a compressor (2), an outdoor heat exchanger (3*a*,3*b*) serving as a heat-source side heat exchanger and an outdoor expansion valve (27*a*, 27*b*); and at least one indoor unit (5*a*, 5*b*) having an indoor expansion valve (18*a*, 18*b*) and an indoor heat exchanger (6*a*, 6*b*) serving as a use-side heat exchanger, the outdoor heat exchanger and each of the indoor heat exchangers being connected to each other through an inter-unit pipe to constitute an heat exchange cycle, characterized in that one end of the outdoor heat exchanger is selectively connected to one of a refrigerant discharge pipe and a refrigerant suction pipe of the compressor, the inter-unit pipe comprises a high pressure pipe connected to the refrigerant discharge pipe, a low pressure pipe connected to the refrigerant suction pipe and an intermediate pressure pipe connected to the other end of the outdoor heat exchanger, one end of each indoor heat exchanger in each of the indoor units is selectively connected to one of the high pressure pipe and the low pressure gas pipe while the other end of the indoor heat exchanger is connected to the intermediate pressure pipe, whereby cooling operation or heating operation is simultaneously performed in different indoor units or both cooling operation and heating operation is simultaneously performed in a mixing mode in different indoor units, and a cooling heat exchanger for cooling the refrigerant after heat-exchange in the heat-source side heat exchanger between the outdoor expansion valve and the heat-source side heat exchanger during cooling operation.

9. The refrigerating machine according to claim 8 wherein the cooling heat exchanger comprises a cooling heat exchanger (51, 102) that is disposed between the outdoor expansion valve and the heat-source side heat exchanger and cools the refrigerant after heat-exchange in the heat-source side heat exchanger (3*a*, 3*b*) with a cooling medium during cooing operation, and a second heat exchanger (52, 103) for cooling the cooling medium of the cooling heat exchanger with a heat source.

10. The refrigerating machine according to claim 9, wherein the cooling medium is water or brine.

11. The refrigerating machine according to claim 9, wherein the heat source is at least one of atmospheric air, underground water, river water, seawater and underground heat.

12. The refrigerating machine according to claim 8, wherein the cooling heat exchanger comprises an ice thermal storage tank that is disposed between the outdoor expansion valve and the heat-source side heat exchanger and cools the refrigerant after the heat exchange in the heat-source side heat exchanger during cooling operation.

13. The refrigerating machine according to claim 8, wherein in addition to the cooling heat exchanger, an ice thermal storage tank is provided so as to be disposed between the outdoor expansion valve and the heat-source side heat exchanger and so as to cool the refrigerant after the heat exchange in the heat-source side heat exchanger during cooling operation.

14. The refrigerating machine according to claim 8, wherein the compressor is equipped with an intermediate pressure portion into which refrigerant having intermediate pressure higher than refrigerant pressure at a suction side and lower than refrigerant pressure at a discharge side is introduced, and there is further provided an intermediate pressure receiver that is interposed in a flow path connecting the outdoor expansion valve at the heat-source side heat exchanger side and the indoor expansion valve at the use-side heat exchanger side, separates gas-liquid mixture refrigerant after the heat exchange in the heat-source side heat exchanger or the use-side heat exchanger into gas-phase refrigerant and liquid-phase refrigerant, and introduces the gas-phase refrigerant to the intermediate pressure portion of the compressor.

15. The refrigerating machine according to claim 8, wherein the compressor is equipped with an intermediate pressure portion into which refrigerant having intermediate pressure higher than refrigerant pressure at a suction side and lower than refrigerant pressure at a discharge side is introduced, and there is further provided a heat exchange circuit for branching refrigerant flowing from one of the heat-source side heat exchanger and the use-side heat exchanger to the other heat exchanger, carrying out heat exchange between one branched refrigerant and one of the other branched refrigerant and the refrigerant before the branching to set the one branched refrigerant to gas-phase refrigerant and then introducing the gas-phase refrigerant thus achieved to the intermediate pressure portion.

16. The refrigerating machine according to claim 8, wherein the pressure of the refrigerant at a high pressure side is supercritical during operation.

17. The refrigerating machine according to claim 16, wherein the refrigerant is carbon dioxide.

* * * * *